US012049791B2

(12) United States Patent
Garg et al.

(10) Patent No.: US 12,049,791 B2
(45) Date of Patent: Jul. 30, 2024

(54) PERFORATING GUN

(71) Applicant: Oso Perforating, LLC, Irving, TX (US)

(72) Inventors: Varun Garg, Dallas, TX (US); Jeremy Ursi, Frisco, TX (US); George Innes, III, Irving, TX (US)

(73) Assignee: OSO PERFORATING, LLC, Irving, TX (US)

( * ) Notice: Subject to any disclaimer, the term of this patent is extended or adjusted under 35 U.S.C. 154(b) by 0 days.

(21) Appl. No.: 18/317,188

(22) Filed: May 15, 2023

(65) Prior Publication Data

US 2023/0304362 A1 Sep. 28, 2023

Related U.S. Application Data

(63) Continuation of application No. 17/869,320, filed on Jul. 20, 2022, now Pat. No. 11,649,684.

(60) Provisional application No. 63/355,440, filed on Jun. 24, 2022, provisional application No. 63/224,338, filed on Jul. 21, 2021.

(51) Int. Cl.

| | |
|---|---|
| ***E21B 17/10*** | (2006.01) |
| ***E21B 43/00*** | (2006.01) |
| ***E21B 43/116*** | (2006.01) |
| ***E21B 43/119*** | (2006.01) |

(52) U.S. Cl.

CPC ..... *E21B 17/10* (2013.01); *E21B 43/00* (2013.01); *E21B 43/116* (2013.01); *E21B 43/119* (2013.01)

(58) Field of Classification Search

CPC ..... E21B 17/10; E21B 43/00; E21B 43/116; E21B 43/117; E21B 43/119

See application file for complete search history.

(56) References Cited

U.S. PATENT DOCUMENTS

| | | | |
|---|---|---|---|
| 11,078,762 | B2 | 8/2021 | Mauldin et al. |
| 11,255,162 | B2 | 2/2022 | Sullivan et al. |
| 11,674,371 | B1 | 6/2023 | Bradley et al. |
| 2021/0207934 | A1* | 7/2021 | Sullivan ..... E21B 43/1185 |
| 2023/0265748 | A1 | 8/2023 | Bradley et al. |
| 2023/0304384 | A1 | 9/2023 | Rajaram et al. |

* cited by examiner

*Primary Examiner* — Yong-Suk (Philip) Ro

(74) *Attorney, Agent, or Firm* — HAYNES AND BOONE, LLP

(57) ABSTRACT

A perforating gun used in oil and gas completions operations. A gun string including the perforating gun and one or more additional perforating guns substantially identical to the perforating gun.

9 Claims, 48 Drawing Sheets

PERFORATING GUN

CROSS-REFERENCE TO RELATED APPLICATIONS

This application is a continuation of U.S. patent application Ser. No. 17/869,320 (the "'320 Application"), filed Jul. 20, 2022, the entire disclosure of which is hereby incorporated herein by reference.

The '320 Application claims the benefit of the filing date of, and priority to, U.S. Patent Application No. 63/224,338 (the "'338 Application"), filed Jul. 21, 2021, the entire disclosure of which is hereby incorporated herein by reference.

The '320 Application also claims the benefit of the filing date of, and priority to, U.S. Patent Application No. 63/355,440 (the "'440 Application"), filed Jun. 24, 2022, the entire disclosure of which is hereby incorporated herein by reference.

TECHNICAL FIELD

The present disclosure relates generally to perforating guns used in oil and gas completions operations, and, more particularly, to a perforating gun with one or more centralizing charge tube inserts and, optionally, an orienting centralizer.

BRIEF DESCRIPTION OF THE DRAWINGS

FIG. 12C-1 is a cross-sectional view of the first perforating gun of FIG. 1 in a third operational state or configuration, according to one or more embodiments.

FIG. 12C-2 is an enlarged cross-sectional view of the first perforating gun of FIG. 12C-1 in the third operational state or configuration, according to one or more embodiments.

FIG. 12D-1 is a cross-sectional view of the first perforating gun of FIG. 1 in a fourth operational state or configuration, according to one or more embodiments.

FIG. 12D-2 is an enlarged cross-sectional view of the first perforating gun of FIG. 12D-1 in the fourth operational state or configuration, according to one or more embodiments.

FIG. 21D-1 is an elevational view of the second perforating gun of FIG. 14 in a fourth operational state or configuration, according to one or more embodiments.

FIG. 21D-2 is an enlarged cross-sectional view of the second perforating gun of FIG. 21D-1 in the fourth operational state or configuration, according to one or more embodiments.

DETAILED DESCRIPTION

Figure 1:
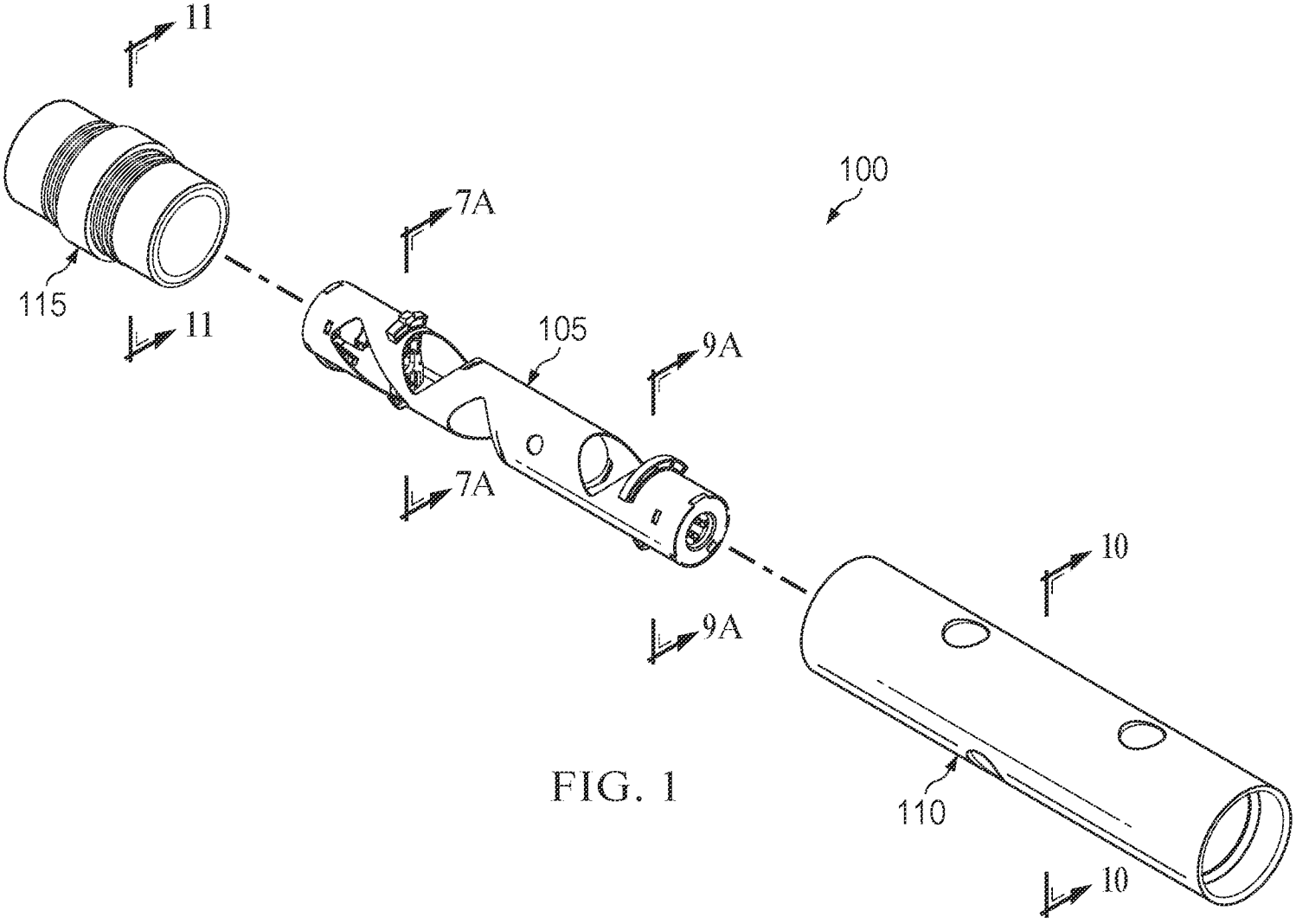
FIG. 1 is an exploded top-front-right-perspective view of a first perforating gun including a first charge cartridge, a first carrier tube, and a first conductor sub.

Referring to FIG. 1, in one or more embodiments, a perforating gun is generally referred to by the reference numeral 100. The perforating gun 100 includes a charge cartridge 105, a carrier tube 110, and a conductor sub 115. The charge cartridge 105 is adapted to house ballistic(s), which ballistic(s) include a singular or plurality of perforating charges and detonator cord, detonable to perforate a wellbore proximate a subterranean formation. The carrier tube 110 receives the assembled charge cartridge 105, including the ballistic(s), a detonator, and (optionally) a switch. The conductor sub 115 is adapted to: axially trap the charge cartridge 105 within the carrier tube 110; and conduct electricity to and/or from the charge cartridge 105 to facilitate detonation of the ballistic(s).

Figure 2:
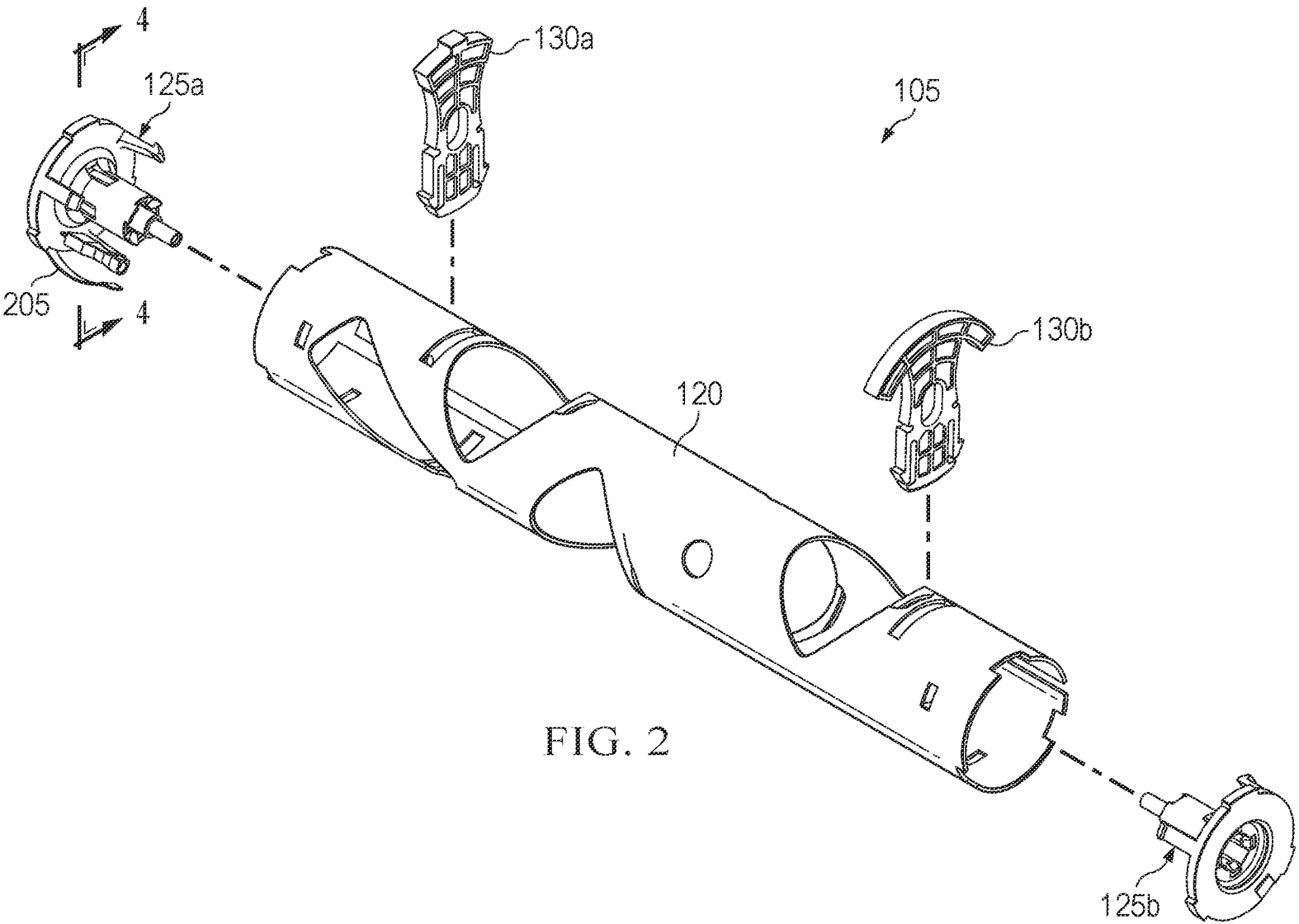
FIG. 2 is an exploded top-front-right-perspective view of the first charge cartridge of FIG. 1, which first charge cartridge includes a first charge tube, first and second cap assemblies, and first and second centralizing inserts, according to one or more embodiments.

Referring to FIG. 2, in one or more embodiments, the charge cartridge 105 includes a charge tube 120, cap assemblies 125*a-b*, centralizing inserts 130*a-b*, and (optionally) the switch (e.g., an addressable switch). The cap assemblies 125*a-b*, the centralizing inserts 130*a-b*, and (optionally) the switch are configured to be toollessly assembled with the charge tube 120 (e.g., without fastener(s)).

Figure 3A:
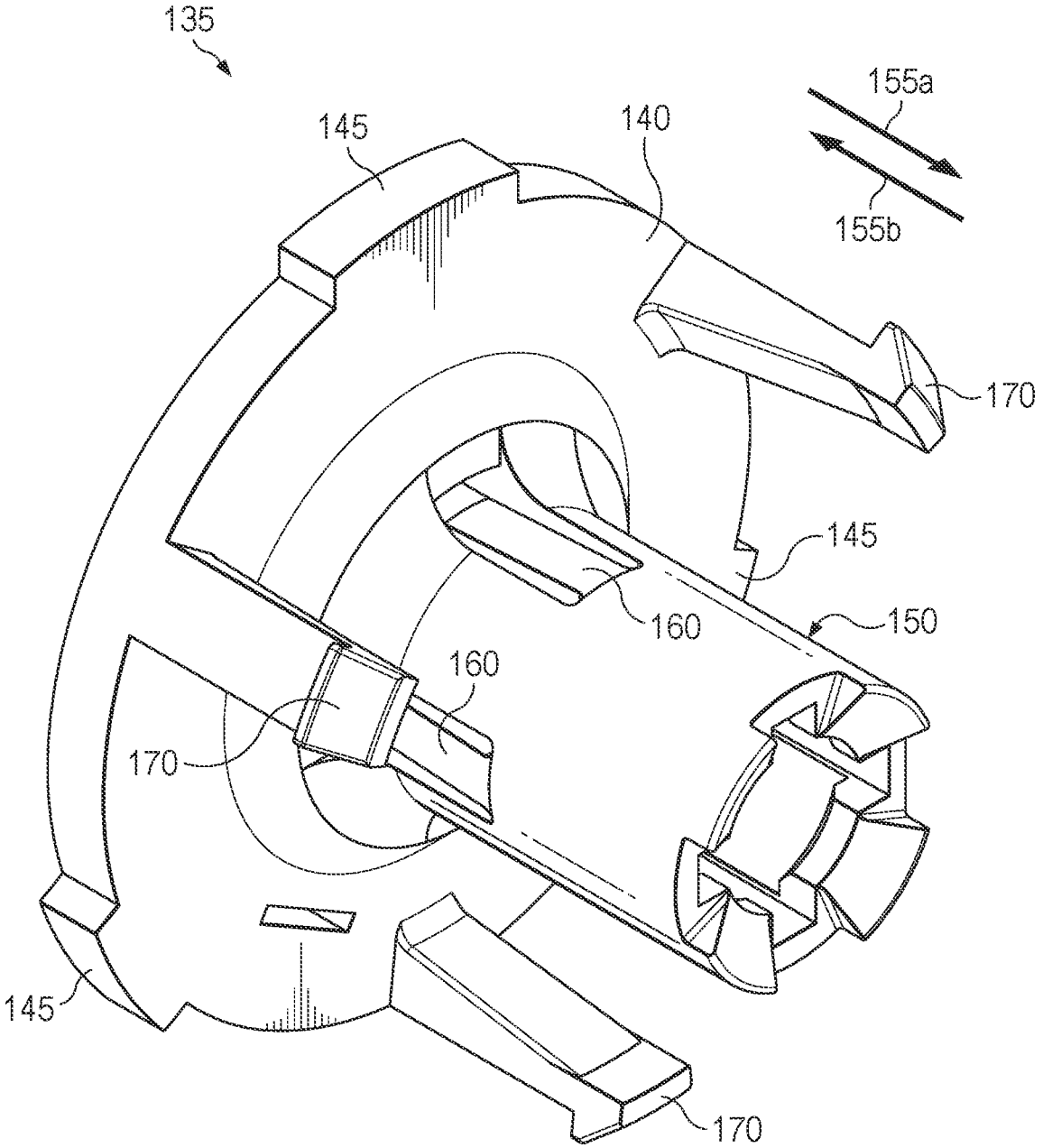
FIG. 3A is a top-front-right-perspective view of an end cap of the first cap assembly of FIG. 2, according to one or more embodiments.
Figure 3B:
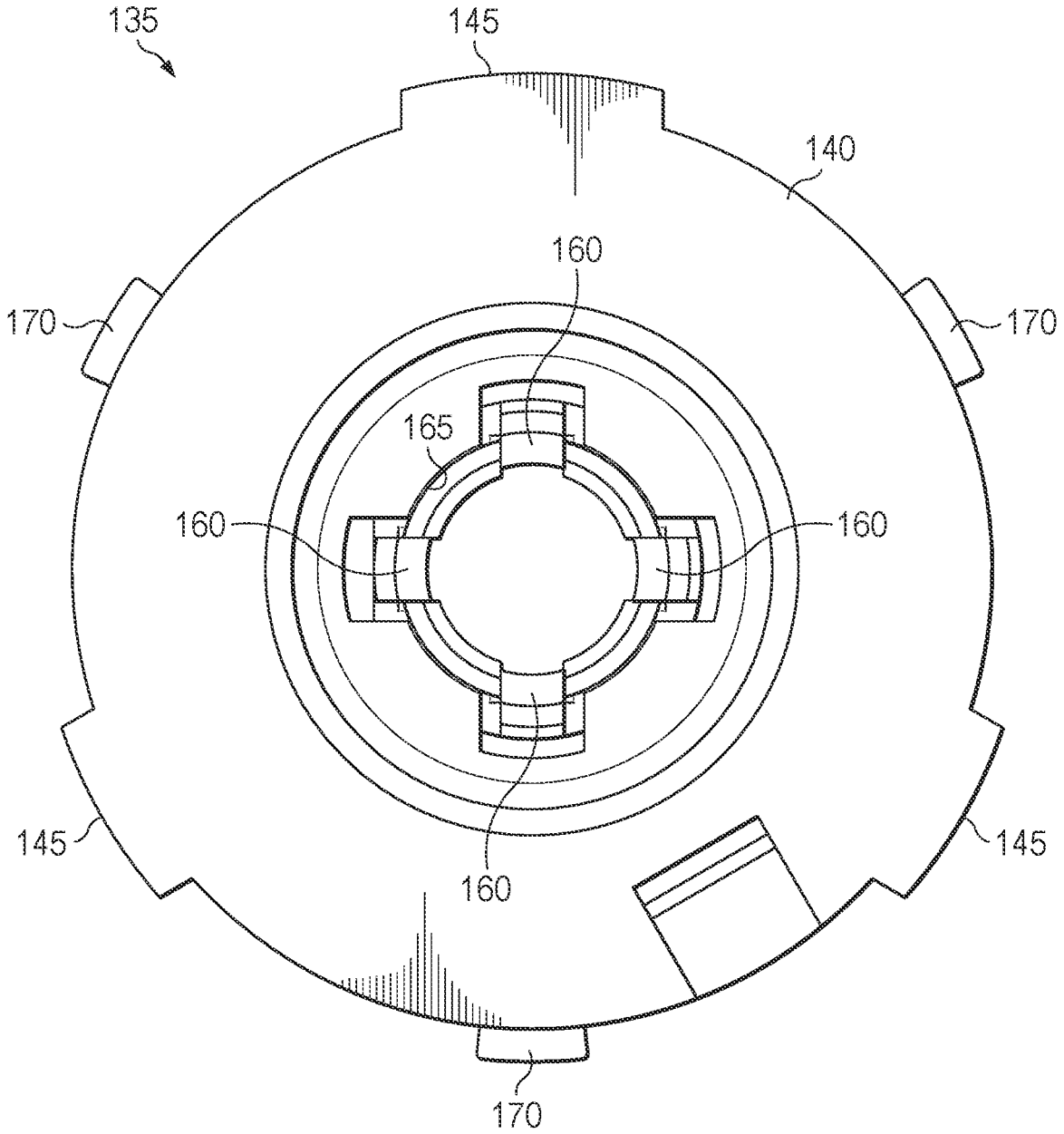
FIG. 3B is a rear elevational view of the end cap of FIG. 3A, according to one or more embodiments.

Referring to FIGS. 3A and 3B, in one or more embodiments, the cap assembly 125*a* includes an end cap 135. The end cap 135 includes an end plate 140, which end plate 140 is disk-shaped. One or more tabs 145 extend radially outwardly from an outer periphery of the end plate 140. A conductor housing 150 extends axially from the end plate 140 in a direction 155*a*. One or more latching features 160 extend axially from the conductor housing 150 in a direction 155*b*, opposite the direction 155*a*. In one or more embodiments, the latching feature(s) 160 are located along, or proximate, a circumference of a central aperture 165 of the end plate 140. In one or more embodiments, the latching feature(s) 160 are radially-inwardly-facing. Additionally, one or more latching features 170 extend axially from the outer periphery of the end plate 140 in the direction 155*a*. In one or more embodiments, the latching feature(s) 170 are located along, or proximate, an outer circumference of the end plate 140. In one or more embodiments, the latching feature(s) 170 are outwardly-facing. The cap assembly 125*b* is substantially identical to the cap assembly 125*a*, and, therefore, will not be described in further detail.

Figure 4:
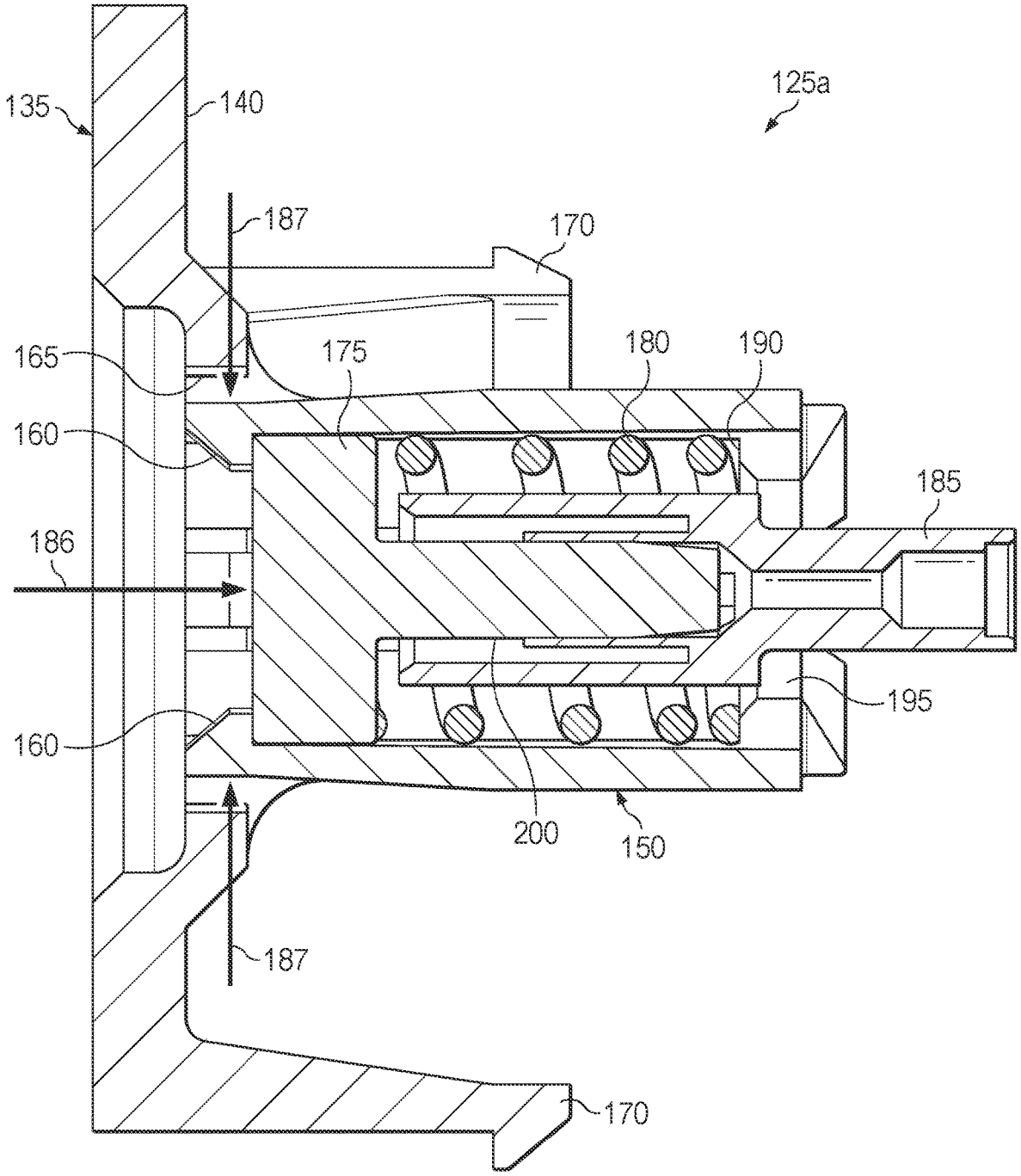
FIG. 4 is a cross-sectional view of the first cap assembly of FIG. 2 taken along the line 4-4 of FIG. 2, according to one or more embodiments.
Figure 5A:
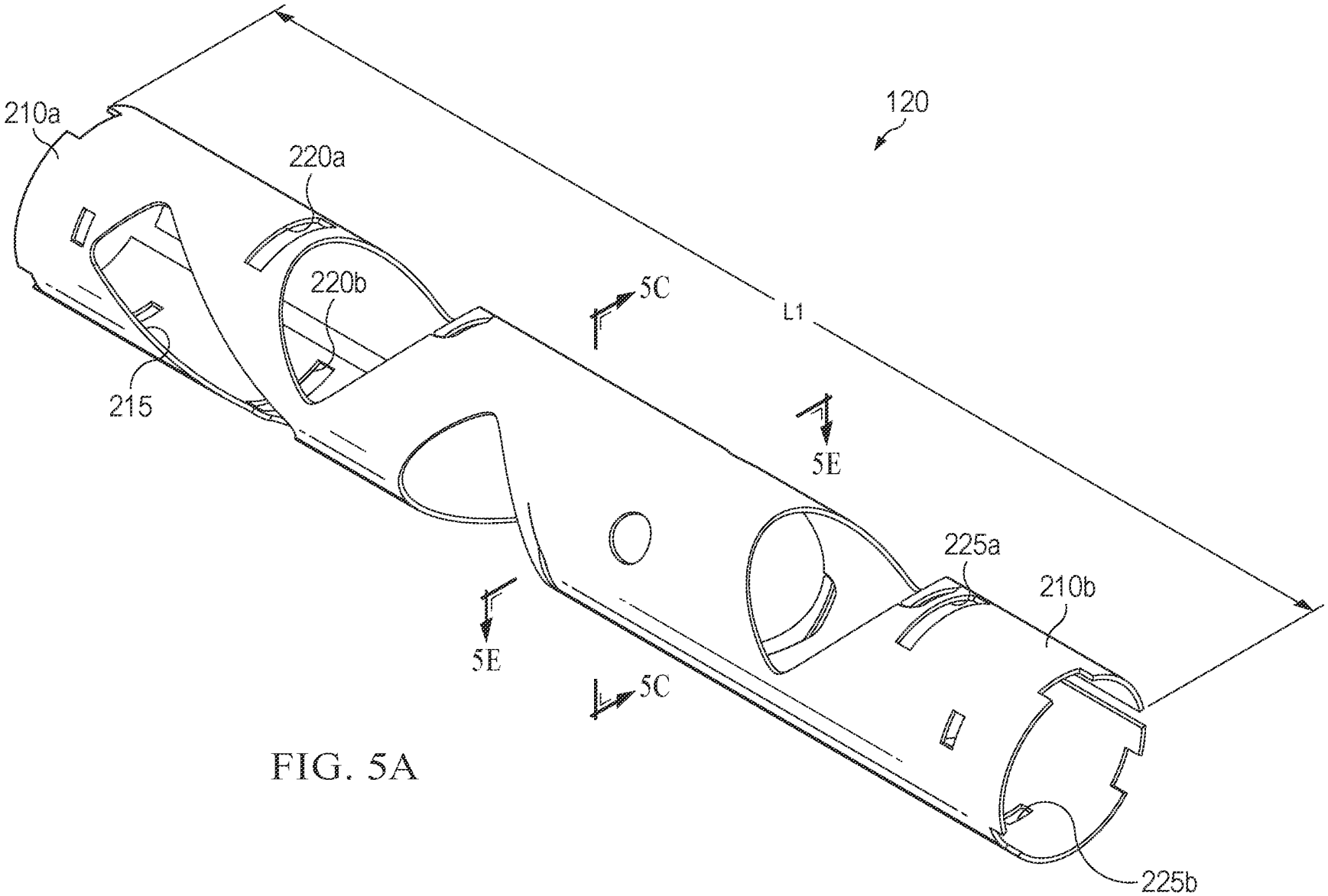
FIG. 5A is a top-front-right-perspective view of the first charge tube of FIG. 2, according to one or more embodiments.
Figure 5B:
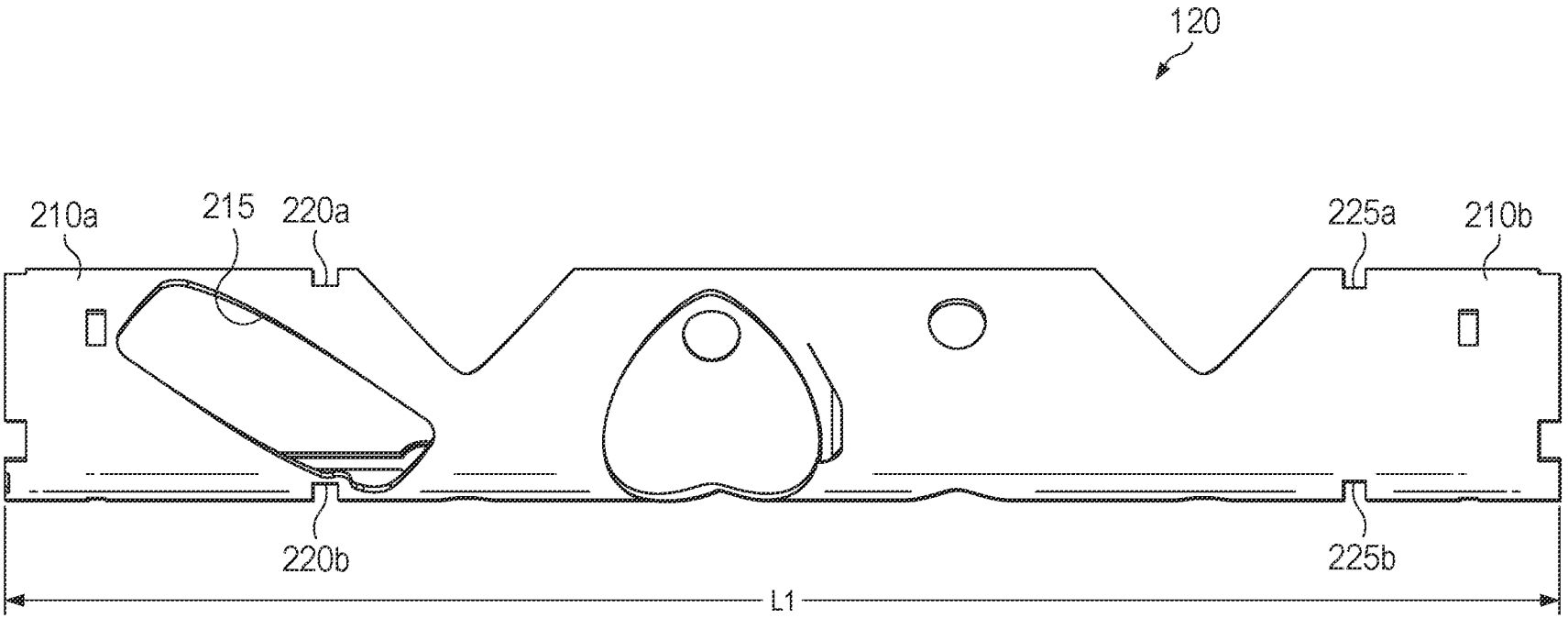
FIG. 5B is a right side elevational view of the first charge tube of FIG. 2, according to one or more embodiments.
Figure 5C:
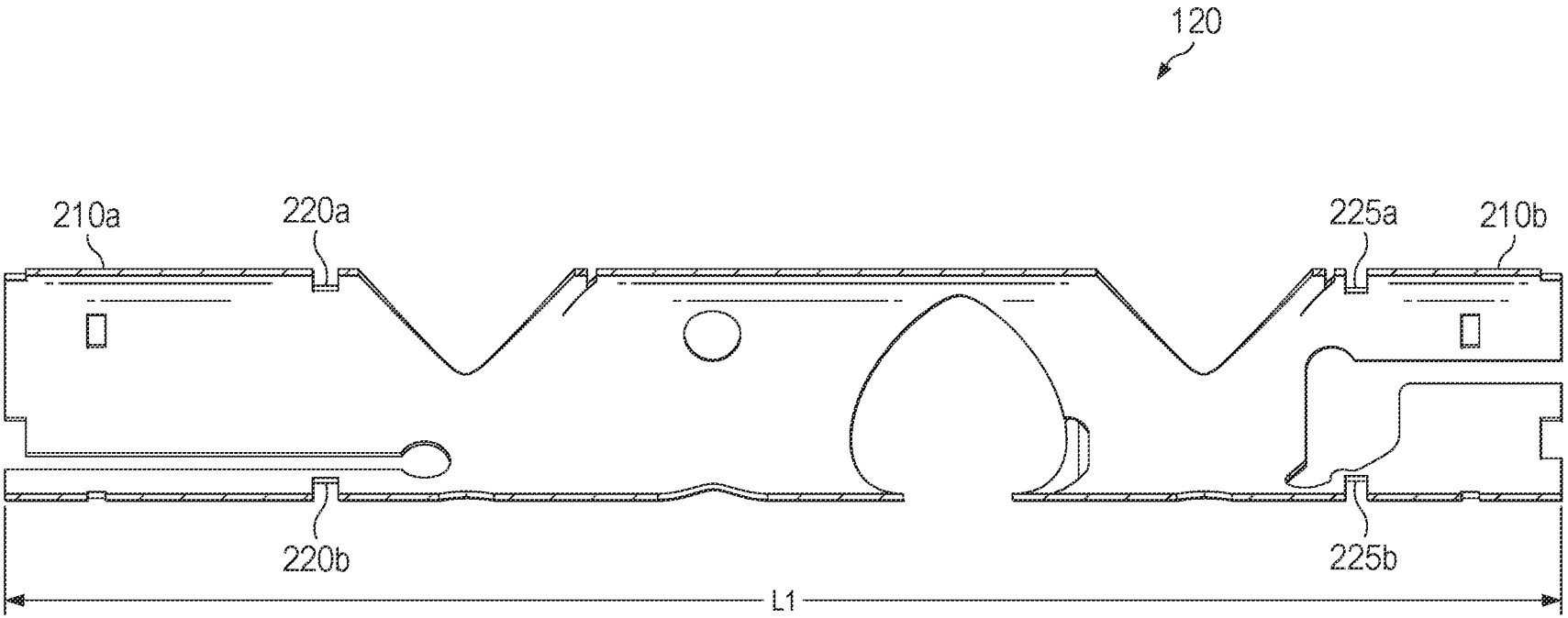
FIG. 5C is a cross-sectional view of the first charge tube of FIG. 2 taken along the line 5C-5C of FIG. 5A, according to one or more embodiments.
Figure 5D:
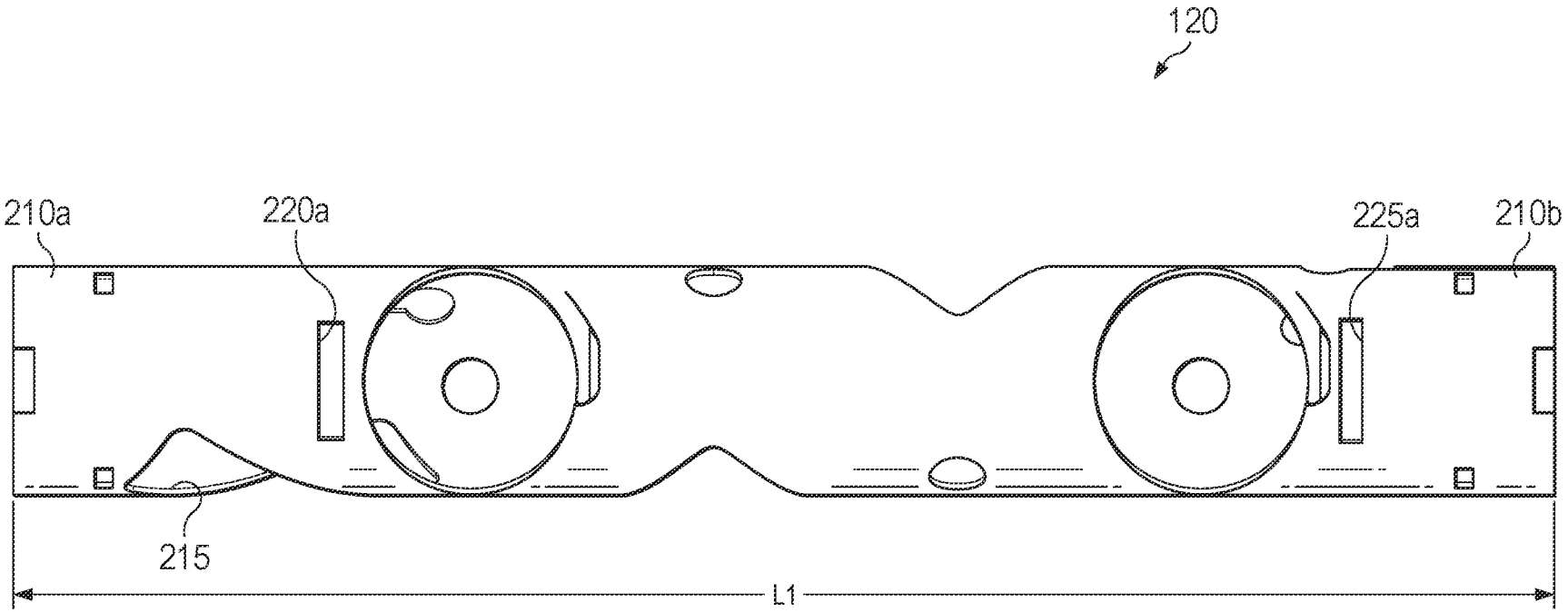
FIG. 5D is a top plan view of the first charge tube of FIG. 2 according to one or more embodiments.
Figure 5E:
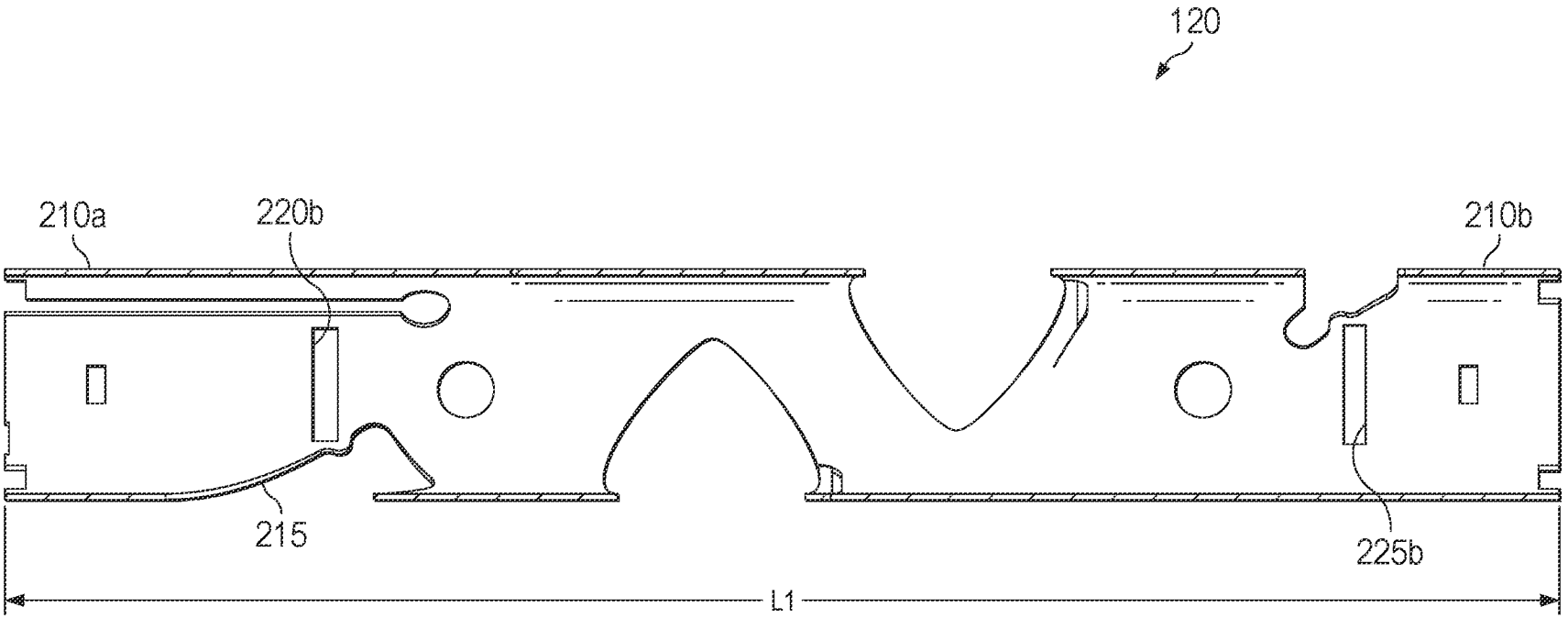
FIG. 5E is a cross-sectional view of the first charge tube of FIG. 2 taken along the line 5E-5E of FIG. 5A, according to one or more embodiments.

Referring to FIG. 4, in one or more embodiments, the cap assembly 125*a* includes the end cap 135, a conductor body 175 (or "contact conductor"), a biasing member 180 (e.g., a spring), and an electrical connector 185. The conductor body 175, the biasing member 180, and the electrical connector 185 are configured to be toollessly assembled with the end cap 135 (e.g., without fastener(s)). More particularly, the conductor body 175 and the biasing member 180 are inserted axially into the conductor housing 150, as indicated by arrow 186, via the central aperture 165 of the end plate 140, causing the latching feature(s) 160 of the end cap 135 to latch onto the conductor body 175, as indicated by arrows 187, thereby trapping the conductor body 175 between the latching feature(s) 160 and an internal annular shoulder 190 of the end cap 135. The electrical connector 185 extends through a central aperture 195 of the conductor housing 150, opposite the central aperture 165 of the end plate 140, fits over a reduced-diameter end portion 200 of the conductor body 175, and is adapted to electrically connect a wire from the detonator and/or the switch to the conductor body 175. In one or more embodiments, as in FIG. 2, the cap assembly 125*a* further includes a ground conductor 205 (e.g., toollessly coupled to the cap assembly 125*a*, and/or coupled to the cap assembly 125*a* without fastener(s)) adapted to provide grounding electrical contact between the charge tube 120 and the carrier tube 110 when the charge tube 120 is received within the carrier tube 110. In one or more embodiments, the ground conductor 205 is electrically coupled to ground (e.g., a ground "button" within the perforating gun 100) via a quick-connect wire (e.g., enabling toolless coupling of the ground conductor 205 to ground, and/or coupling of the ground conductor 205 to ground without fastener(s)).

Figure 7A:
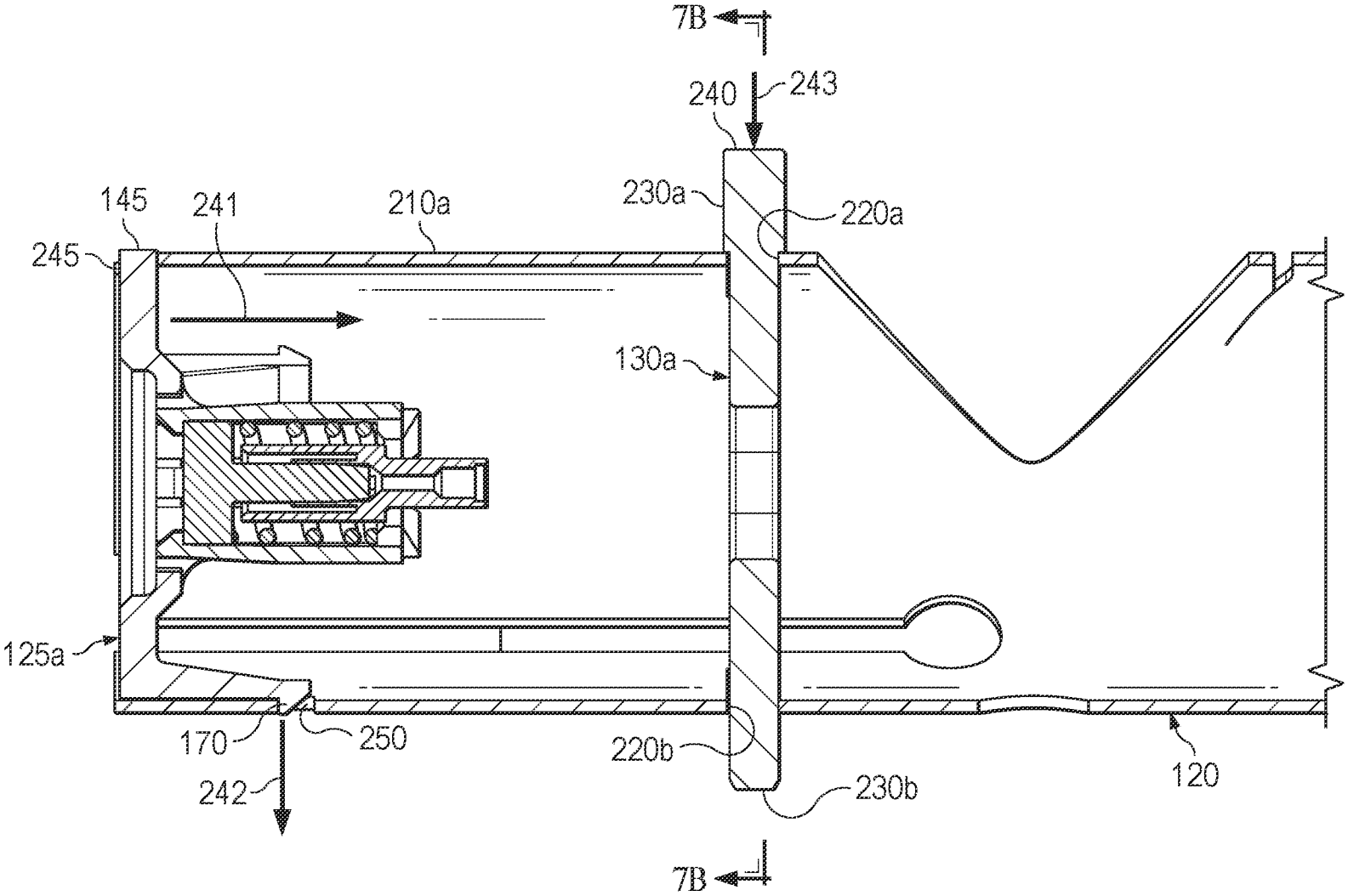
FIG. 7A is a cross-sectional view of the first charge cartridge of FIG. 2 taken along the line 7A-7A of FIG. 1, illustrating, in an assembled state, a first end portion of the first charge tube, the first cap assembly, and the first centralizing insert, according to one or more embodiments.
Figure 7B:
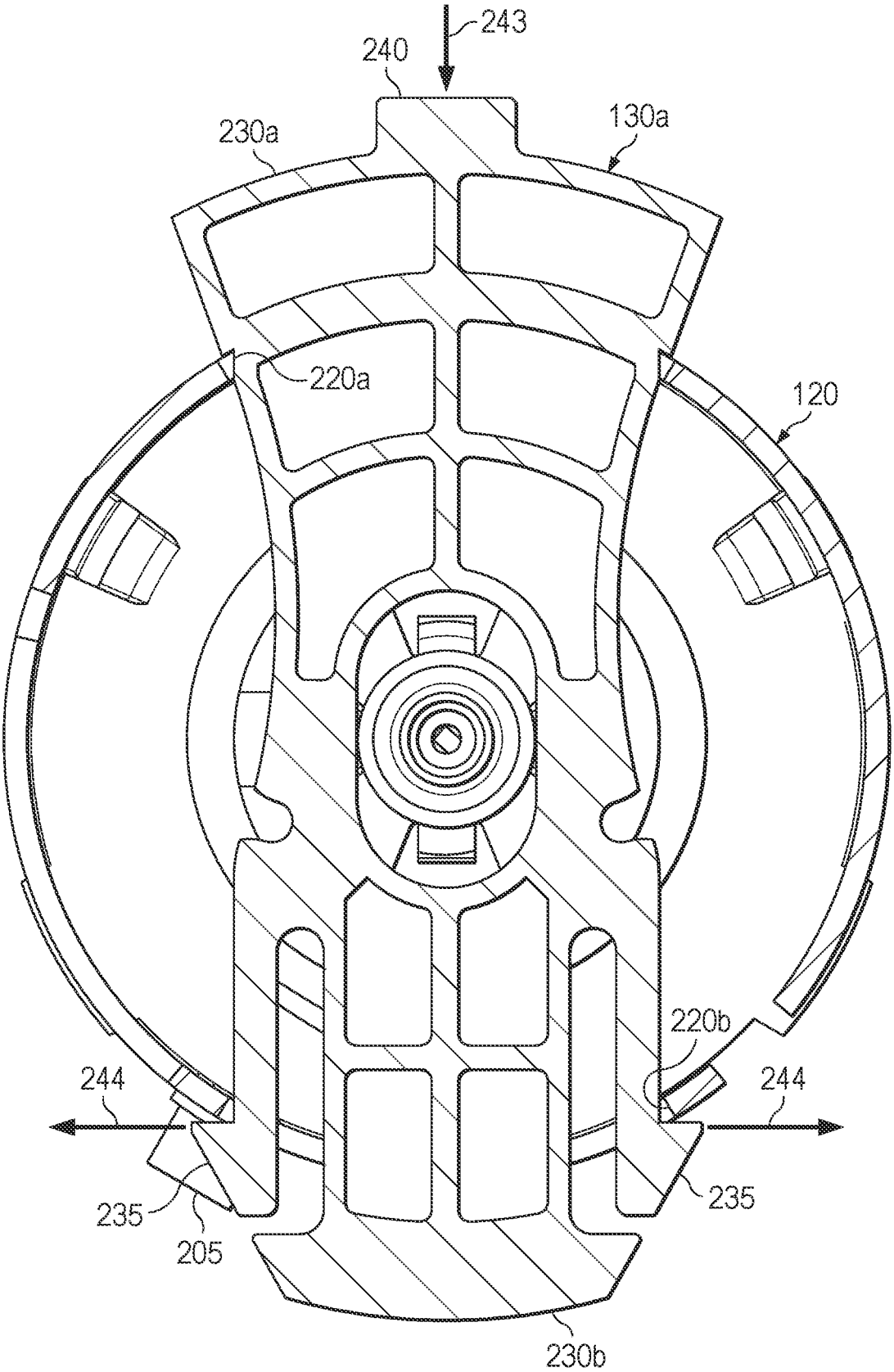
FIG. 7B is a cross-sectional view of the first charge cartridge of FIG. 7A taken along the line 7B-7B of FIG. 7A, according to one or more embodiments.
Figure 9A:
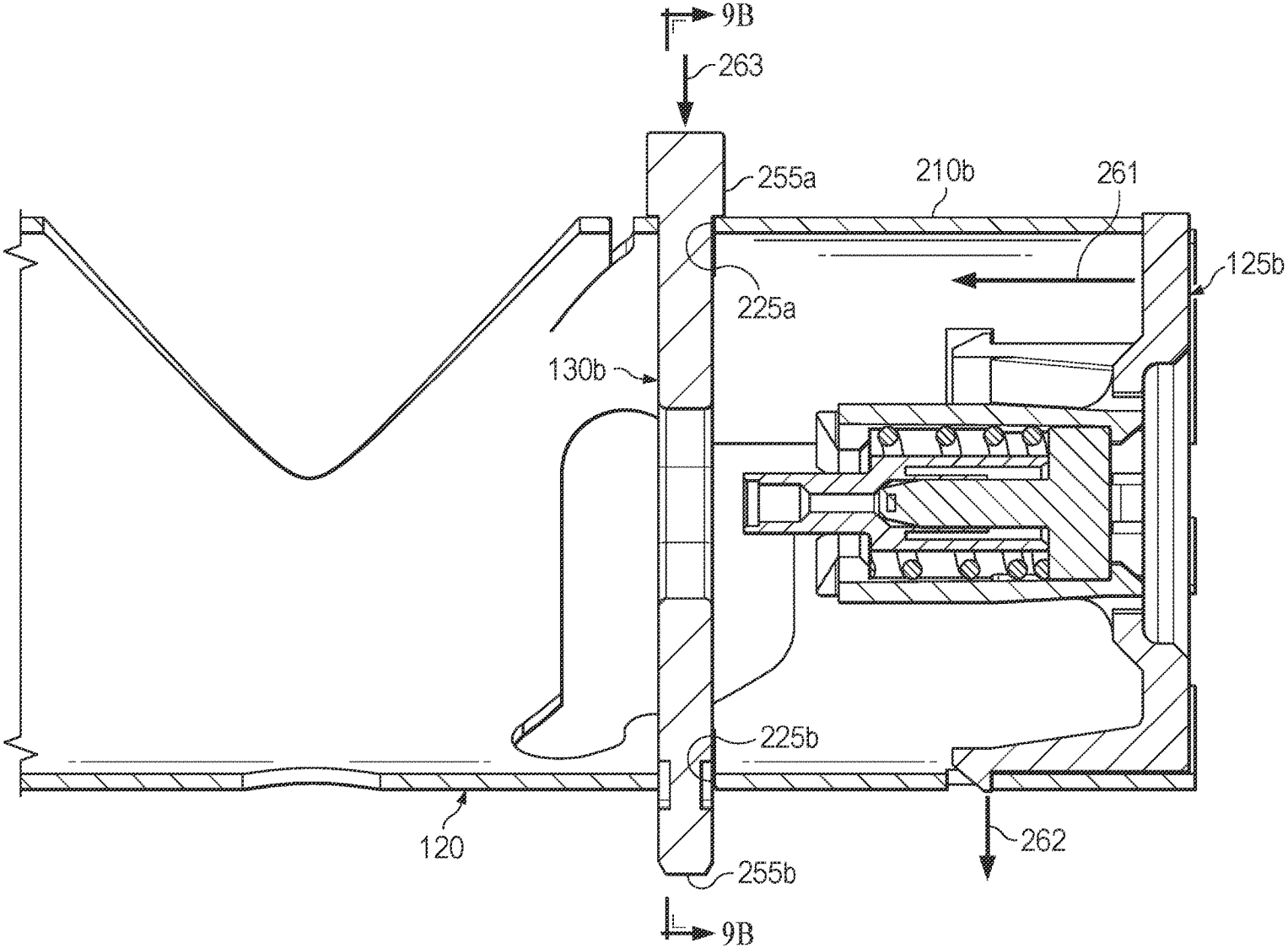
FIG. 9A is a cross-sectional view of the first charge cartridge of FIG. 2 taken along the line 9A-9A of FIG. 1, illustrating, in an assembled state, a second end portion of the first charge tube, the second cap assembly, and the second centralizing insert, according to one or more embodiments.
Figure 9B:
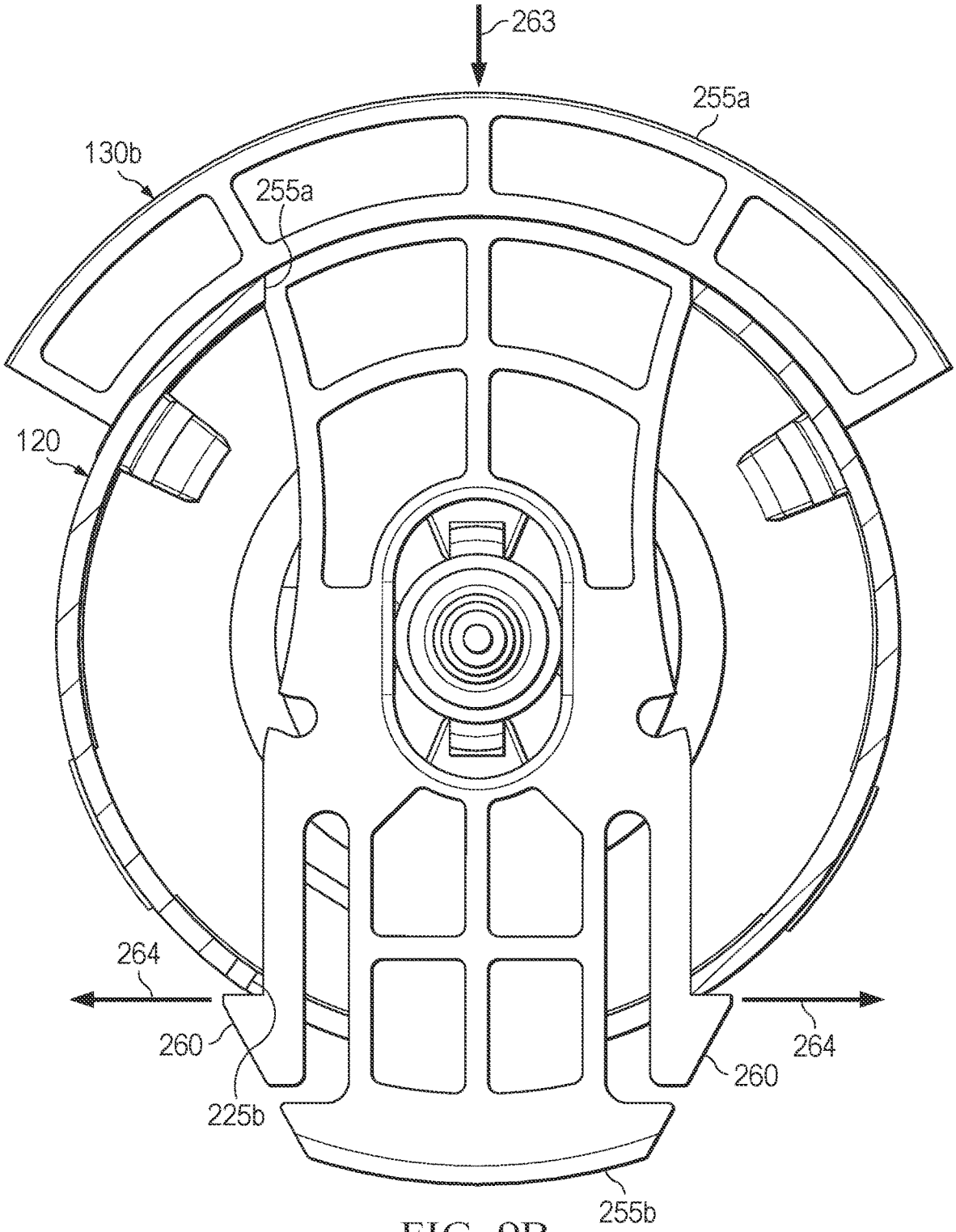
FIG. 9B is a cross-sectional view of the first charge cartridge of FIG. 9A taken along the line 9B-9B of FIG. 9A, according to one or more embodiments.
Figure 12A:
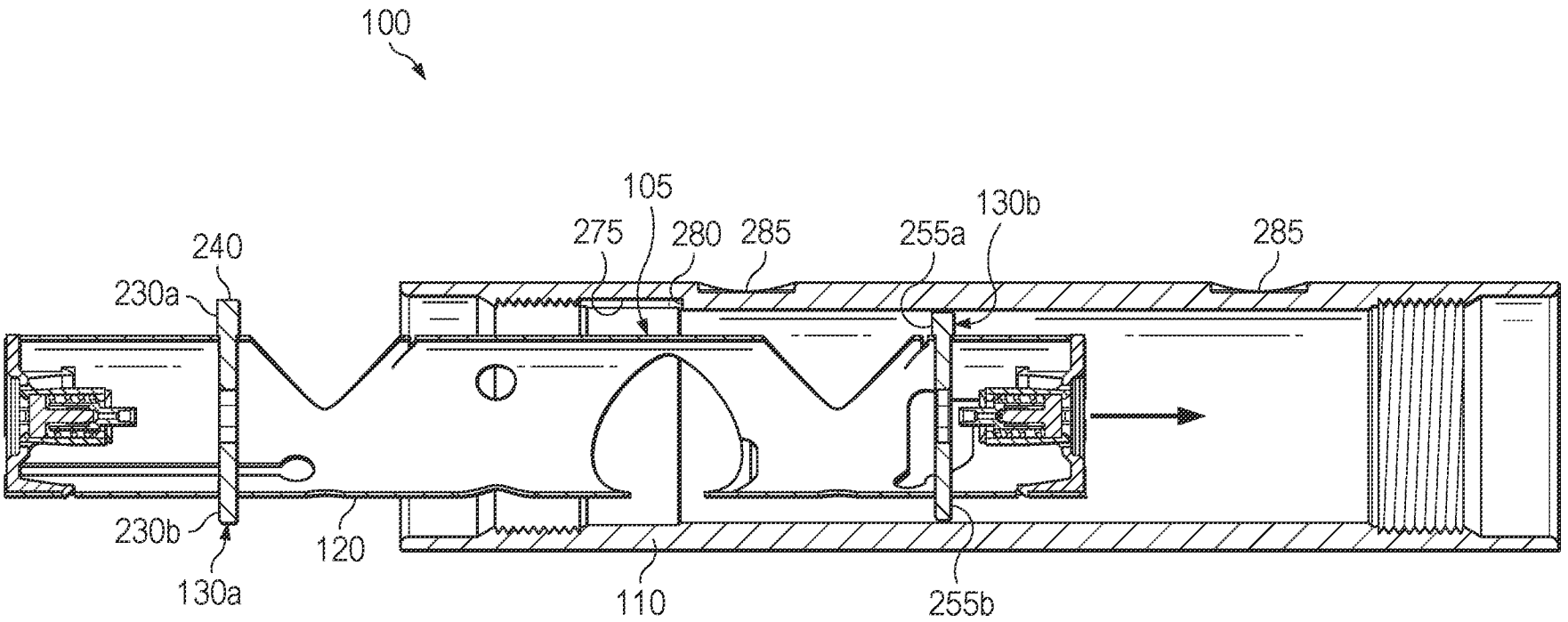
FIG. 12A is a cross-sectional view of the first perforating gun of FIG. 1 in a first operational state or configuration, according to one or more embodiments.
Figure 12B:
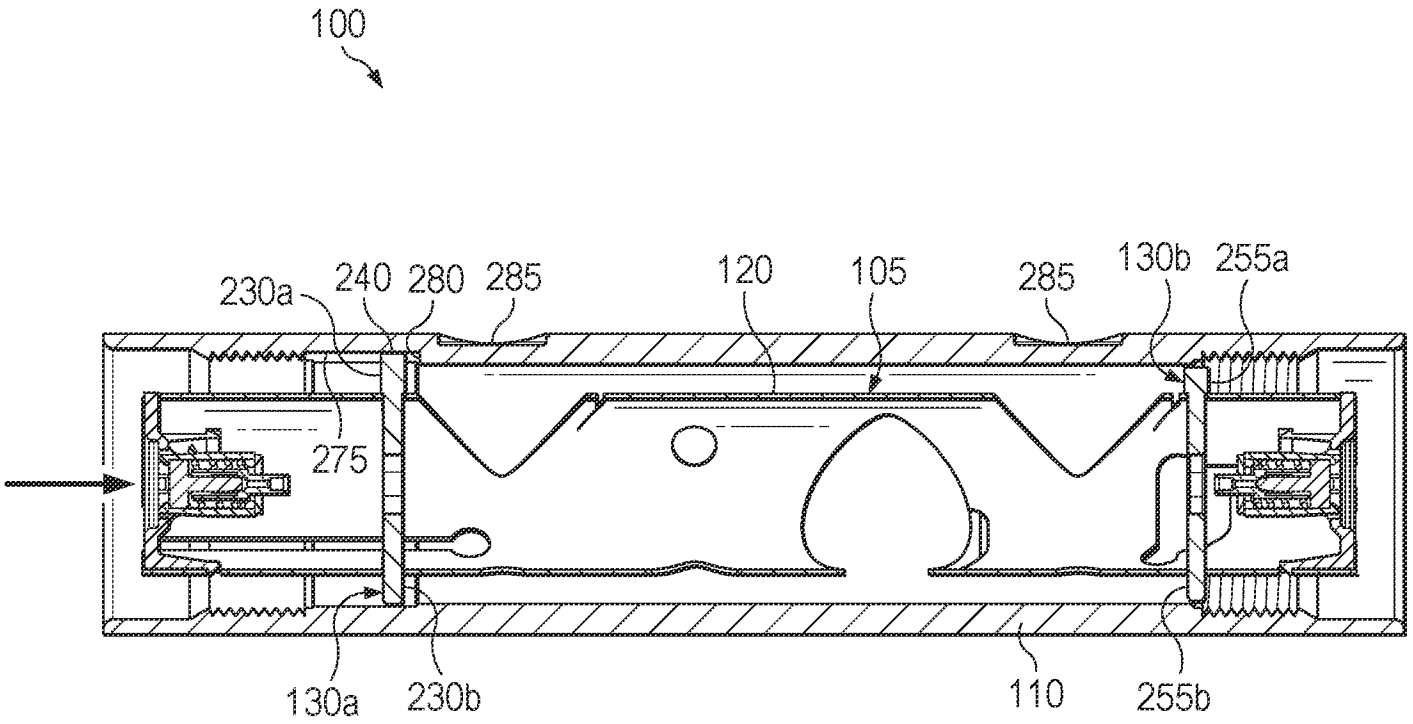
FIG. 12B is a cross-sectional view of the first perforating gun of FIG. 1 in a second operational state or configuration, according to one or more embodiments.
Figures 1, 12C:
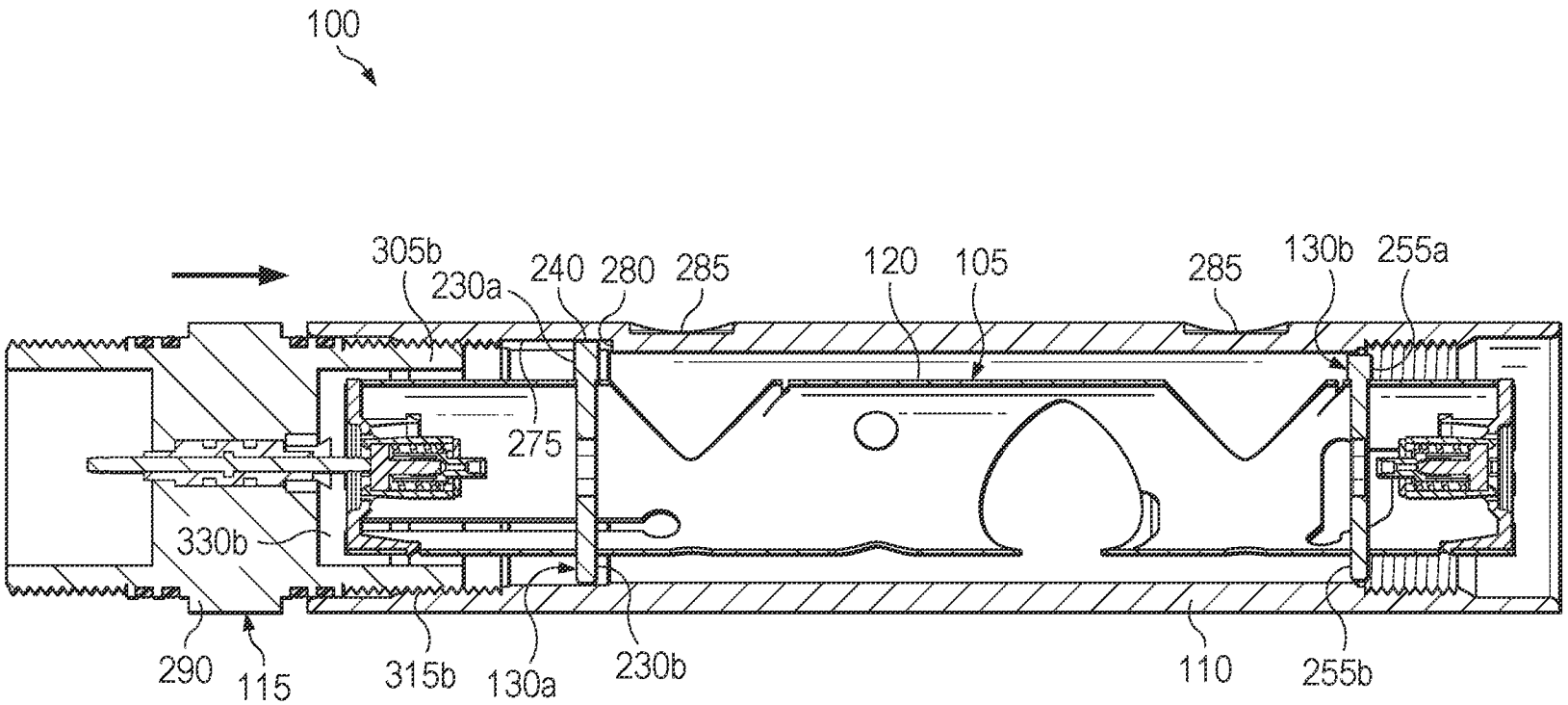
Figures 2, 12C:
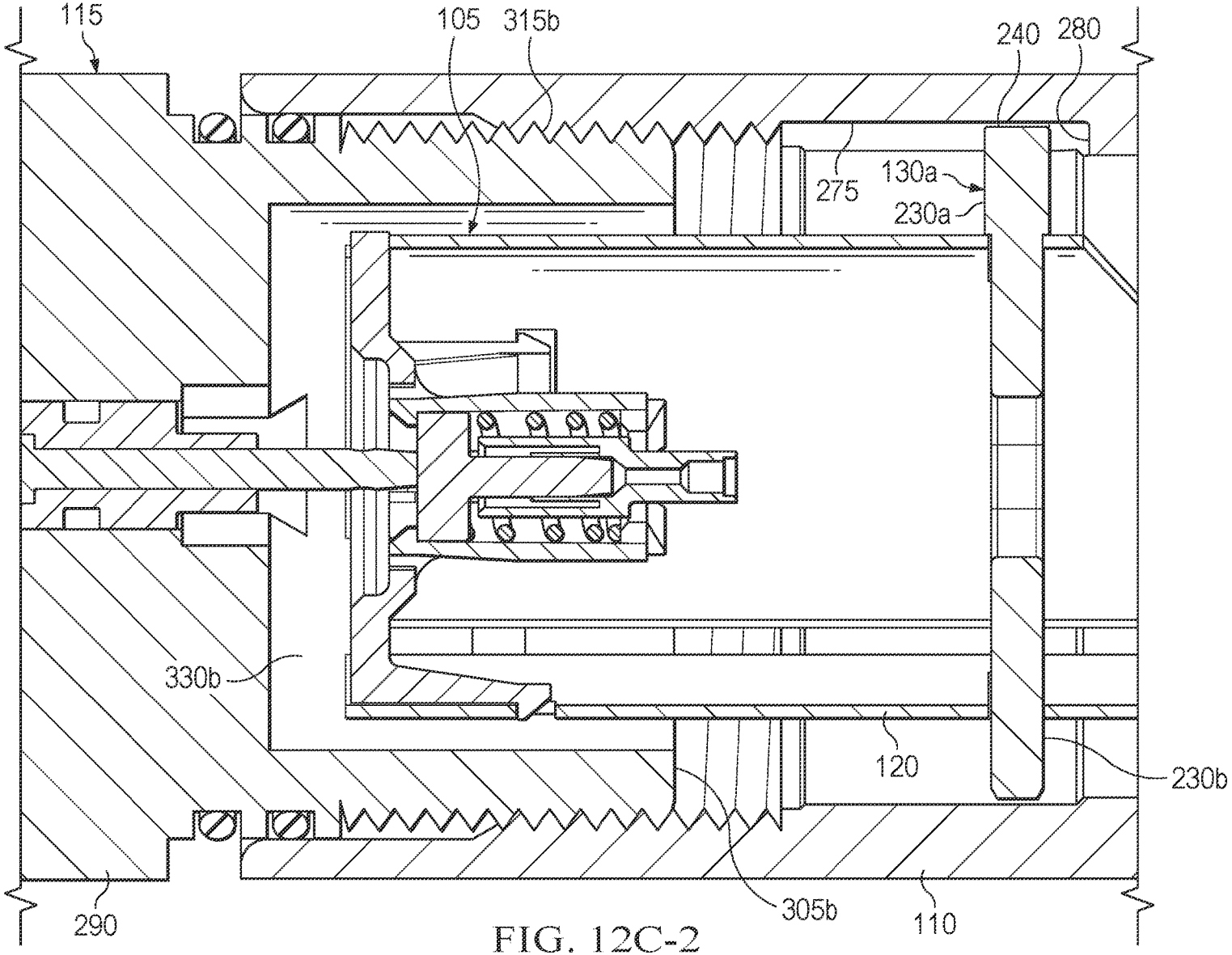
Figures 1, 12D:
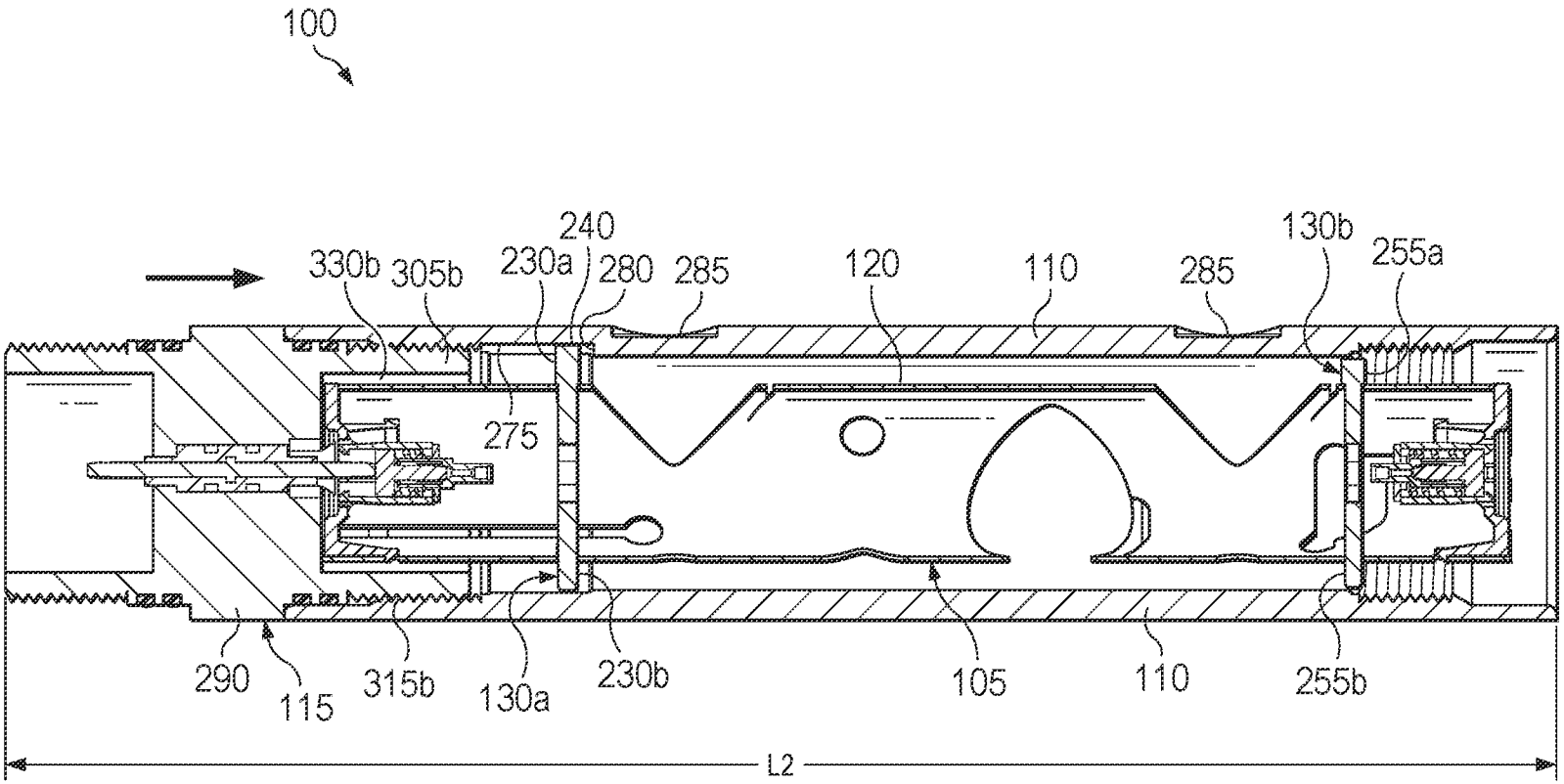
Figures 2, 12D:
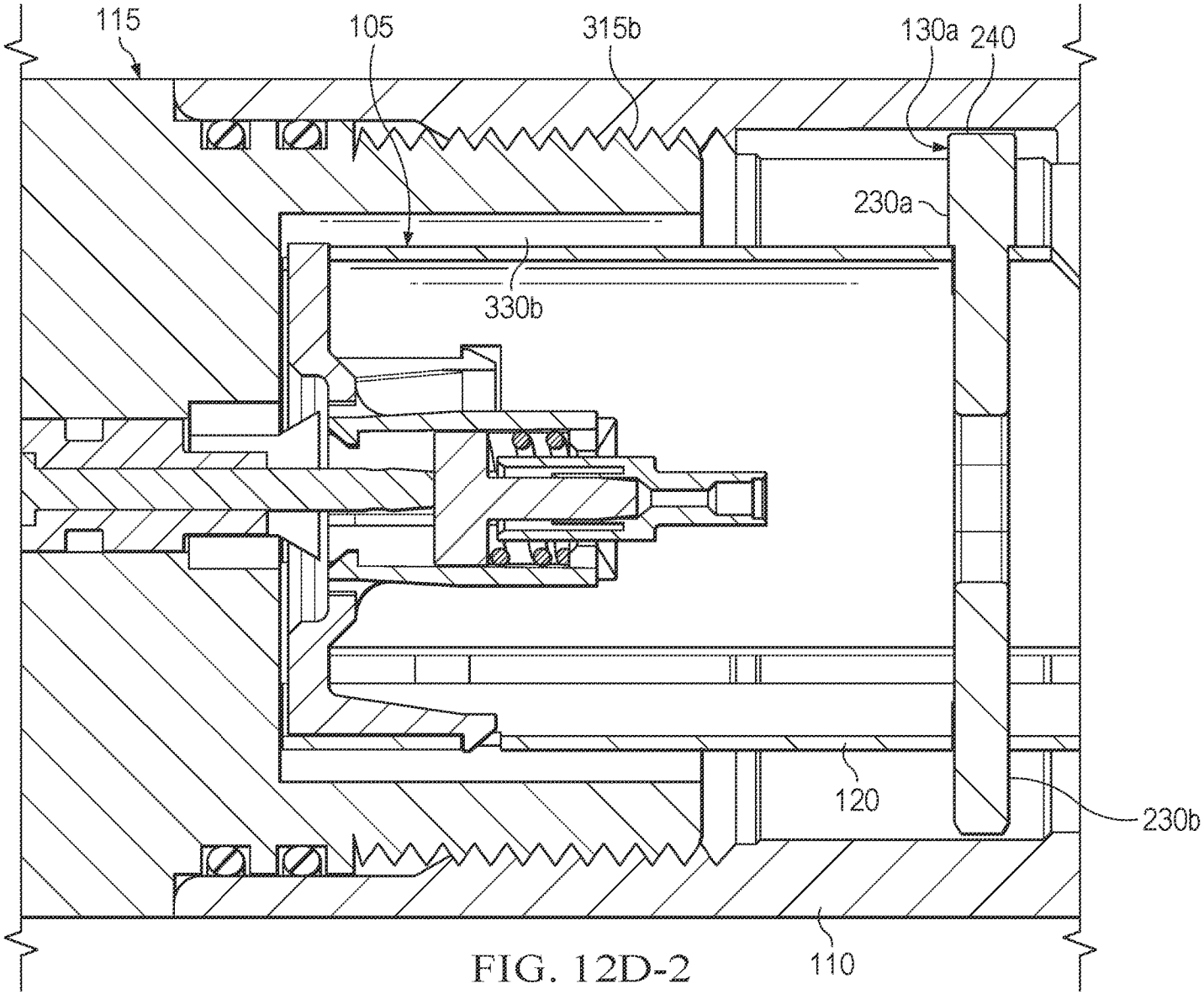
Figure 12E:
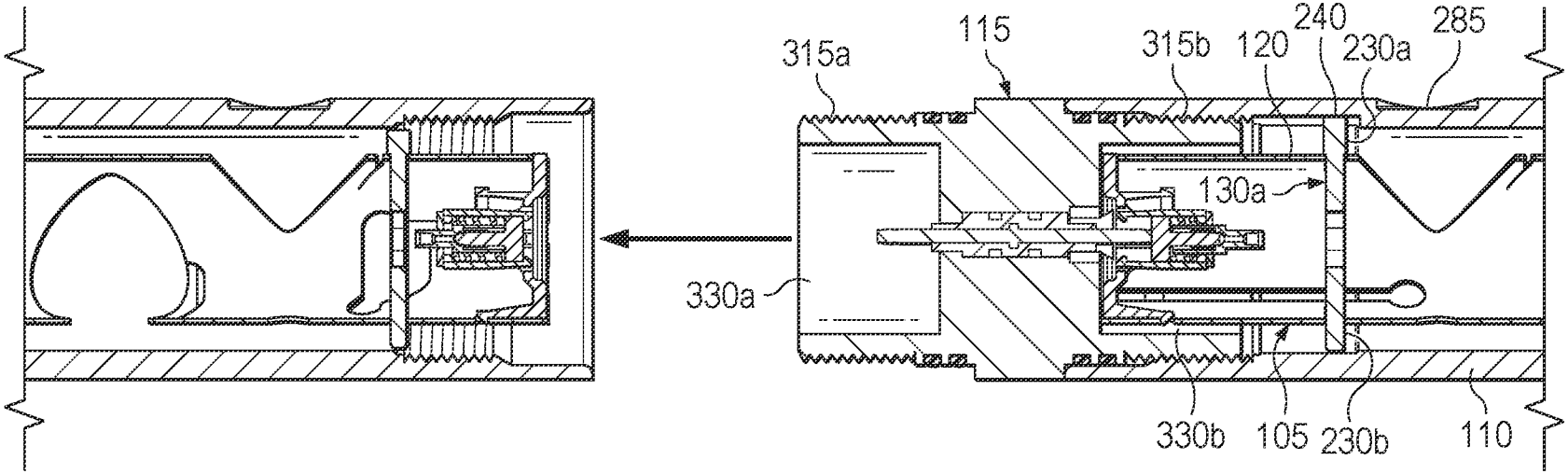
FIG. 12E is a cross-sectional view of the first perforating gun of FIG. 1 in a fifth operational state or configuration, according to one or more embodiments.

Referring to FIGS. 5A through 5E, in one or more embodiments, the charge tube 120 defines opposing end portions 210*a-b*. Although shown as a single integrally formed body, the charge tube 120 may instead be broken into two or more interconnected components. An access port or window 215 is formed radially through the charge tube 120 at or proximate the end portion 210*a* of the charge tube 120, which access port or window 215 permits access to an interior of the charge tube 120 at the end portion 210*a* of the charge tube 120, permitting insertion of a detonator on-site during assembly of the perforating gun 100 and immediately before the perforating gun 100 is deployed into a wellbore. In one or more embodiments, the access port or window 215 extends spirally (e.g., helically) along the charge tube 120; this spiral extension of the access port or window 215 along the charge tube 120 helps to minimize, or at least decrease, a length L1 of the charge tube 120 and, thus, an overall length L2 of the perforating gun 100 (shown in FIG. 12D-1). In one or more embodiments, the length L1 of the charge tube is a maximum length of the charge tube. Additionally, circumferentially-opposing slots 220*a-b* are formed radially through the charge tube 120 at or proximate the end portion 210*a* of the charge tube 120, via which slots 220*a-b* the centralizing insert 130*a* is insertable transversely through the charge tube 120 (as shown in FIGS. 7A and 7B). Similarly, circumferentially-opposing slots 225*a-b* are formed radially through the charge tube 120 at or proximate the end portion 210*b* of the charge tube 120, via which slots 225*a-b* the centralizing insert 130*b* is insertable transversely through the charge tube 120 (as shown in FIGS. 9A and 9B). When so transversely inserted through the charge tube 120, the centralizing inserts 130*a-b* are each spaced inwardly from the corresponding ends of the charge tube 120. The charge tube 120 illustrated in FIGS. 5A through 5E is configured to rotationally align the perforating charges in a 120-degree phased relationship with adjacent one(s) of the perforating charges.

Figure 6A:
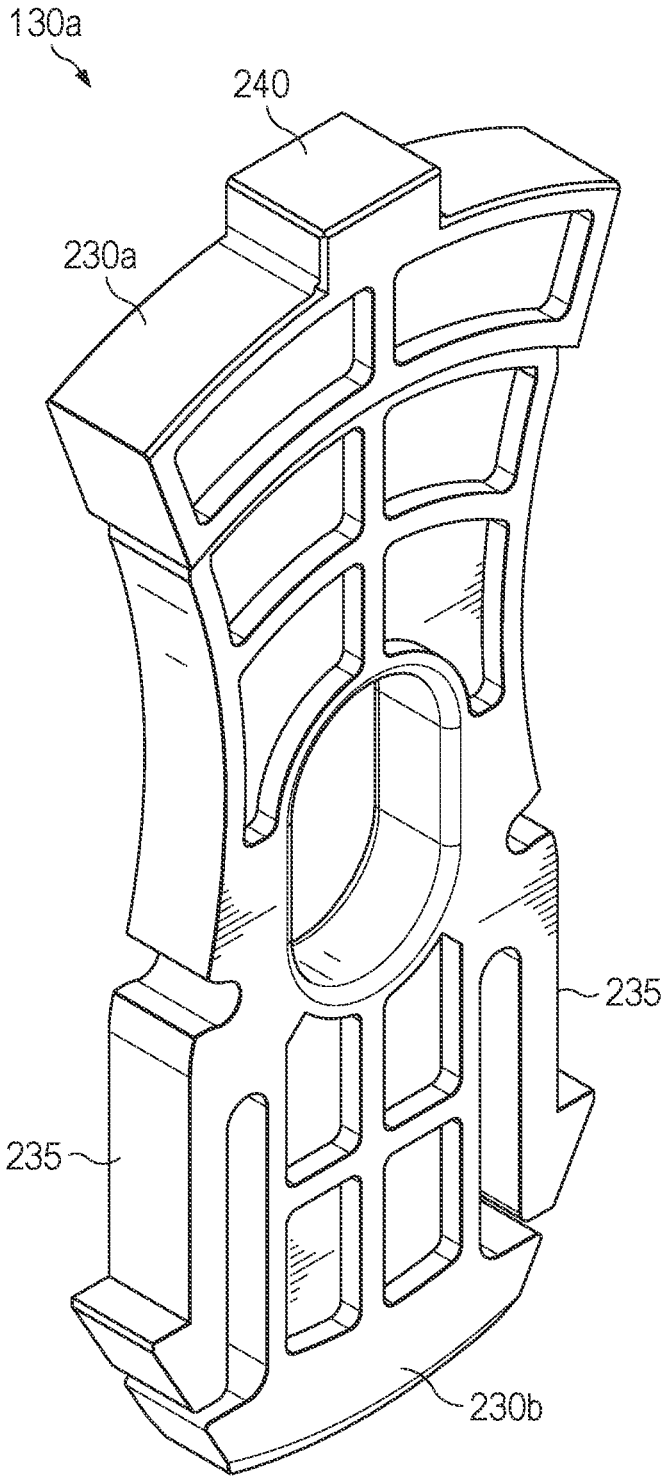
FIG. 6A is a top-front-right-perspective view of the first centralizing insert of FIG. 2, according to one or more embodiments.
Figure 6B:
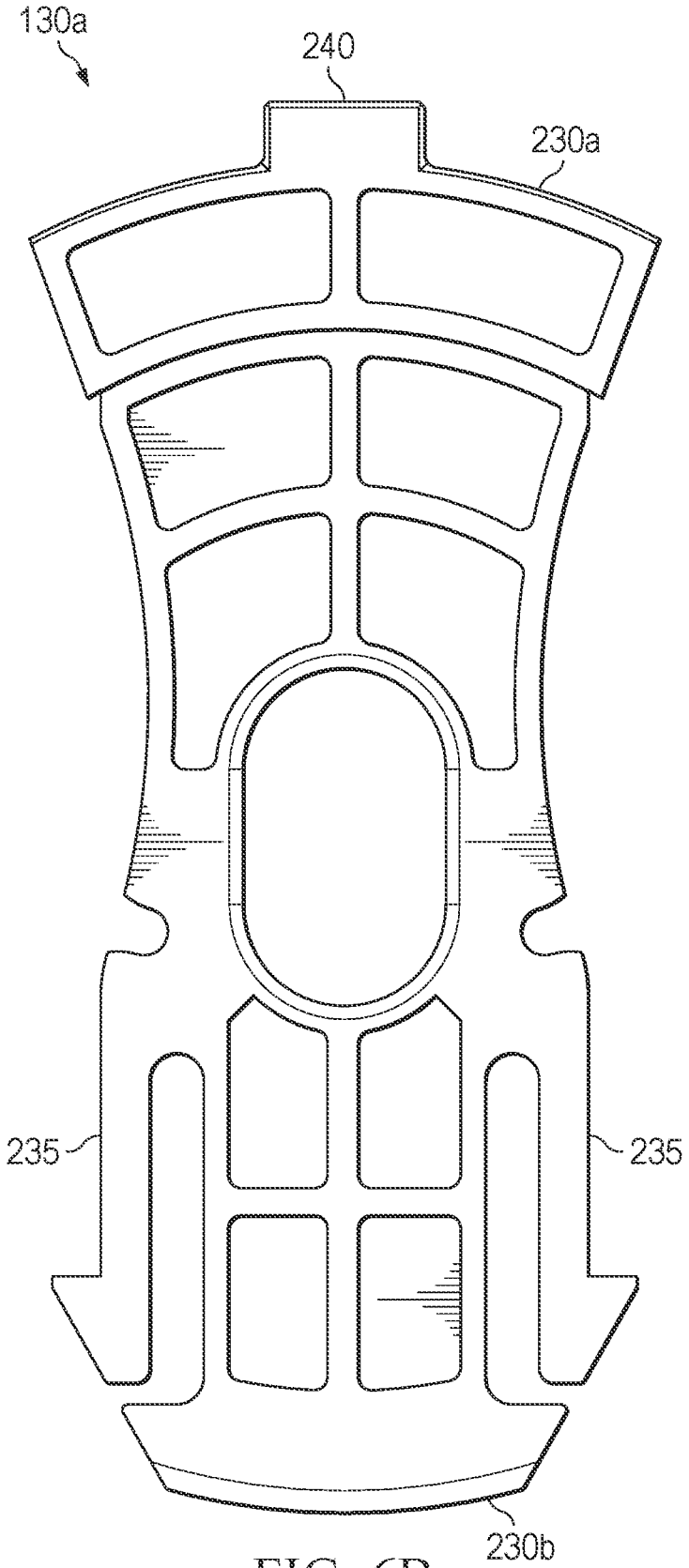
FIG. 6B is a front elevational view of the first centralizing insert of FIG. 2, according to one or more embodiments.

Referring to FIGS. 6A and 6B, in one or more embodiments, the centralizing insert 130*a*, which defines opposing end portions 230*a-b*, includes one or more latching features 235 at or proximate the end portion 230*b* thereof. Additionally, an orienting key 240 extends radially from the centralizing insert 130*a* at the end portion 230*a*.

Referring to FIGS. 7A and 7B, in one or more embodiments, the cap assembly 125*a* and the centralizing insert 130*a* are assembled (e.g., toollessly and/or without fastener (s)) into the end portion 210*a* of the charge tube 120. More particularly, the cap assembly 125*a* is inserted axially into the end portion 210*a* of the charge tube 120, as indicated by arrow 241, causing: the one or more tabs 145 to be received within corresponding axial recesses 245 formed into the charge tube 120 at the end portion 210*a*; and the latching feature(s) 170 of the end cap 135 to latch onto the charge tube 120 at corresponding slots 250 formed through the charge tube 120, as indicated by arrow 242. Additionally, the centralizing insert 130*a* is inserted transversely through the charge tube 120, via the slots 220*a-b*, as indicated by arrow 243, causing: the latching feature(s) 235 of the centralizing insert 130*a* to latch onto the charge tube 120 at the slot 220*b*, as indicated by arrows 244; and the opposing end portions 230*a-b* of the centralizing insert 130*a* to each extend radially beyond the charge tube 120.

Figure 8A:
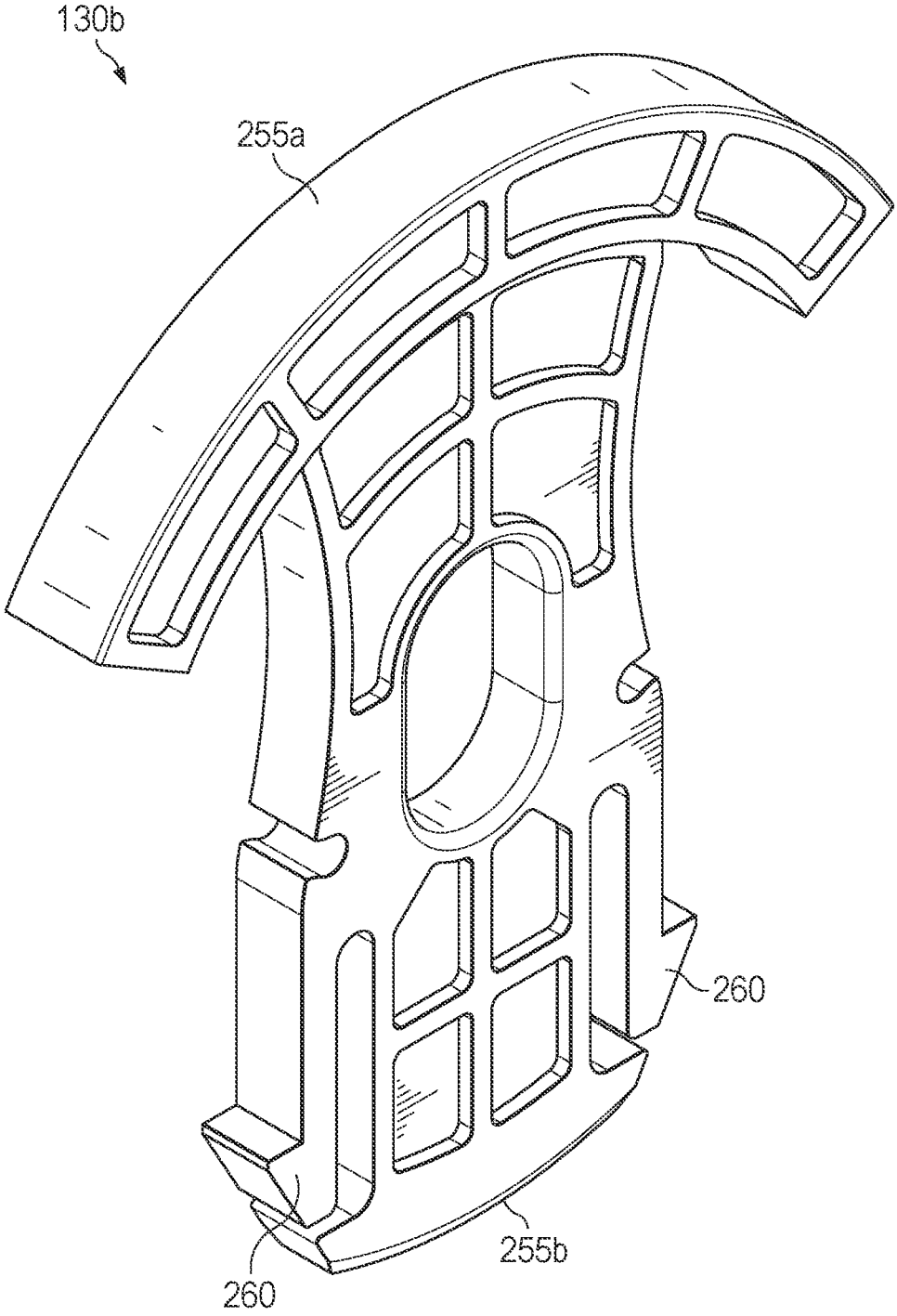
FIG. 8A is a top-front-right-perspective view of the second centralizing insert of FIG. 2, according to one or more embodiments.
Figure 8B:
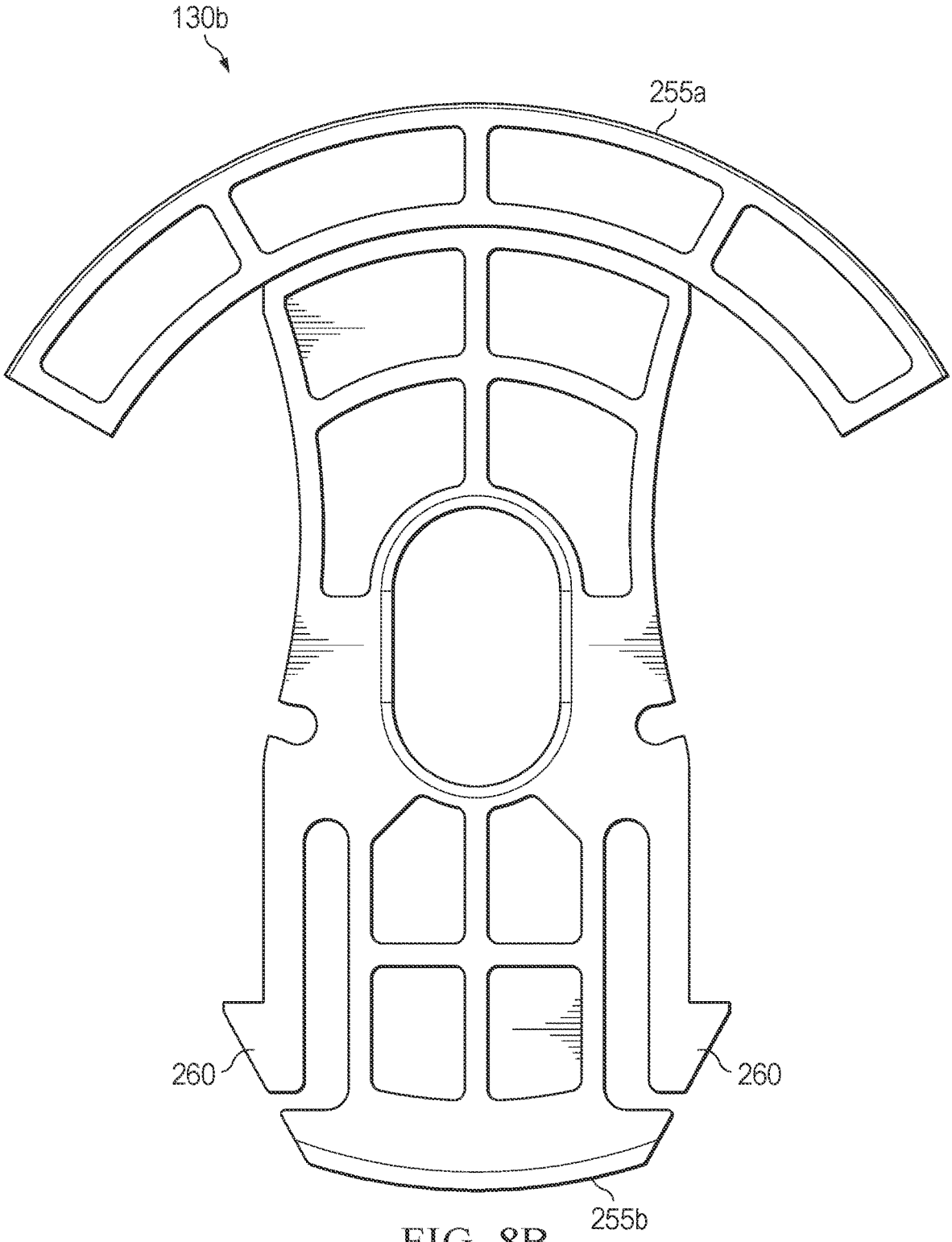
FIG. 8B is a front elevational view of the second centralizing insert of FIG. 2, according to one or more embodiments.

Referring to FIGS. 8A and 8B, in one or more embodiments, the centralizing insert 130*b*, which defines opposing end portions 255*a-b*, includes one or more latching features 260 at or proximate the end portion 255*b* thereof.

Referring to FIGS. 9A and 9B, in one or more embodiments, the cap assembly 125*b* and the centralizing insert 130*b* are assembled (e.g., toollessly and/or without fastener (s)) into the end portion 210*b* of the charge tube 120. More particularly, the cap assembly 125*b* is inserted axially into the end portion 210*b* of the charge tube 120, as indicated by arrow 261, in a manner substantially identical to the manner in which the cap assembly 125*a* is inserted axially into the end portion 210*a* of the charge tube 120, as indicated by arrow 262, and, therefore, will not be described in further detail. Additionally, the centralizing insert 130*b* is inserted transversely through the charge tube 120, via the slots 225*a-b*, as indicated by arrow 263, causing: the latching feature(s) 260 of the centralizing insert 130*b* to latch onto the charge tube 120 at the slot 225*b*, as indicated by arrows 264; and the opposing end portions 255*a-b* of the centralizing insert 130*b* to each extend radially beyond the charge tube 120.

Figure 10:
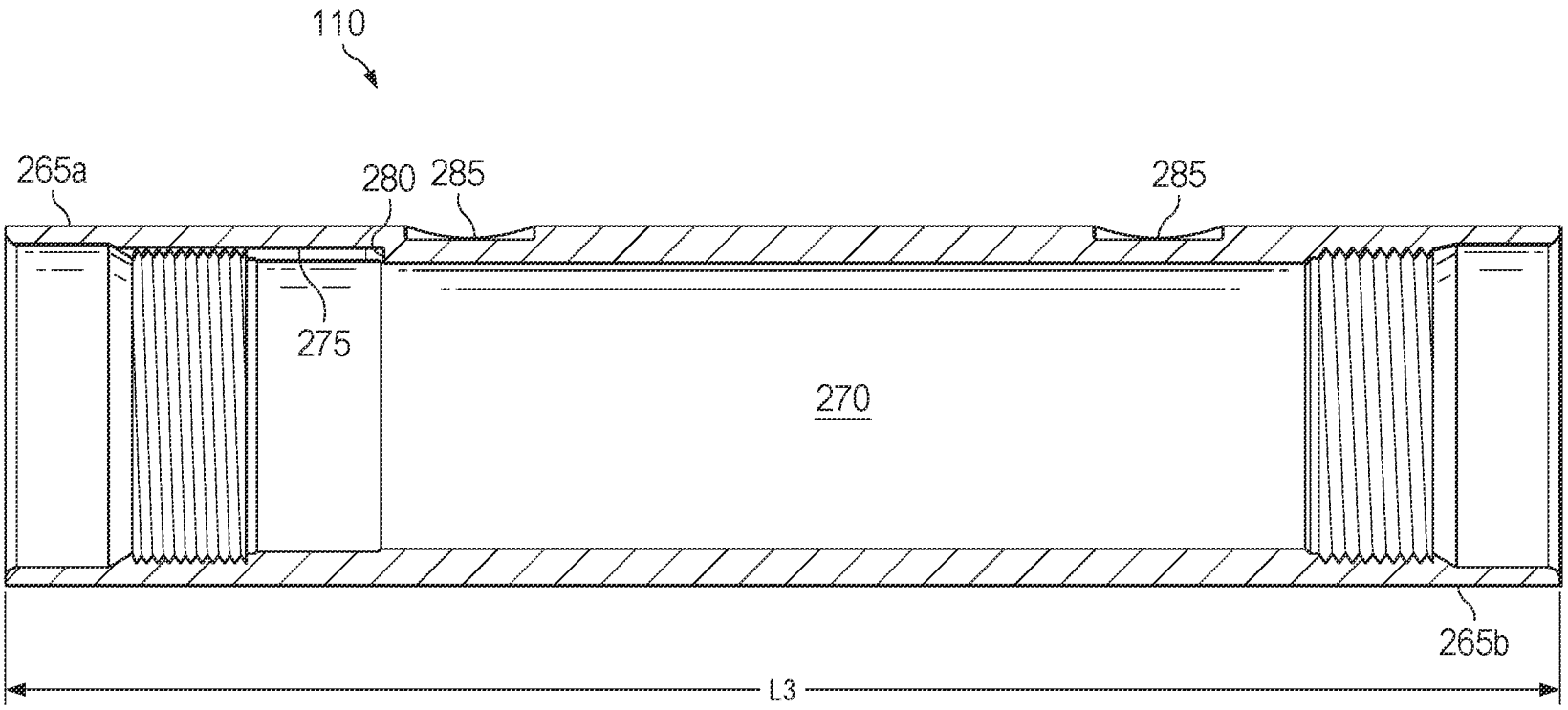
FIG. 10 is a cross-sectional view of the first carrier tube of FIG. 1 taken along the line 10-10 of FIG. 1, according to one or more embodiments.

Referring to FIG. 10, in one or more embodiments, the carrier tube 110 defines opposing end portions 265*a-b* and a central passageway 270 extending axially therethrough. Although shown as a single integrally formed body, the carrier tube 110 may instead be broken into two or more interconnected components. An orienting keyway 275 is formed internally into the carrier tube 110 at the end portion 265*a* thereof. In one or more embodiments, as in FIG. 10, the orienting keyway 275 extends only partway along the carrier tube 110, thereby defining an internal shoulder 280 in the carrier tube 110 at its termination point. A plurality of scallops 285 are formed externally into the carrier tube 110; the plurality of scallops 285 are rotationally aligned in a 120-degree phased relationship with adjacent one(s) of the scallops 285. Once loaded into the charge tube 120, the perforating charges (each of which is rotationally aligned in a 120-degree phased relationship with the adjacent one(s) of the perforating charges) are adapted to be axially and rotationally aligned with respective ones of the plurality of scallops 285 formed into the carrier tube 110, as will be described in further detail below.

Figure 11:
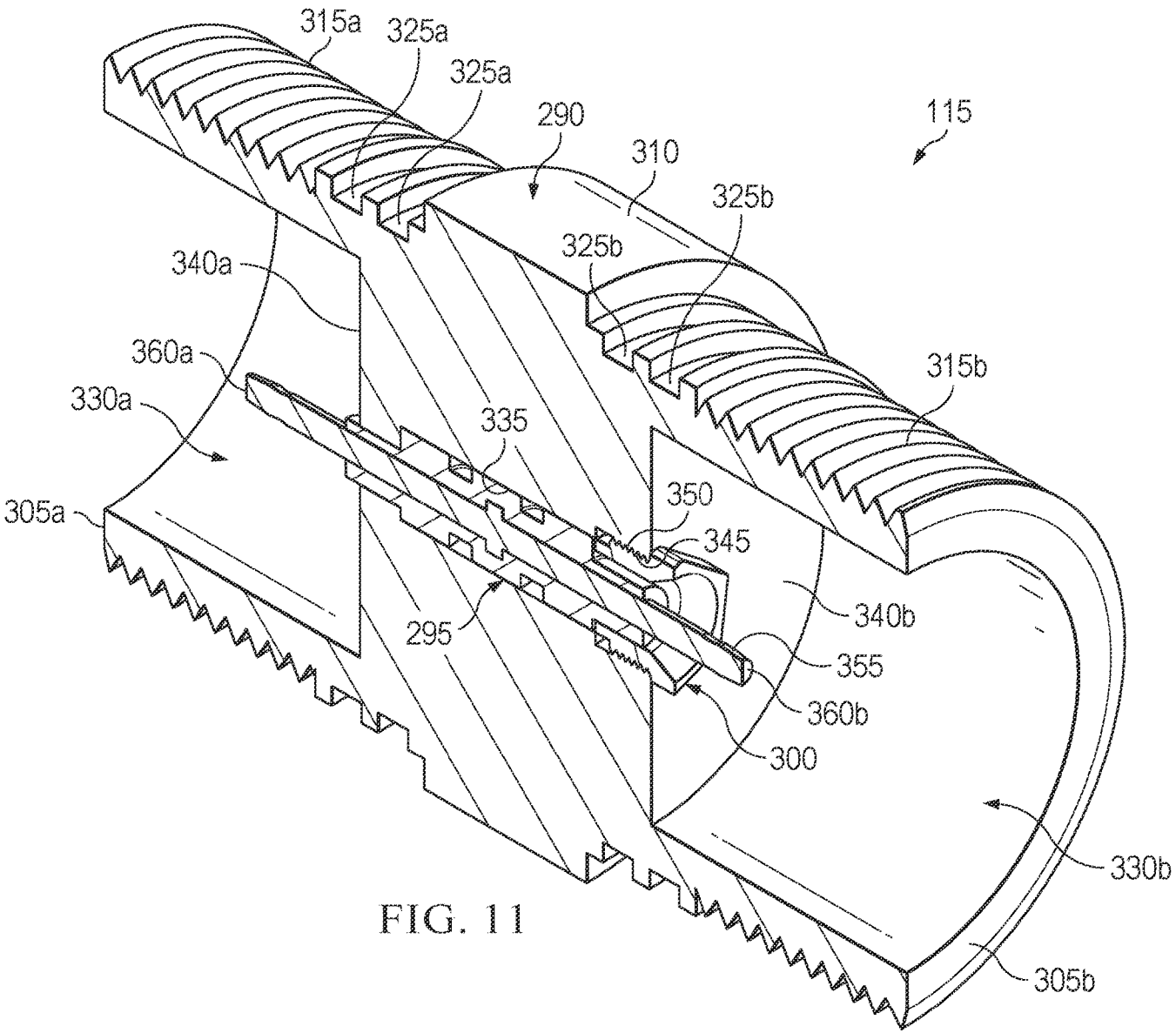
FIG. 11 is a cross-sectional view of the first conductor sub of FIG. 1 taken along the line 11-11 of FIG. 1, according to one or more embodiments.

Referring to FIG. 11, in one or more embodiments, the conductor sub 115 includes a sub body 290, a conductor assembly 295 (or "feedthrough"), and a retainer 300. The sub body 290 defines opposing end portions 305*a-b*. The sub body 290 includes an enlarged-diameter portion 310 located between the end portions 305*a-b* of the sub body 290. An external threaded connection 315*a* is formed in the sub body 290 proximate the end portion 305*a* of the sub body 290. One or more seals are adapted to extend within one or more external annular grooves 325*a* formed into the sub body 290 between the enlarged-diameter portion 310 and the external threaded connection 315*a*. Similarly, an external threaded connection 315*b* is formed in the sub body 290 proximate the end portion 305*b* of the sub body 290. One or more seals are adapted to extend within one or more external annular grooves 325*b* formed into the sub body 290 between the enlarged-diameter portion 310 and the external threaded connection 315*b*.

Opposing axial recesses 330*a-b* are formed into the sub body 290 at the end portions 305*a-b*, respectively, of the sub body 290. An internal bore 335 is formed through the sub body 290 between the axial recesses 330*a-b*. The axial recesses 330*a-b* are substantially larger in diameter than the internal bore 335; as a result, an internal face 340*a* is formed in the sub body 290 where the internal bore 335 intersects the axial recess 330*a*, and an internal face 340*b* is formed in the sub body 290 where the internal bore 335 intersects the axial recess 330*b*. An internal threaded connection 345 is formed in the sub body 290 at the internal bore 335, proximate the axial recess 330*a*. The retainer 300 includes an external threaded connection 350 threadably engaged with the internal threaded connection 345 of the sub body 290 to retain the conductor assembly 295 within the sub body 290. The conductor assembly 295 includes a conductor body 355 defining opposing end portions 360*a-b* disposed within the axial recesses 330*a-b*, respectively, so as not to extend beyond the opposing end portions 305*a-b* of the sub body 290 when the retainer 300 retains the conductor assembly 295 within the sub body 290.

In one or more embodiments, the conductor sub 115 is or includes one or more components substantially identical (or at least similar) to corresponding component(s) of the conductor sub shown and described in U.S. Application No. 63/154,626 (the "'626 Application"), filed Feb. 26, 2021, the entire disclosure of which is incorporated herein by reference. For example, the conductor assembly 295 of the conductor sub 115 may be substantially identical (or at least similar) to the corresponding component(s) of the conductor sub shown and described in the '626 Application. In addition, or instead, in one or more embodiments, the conductor sub 115 is or includes one or more components identical (or at least similar) to corresponding component(s) of the orienting sub shown and described in U.S. application Ser. No. 17/193,412 (the "'412 Application"), filed Mar. 5, 2021, the entire disclosure of which is hereby incorporated herein by reference. For example, the conductor assembly 295 of the conductor sub 115 may be substantially identical (or at least similar) to the corresponding component(s) of the conductor sub shown and described in the '412 Application.

Referring to FIGS. 12A through 12E, in one or more embodiments, the perforating gun 100 is adapted to be assembled (e.g., toollessly and/or without fastener(s)) on-site at a wellsite before being run downhole into a wellbore and detonated to perforate the wellbore proximate a subterranean formation. When the perforating gun 100 is fully assembled: the centralizing inserts 130*a-b* each extend transversely through the charge tube 120, as described above; the charge tube 120 is diametrically centered within the carrier tube 110 with the centralizing inserts 130*a-b* (in several embodiments, the charge tube 120 is radially centralized, or nearly radially centralized, within the carrier tube 110, with one or both end portions 230*a-b* of the centralizing insert 130*a* contacting the inside surface of the carrier tube 110, and with one or both end portions 255*a-b* of the centralizing insert 130*b* contacting the inside surface of the carrier tube 110); and the charge cartridge 105 is axially trapped between the conductor sub 115 and the internal shoulder 280 formed into the carrier tube 110 by the orienting keyway 275 (as a result, the charge cartridge 105 extends within the axial recess 330*b* formed into the sub body 290 of the conductor sub 115 at the end portion 305*b*; such extension of the charge cartridge 105 within the axial recess 330*b* formed into the sub body 290 of the conductor sub 115 at the end portion 305*b* helps to minimize, or at least decrease, the overall length L2 of the perforating gun 100). In addition, or instead, the charge cartridge 105 may be trapped between the conductor sub 115 and an adjacent sub (or other component) connected at the opposing end of the perforating gun 100; in such instances, the charge cartridge 105 may also extend within an axial recess formed into the adjacent sub (such extension of the charge cartridge 105 within the axial recess formed into the adjacent sub helps to minimize, or at least decrease, the overall length L2 of the perforating gun 100). In any case, when the perforating gun 100 is fully assembled, the charge tube 120 is not connected to the conductor sub 115, and the perforating charges loaded in the charge tube 120 are axially and rotationally aligned with respective ones of the plurality of scallops 285 formed externally into the carrier tube 110.

In one or more embodiments, the charge tube 120 defines the length L1, the carrier tube 110 defines a length L3, and a ratio of the length L1 to the length L3 is: equal to or greater than 0.2; equal to or greater than 0.3; equal to or greater than 0.4; equal to or greater than 0.5; equal to or greater than 0.6; equal to or greater than 0.7; equal to or greater than 0.75; equal to or greater than 0.775; equal to or greater than 0.8; equal to or greater than 0.825; equal to or greater than 0.85; equal to or greater than 0.875; equal to or greater than 0.9; or equal to or greater than 0.925. In one or more embodiments, the length L3 of the carrier tube 110 is a maximum length of the carrier tube 110. In some embodiments, the increased ratio of the length L1 to the length L3 helps to minimize, or at least decrease, the overall length L2 of the perforating gun 100. In several embodiments, the embodiments illustrated in the figures (including in, e.g., FIG. 12B) provide a ratio of the length L1 of the charge tube 120 to the length L3 of the carrier tube 110 of equal to or greater than 0.7, 0.75, 0.9, or 0.925, thereby minimizing or at least decreasing the overall length L2 of the perforating gun 100.

Figure 13:
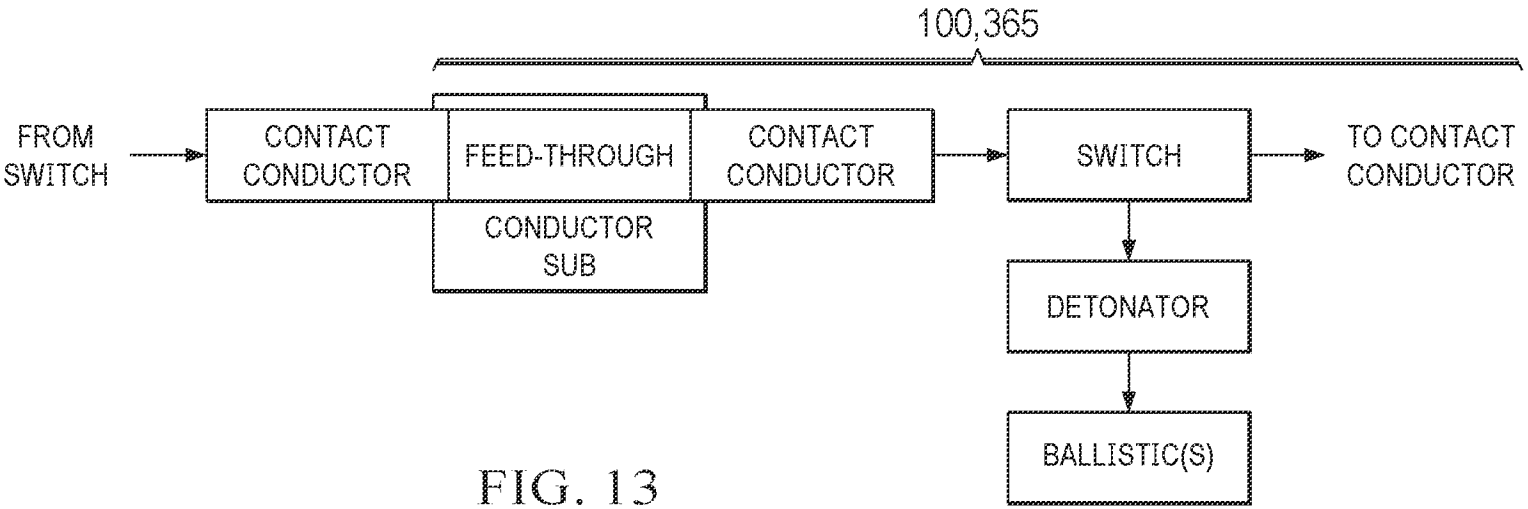
FIG. 13 is a diagrammatic illustration the first perforating gun of FIG. 1 assembled together with another perforating gun, according to one or more embodiments.

Referring to FIG. 13, in one or more embodiments the perforating gun 100 is assembled in series with one or more other perforating guns to form a gun string along which electricity is communicable to detonate the ballistic(s) of each perforating gun.

Figure 14:
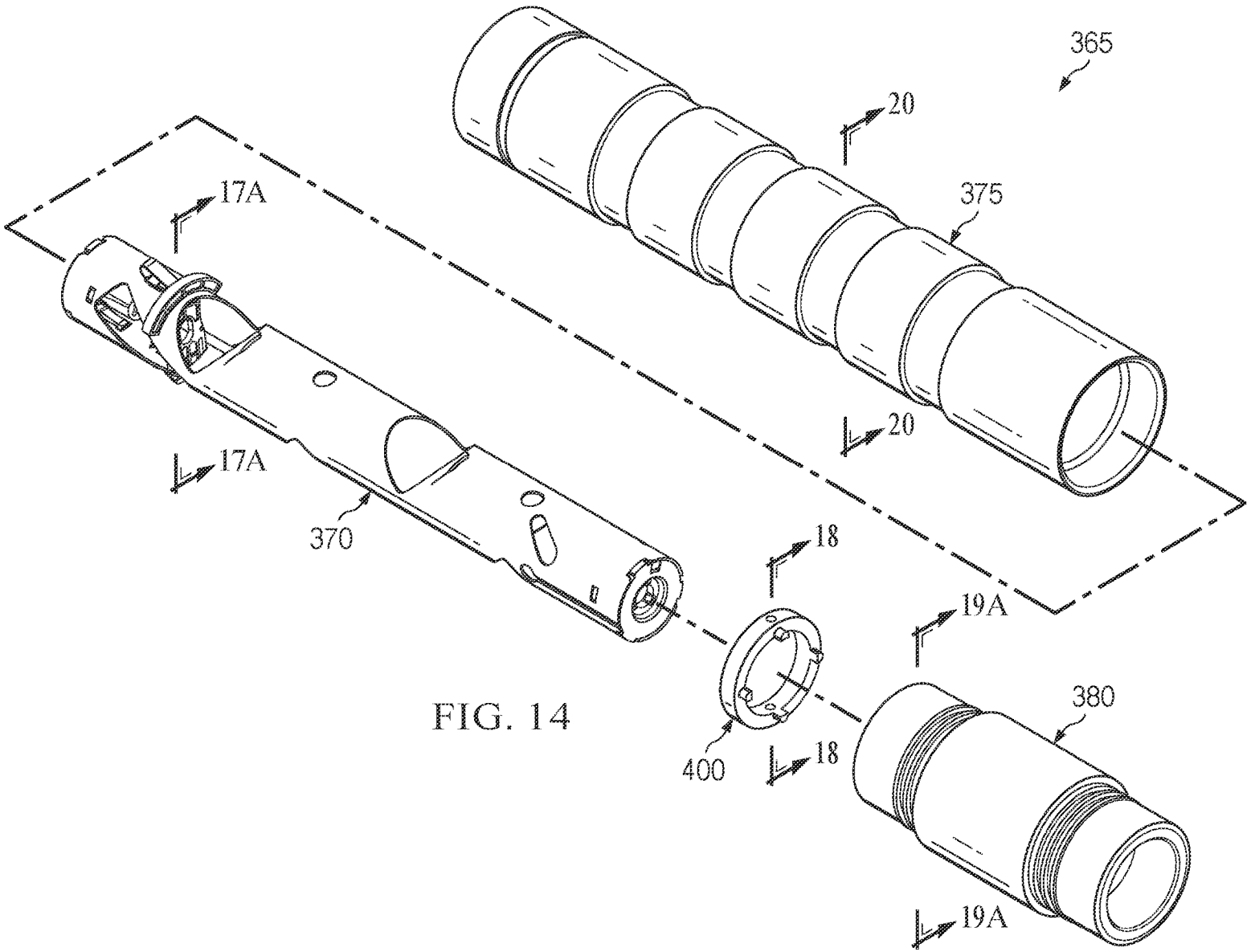
FIG. 14 is an exploded top-front-right-perspective view of a second perforating gun including a second charge cartridge, a second carrier tube, and a second conductor sub.

Referring to FIG. 14, in one or more embodiments, a perforating gun is generally referred to by the reference numeral 365. The perforating gun 365 includes a charge cartridge 370, a carrier tube 375, and a conductor sub 380. The charge cartridge 370 is adapted to house ballistic(s), which ballistic(s) include a singular or plurality of perforating charges and detonator cord, detonable to perforate a wellbore proximate a subterranean formation. The carrier tube 375 receives the assembled charge cartridge 370, including the ballistic(s), a detonator, and (optionally) a switch (e.g., an addressable switch). The conductor sub 380 is adapted to: axially trap the charge cartridge 370 within the carrier tube 375; and conduct electricity to and/or from the charge cartridge 370 to facilitate detonation of the ballistic (s).

Figure 15:
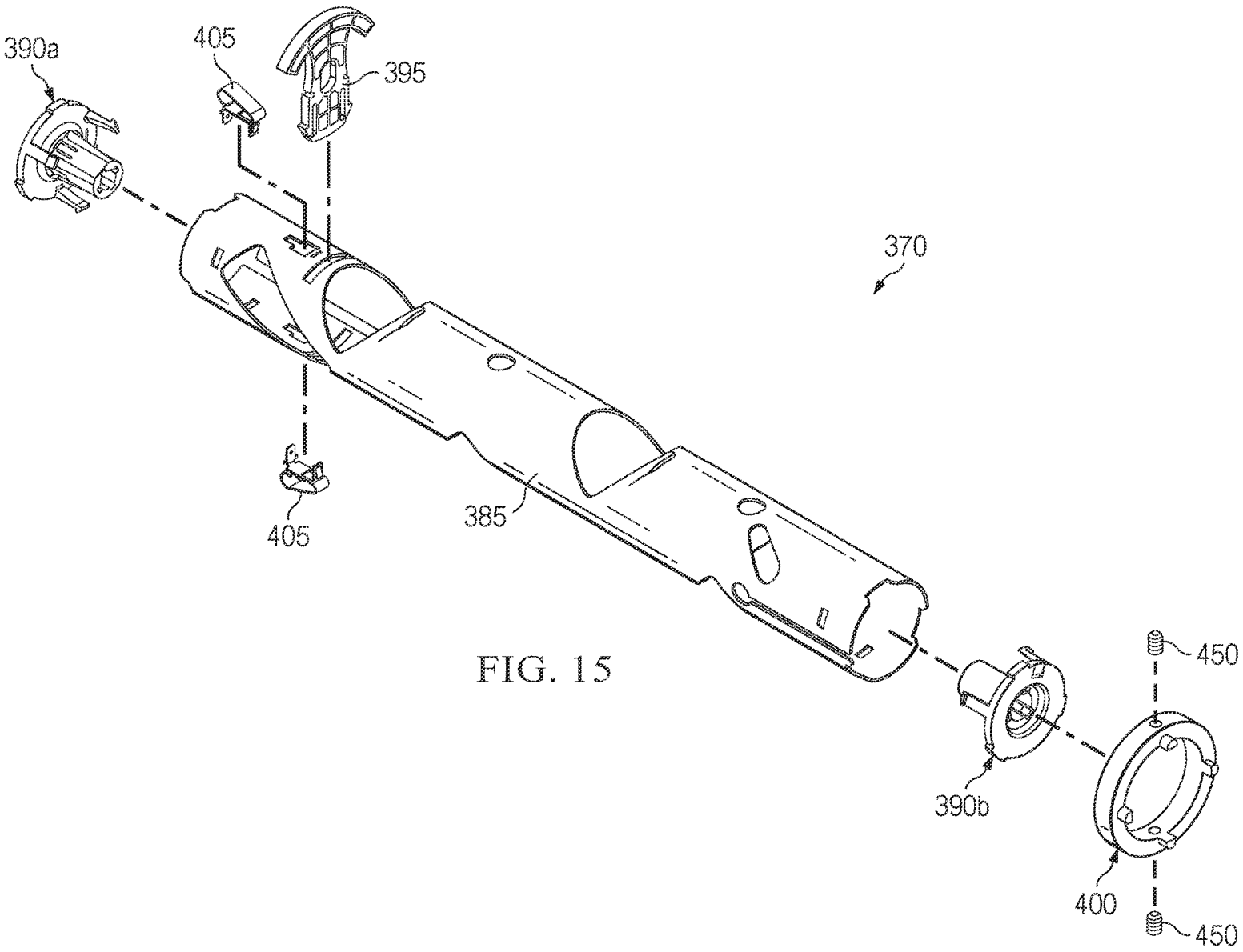
FIG. 15 is an exploded top-front-right-perspective view of the second charge cartridge of FIG. 1, which second charge cartridge includes a second charge tube, third and fourth cap assemblies, a third centralizing insert, and an orienting centralizer, according to one or more embodiments.
Figure 16A:
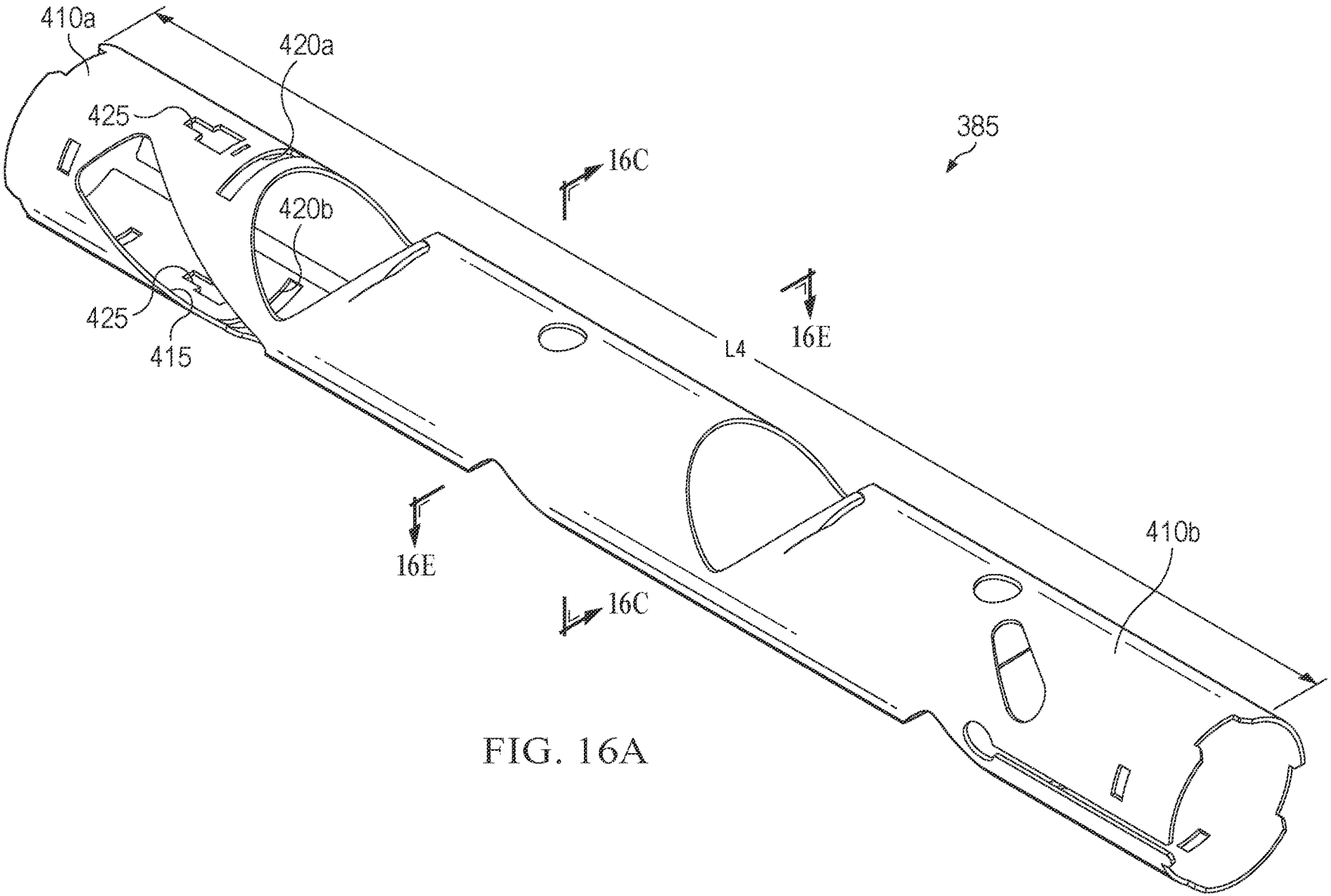
FIG. 16A is a top-front-right-perspective view of the second charge tube of FIG. 15, according to one or more embodiments.
Figure 16B:
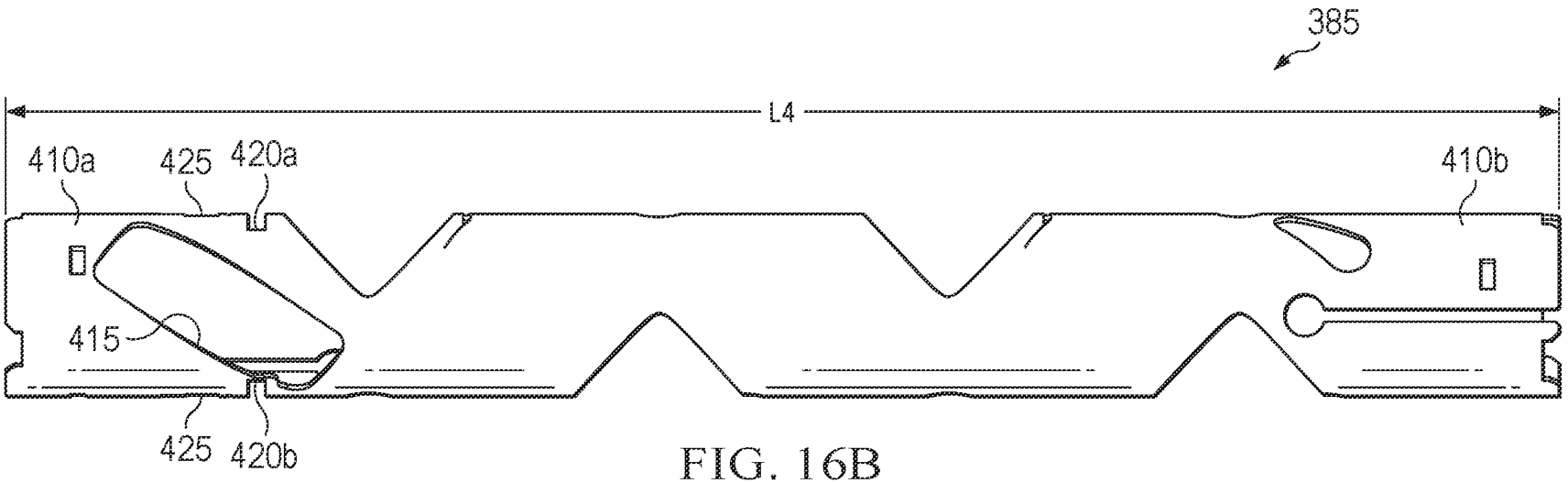
FIG. 16B is a right side elevational view of the second charge tube of FIG. 15, according to one or more embodiments.
Figure 16C:
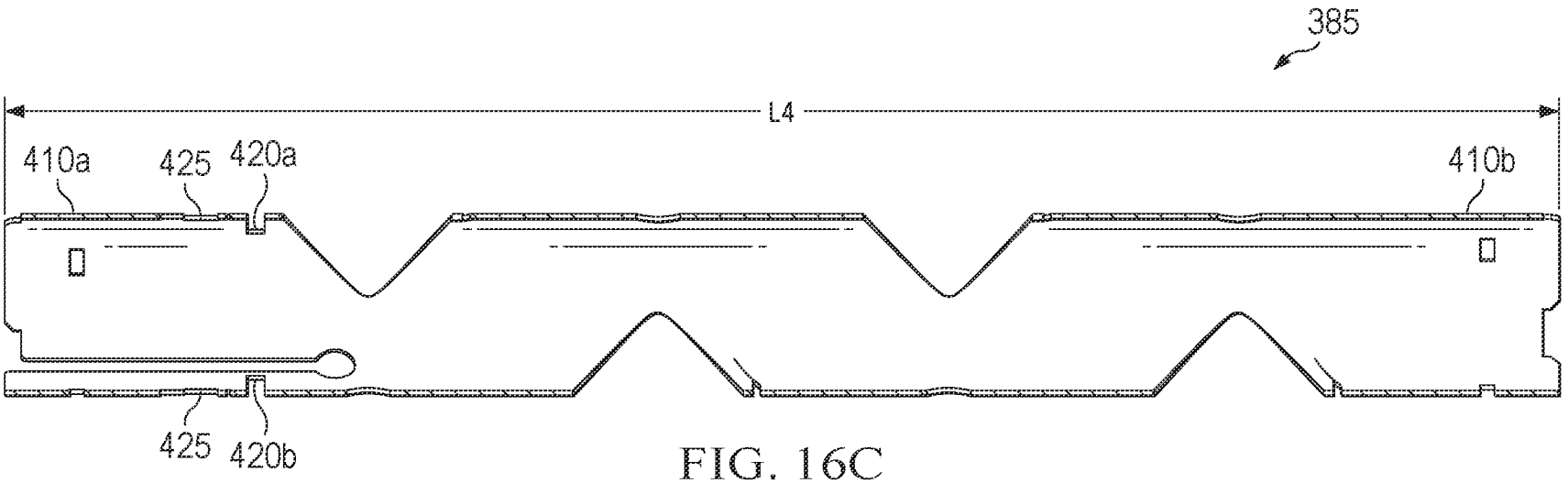
FIG. 16C is a cross-sectional view of the second charge tube of FIG. 15 taken along the line 16C-16C of FIG. 16A, according to one or more embodiments.
Figure 16D:
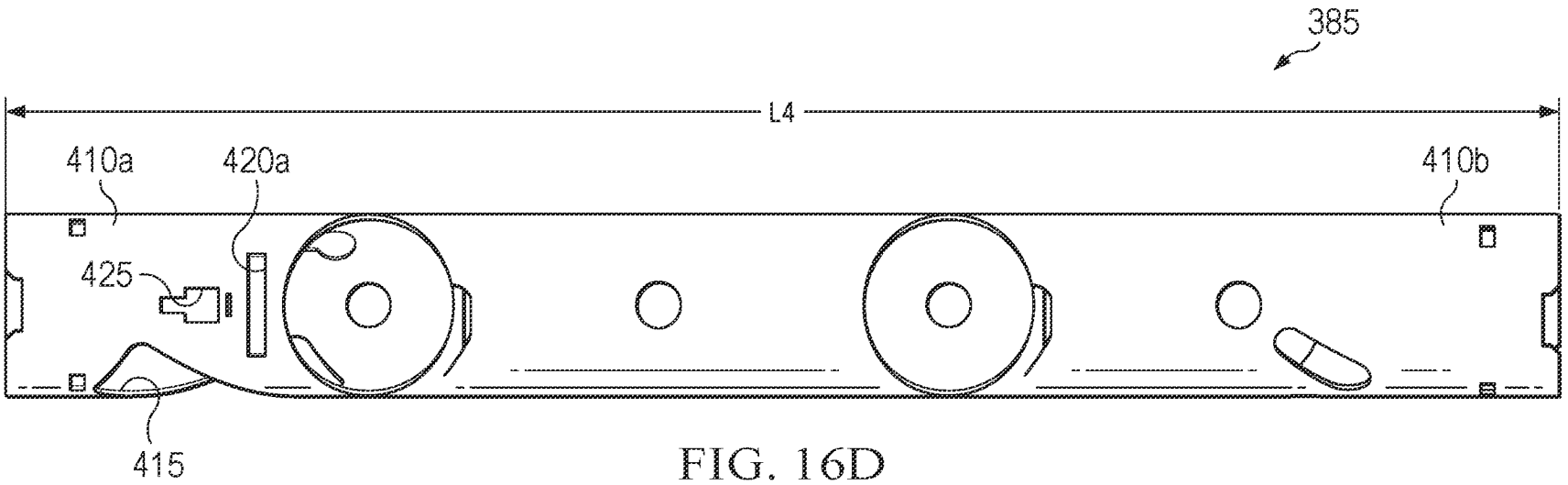
FIG. 16D is a top plan view of the second charge tube of FIG. 15, according to one or more embodiments.
Figure 16E:
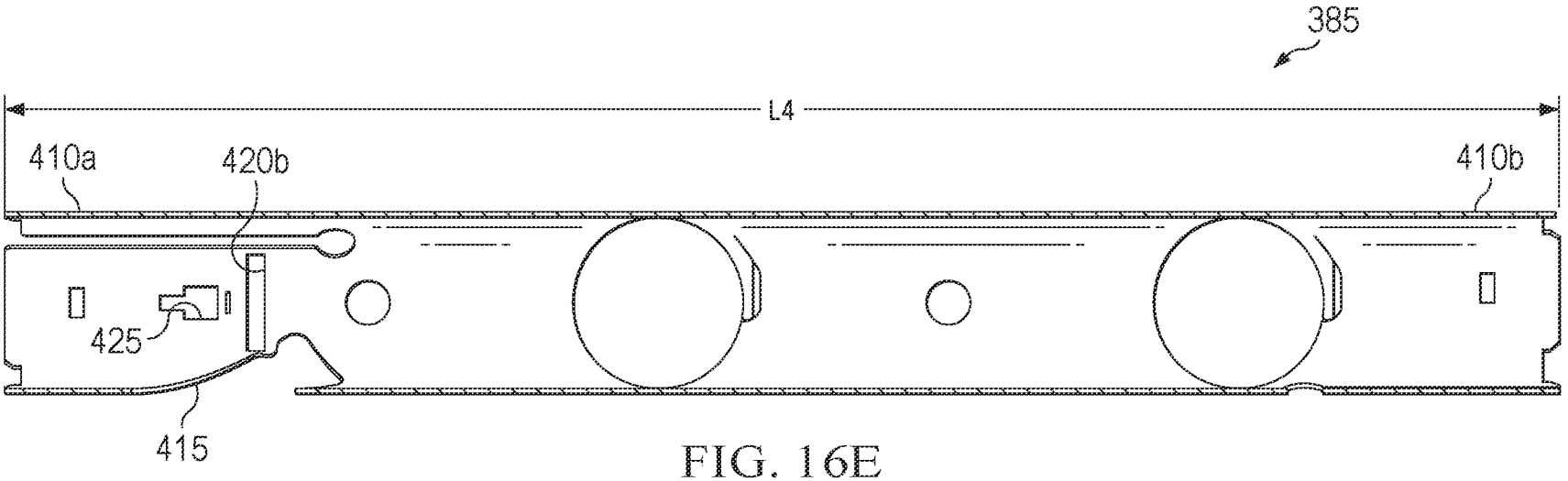
FIG. 16E is a cross-sectional view of the second charge tube of FIG. 15 taken along the line 16E-16E of FIG. 16A, according to one or more embodiments.

Referring to FIG. 15, in one or more embodiments, the charge cartridge 370 includes a charge tube 385, cap assemblies 390*a-b*, a centralizing insert 395, and an orienting centralizer 400. The cap assemblies 390*a-b* shown in FIG. 15 include components and features substantially identical (or at least similar) to corresponding components and features of the cap assembly 125*a* shown and described above in connection with FIGS. 3A, 3B, and 4, and, therefore, will not be shown or described in further detail. Likewise, the centralizing insert 395 shown in FIG. 15 is substantially identical (or at least similar) to the centralizing insert 130*b* shown and described above in connection with FIGS. 8A and 8B, and, therefore, will not be shown or described in further detail below. As shown in FIG. 15 (and FIG. 17A), the charge cartridge 370 includes one or more ground conductors 405 (two are shown in the FIGS. 15 and 17A), each of which is toollessly coupled (or coupled without fasteners) to at least the charge tube 385 and adapted to provide grounding electrical contact between the charge tube 385 and the carrier tube 375 when the charge tube 385 is received within the carrier tube 375. Instead of, or in addition to, the one or more ground conductors 405 shown in FIGS. 15 and 17A, in a manner similar to that shown in FIG. 2, the cap assembly 390*a* of the charge cartridge 370 of FIG. 15 includes another ground conductor similar to the ground conductor 205 (e.g., toollessly coupled to the cap assembly 390*a*, and/or coupled to the cap assembly 390*a* without fastener(s)) and adapted to provide grounding electrical contact between the charge tube 385 and the carrier tube 375 when the charge tube 385 is received within the carrier tube 375.

Figure 17A:
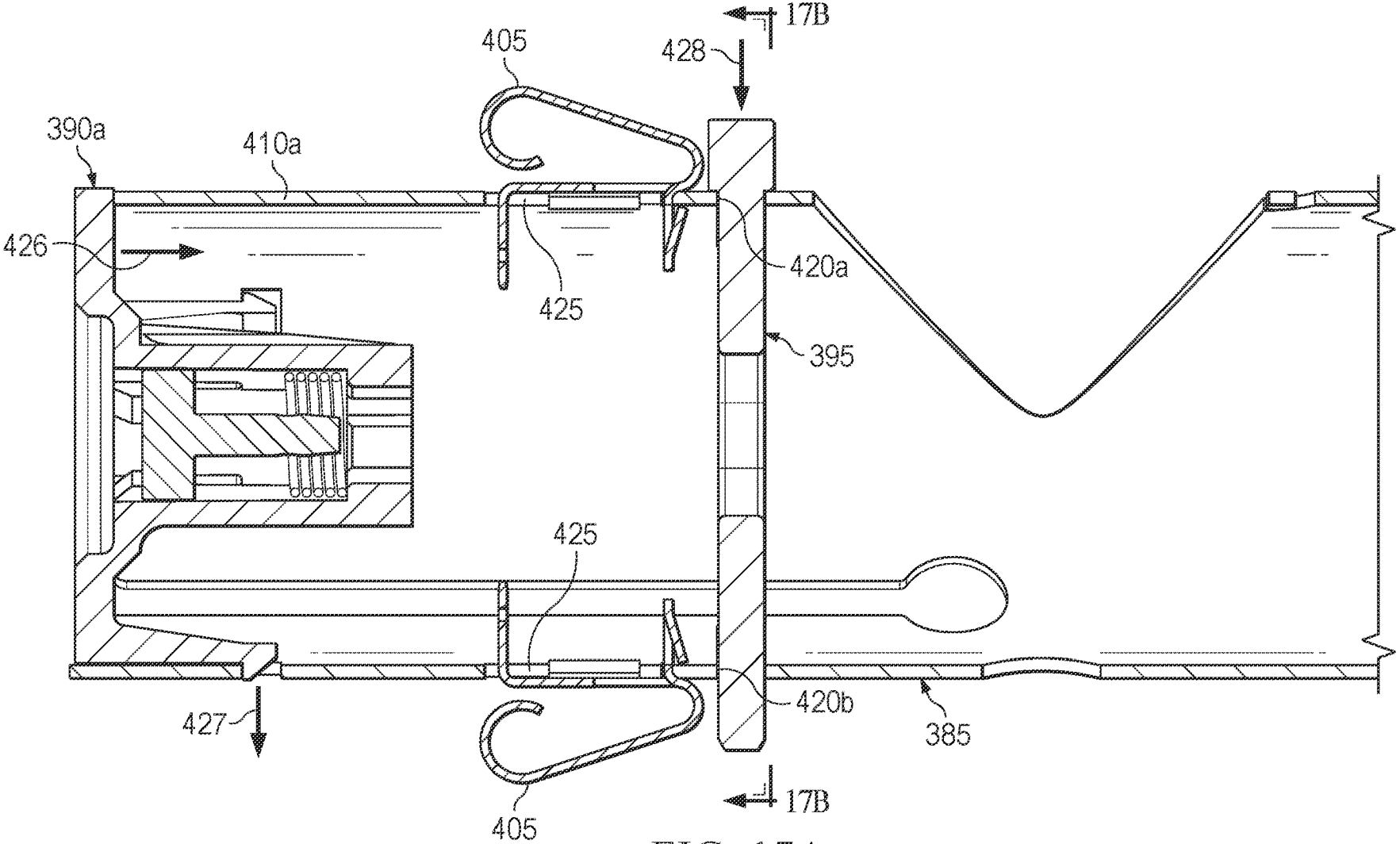
FIG. 17A is a cross-sectional view of the second charge cartridge of FIG. 15 taken along the line 17A-17A of FIG. 14, illustrating, in an assembled state, a first end portion of the second charge tube, the third cap assembly, and the third centralizing insert, according to one or more embodiments.
Figure 17B:
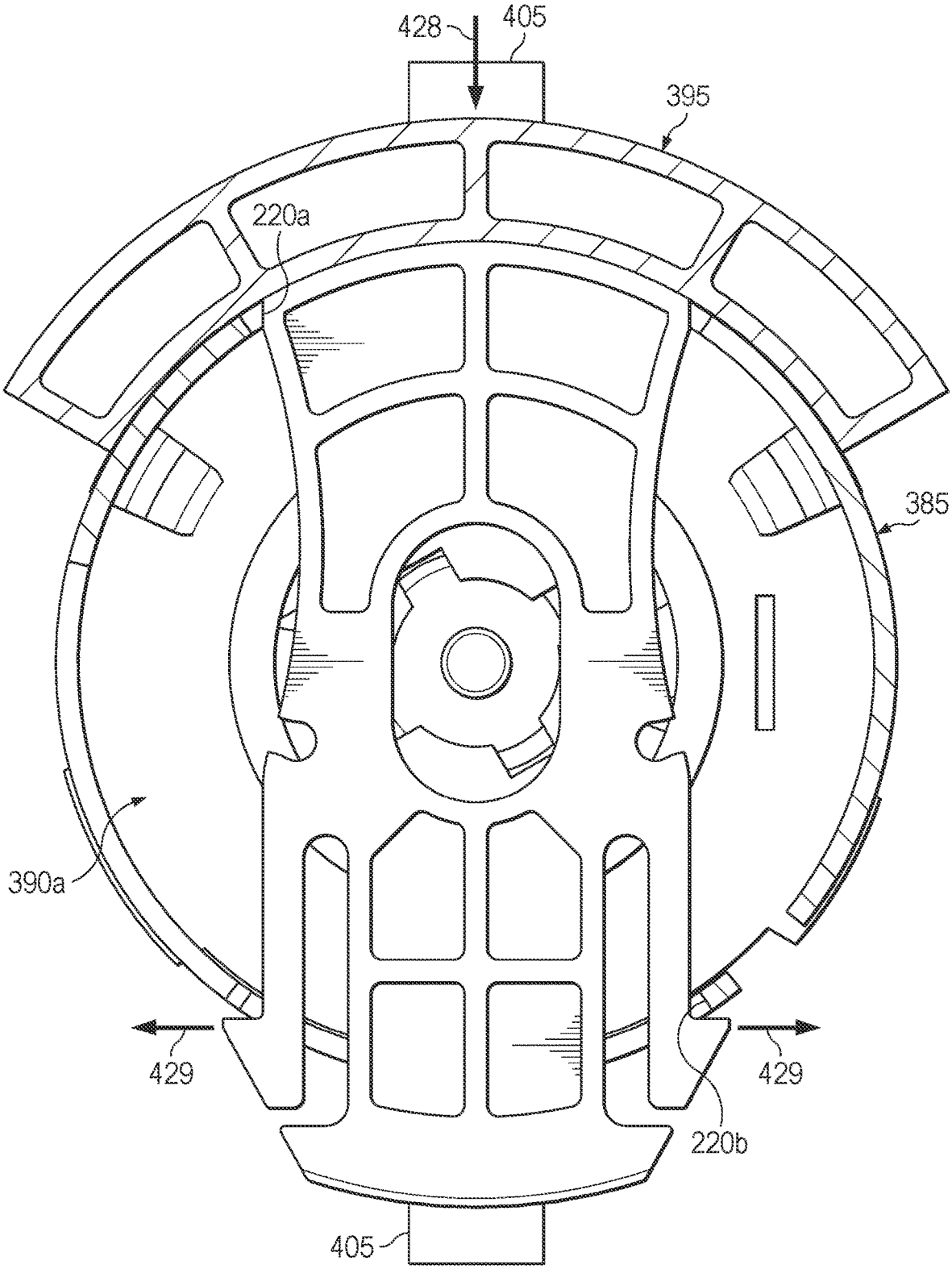
FIG. 17B is a cross-sectional view of the second charge cartridge of FIG. 17A taken along the line 17B-17B of FIG. 17A, according to one or more embodiments.

Referring to FIGS. 16A through 16E, in one or more embodiments, the charge tube 385 defines opposing end portions 410*a-b*. An access port or window 415 is formed radially through the charge tube 385 at or proximate the end portion 410*a* of the charge tube 385, which access port or window 415 permits access to an interior of the charge tube 385 at the end portion 410*a* of the charge tube 385, permitting insertion of a detonator on-site during assembly of the perforating gun 365 and immediately before the perforating gun 365 is deployed into a wellbore. In one or more embodiments, the access port or window 415 extends spirally (e.g., helically) along the charge tube 385; this spiral extension of the access port or window 415 along the charge tube 385 helps to minimize, or at least decrease, a length L4 of the charge tube 385 and, thus, an overall length L5 of the perforating gun 365. In one or more embodiments, the length L4 of the charge tube 385 is a maximum length of the charge tube 385. Additionally, circumferentially-opposing slots 420*a-b* are formed radially through the charge tube 385 at or proximate the end portion 410*a* of the charge tube 385, via which slots 420*a-b* the centralizing insert 395 is insertable transversely through the charge tube 385 (as shown in FIGS. 17A and 17B). When so transversely inserted through the charge tube 385, the centralizing insert 395 is spaced inwardly from the corresponding end of the charge tube 385. The charge tube 385 illustrated in FIGS. 16A through 16E is configured to align the perforating charges in a 180-degree phased relationship with adjacent one(s) of the perforating charges, which 180-degree phased relationship requires adjacent ones of the perforating guns to be properly circumferentially aligned with one another before being run downhole into the wellbore. This circumferential alignment is facilitated by the orienting centralizer 400, as will be described in further detail below.

Referring to FIGS. 17A and 17B, in one or more embodiments, the cap assembly 390*a* and the centralizing insert 395 are assembled (e.g., toollessly and/or without fastener(s)) into the end portion 410*a* of the charge tube 385. The manner in which the cap assembly 390*a* is inserted axially into the end portion 410*a* of the charge tube 385 (as indicated by arrows 426, 427) is substantially identical (or at least similar) to the manner in which the cap assembly 125*a* is inserted axially into the end portion 210*a* of the charge tube 120, as shown and described above in connection with FIG. 7A, and, therefore, will not be described in further detail. Likewise, the manner in which the centralizing insert 395 is inserted transversely through the charge tube 385, via the slots 420*a-b* (as indicated by arrows 428, 429), is substantially identical (or at least similar) to the manner in which the centralizing insert 130*a* is inserted transversely through the charge tube 120, via the slots 220*a-b*, as shown and described above in connection with FIGS. 7A and 7B, and, therefore, will not be described in further detail. In one or more embodiments, as in FIGS. 15 and 17A, the charge cartridge 370 further includes the pair of ground conductors 405 received (e.g., toollessly and/or without fastener(s)) within a corresponding pair of openings 425 formed through the charge tube 385, and are adapted to provide grounding electrical contact between the charge tube 385 and the carrier tube 375 when the charge tube 385 is received within the carrier tube 375. In one or more embodiments, the pair of ground conductors 405 are each electrically coupled to ground (e.g., one or more ground "buttons" within the perforating gun 365) via a quick-connect wire (e.g., enabling toolless coupling of the pair of ground conductors 405 to ground, and/or coupling of the pair of ground conductors 405 to ground without fastener(s)).

Figure 18A:
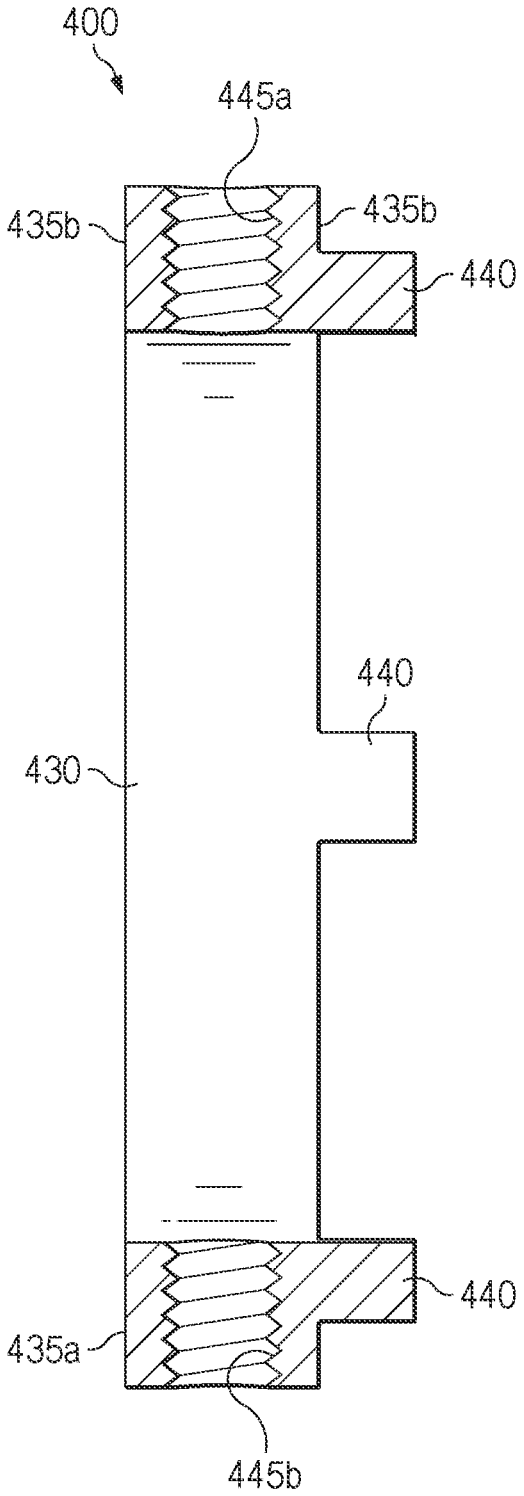
FIG. 18A is a cross-sectional view of the orienting centralizer of FIG. 15, taken along the line 18A-18A of FIG. 14, according to one or more embodiments.
Figure 18B:
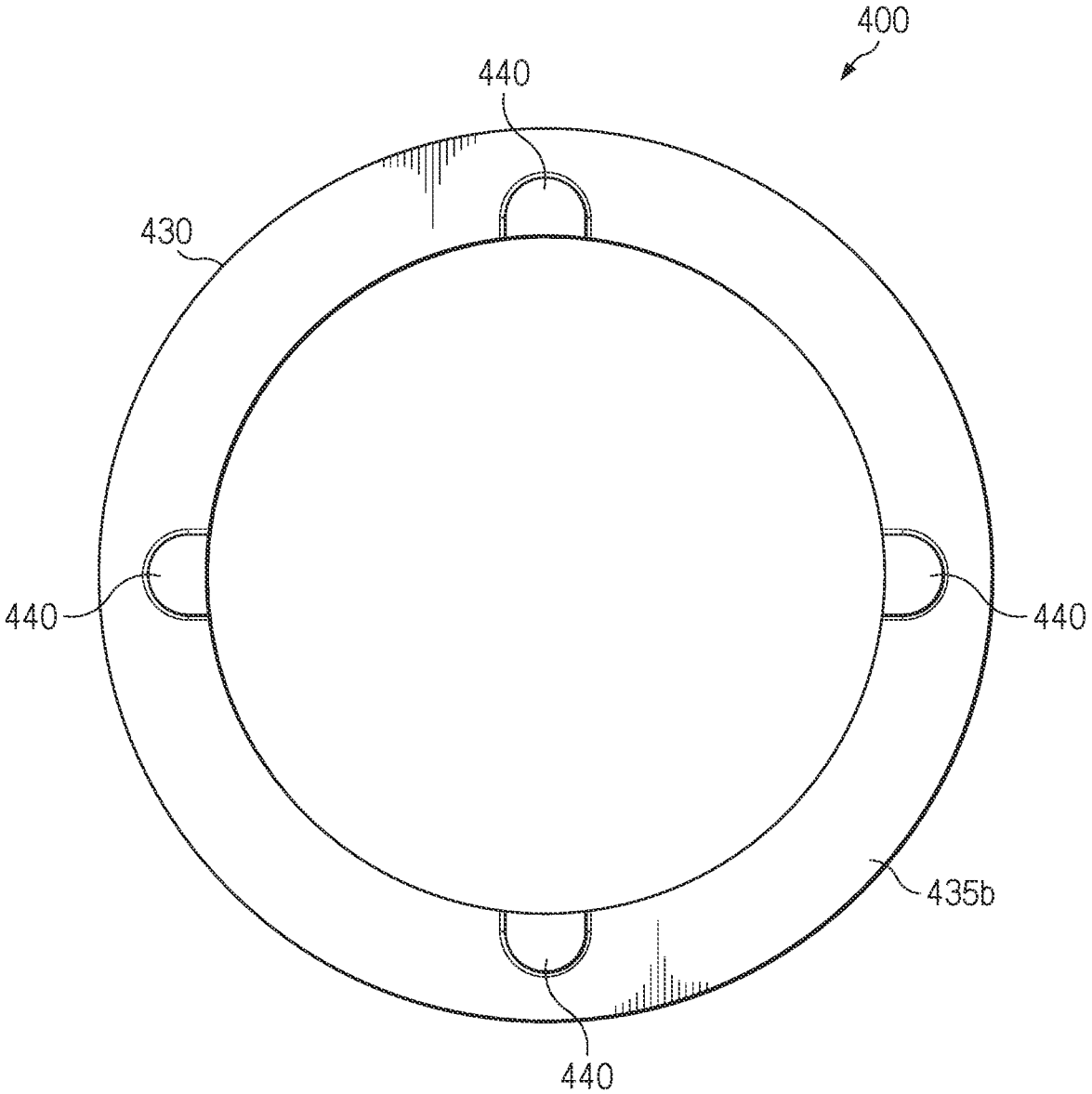
FIG. 18B is a front elevational view of the orienting centralizer of FIG. 15, according to one or more embodiments.

Referring to FIGS. 18A and 18B, in one or more embodiments, the orienting centralizer 400 includes an annular body 430 defining opposing end portions 435*a-b*, and a plurality of orienting keys 440 extending externally from the annular body 430 at the end portion 435*b*. A pair of radial openings 445*a-b* are formed through the annular body 430, which radial openings 445*a-b* are each adapted to receive a set screw 450 to secure the orienting centralizer 400 to the charge tube 385, as will be described in further detail below.

Figure 19A:
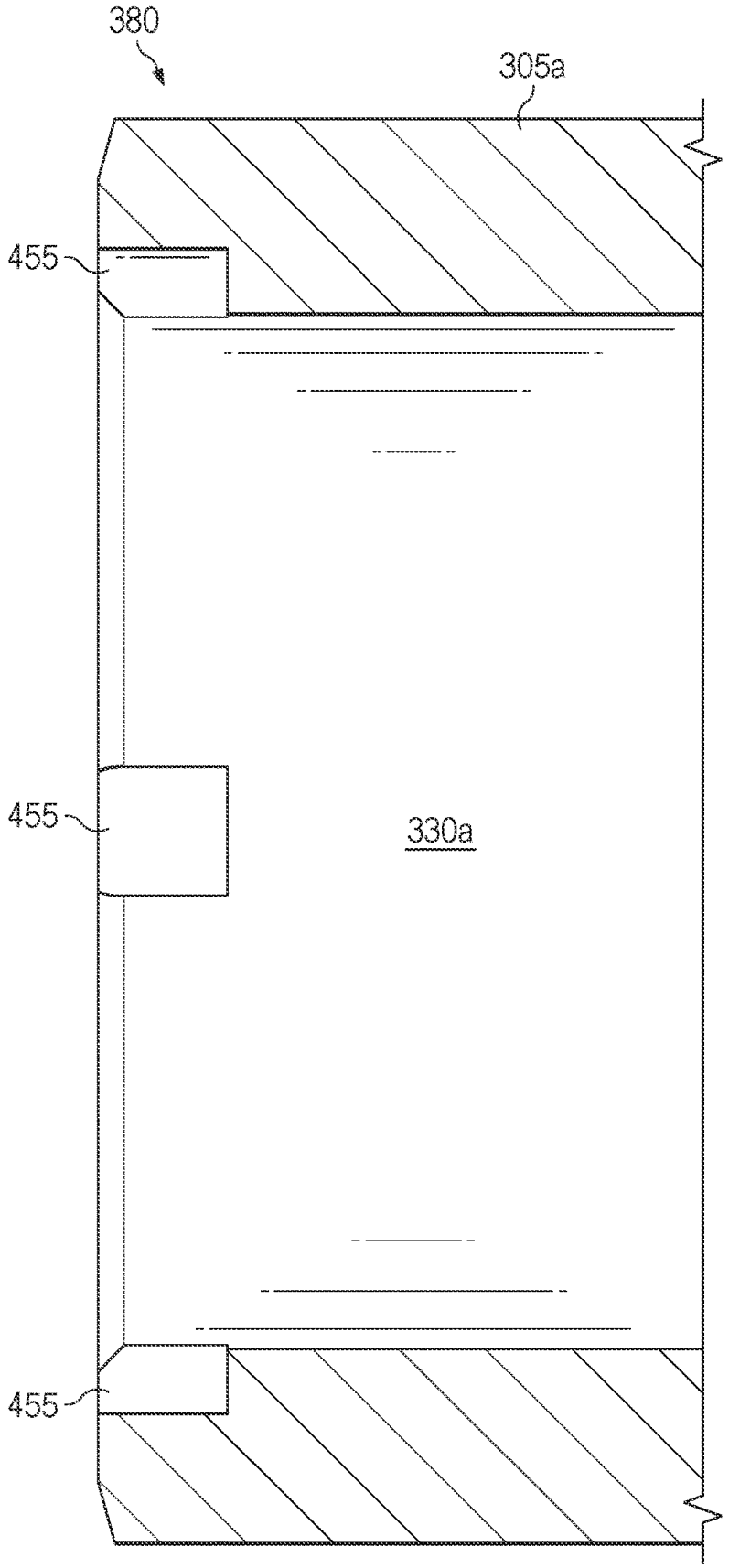
FIG. 19A is a cross-sectional view of a portion of the second conductor sub of FIG. 14 taken along the line 19A-19A of FIG. 14, according to one or more embodiments.
Figure 19B:
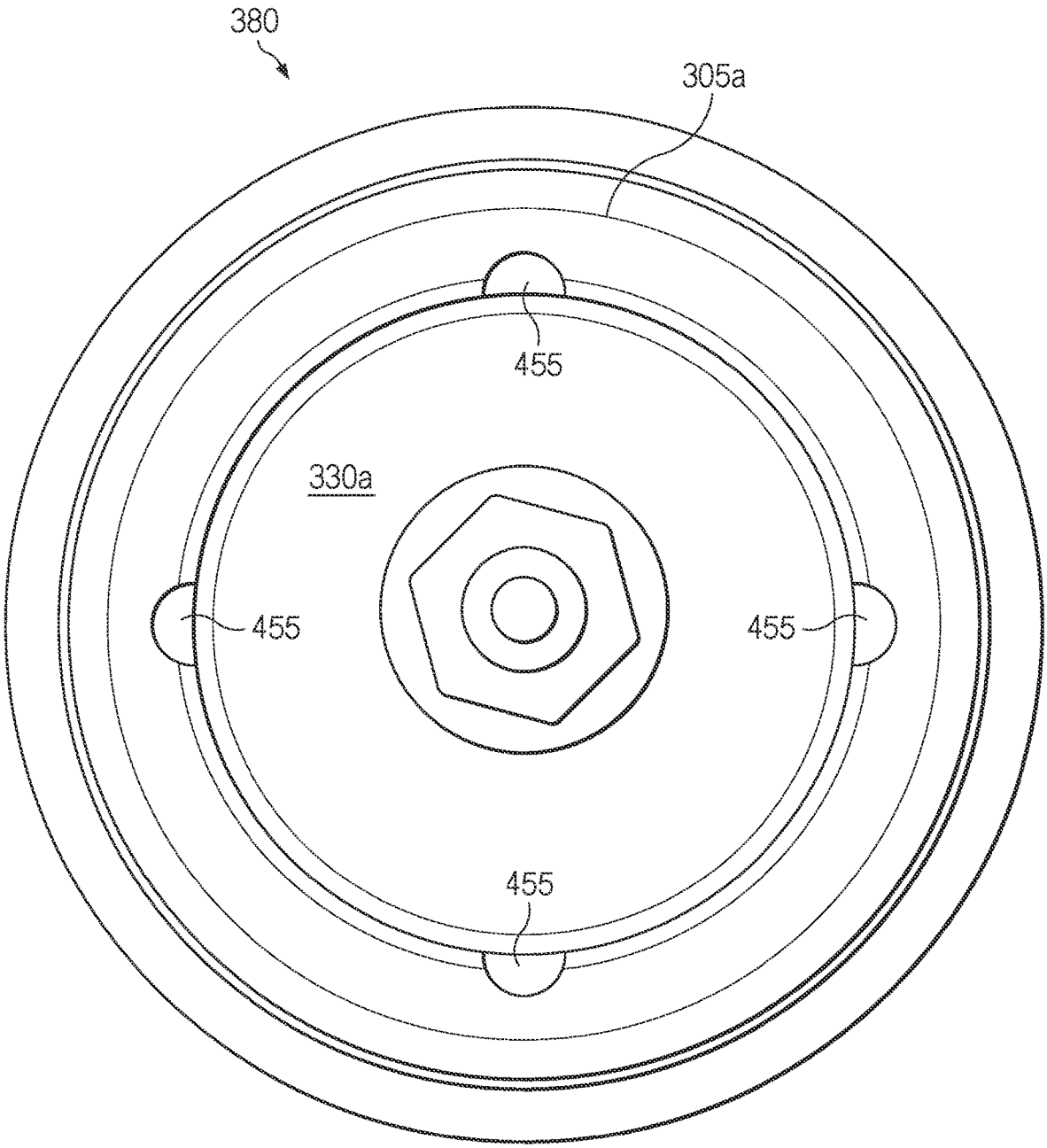
FIG. 19B is a rear elevational view of the second conductor sub of FIG. 14, according to one or more embodiments.

Referring to FIGS. 19A and 19B, in one or more embodiments, the conductor sub 380 includes components and features substantially identical (or at least similar) to corresponding components and features of the conductor sub 115 shown and described above in connection with FIG. 11, which substantially identical (or at least similar) components and features are given the same reference numerals, and will not be described in further detail. Additionally, a plurality of orienting keyways 455 are formed internally into the conductor sub 380 at the end portion 305*a* of the sub body 290 thereof. The plurality of orienting keyways 455 formed internally into the conductor sub 380 at the end portion 305*a* of the sub body 290 thereof are adapted to receive the plurality of orienting keys 440 extending externally from the orienting centralizer 400, as will be described in further detail below.

In one or more embodiments, the conductor sub 380 is or includes one or more components substantially identical (or at least similar) to corresponding component(s) of the conductor sub shown and described in U.S. Application No. 63/154,626 (the "'626 Application"), filed Feb. 26, 2021, the entire disclosure of which is incorporated herein by reference. For example, the conductor assembly 295 of the conductor sub 380 may be substantially identical (or at least similar) to the corresponding component(s) of the conductor sub shown and described in the '626 Application. In addition, or instead, in one or more embodiments, the conductor sub 380 is or includes one or more components identical (or at least similar) to corresponding component(s) of the orienting sub shown and described in U.S. application Ser. No. 17/193,412 (the "'412 Application"), filed Mar. 5, 2021, the entire disclosure of which is hereby incorporated herein by reference. For example, the conductor assembly 295 of the conductor sub 380 may be substantially identical (or at least similar) to the corresponding component(s) of the conductor sub shown and described in the '412 Application.

Figure 20:
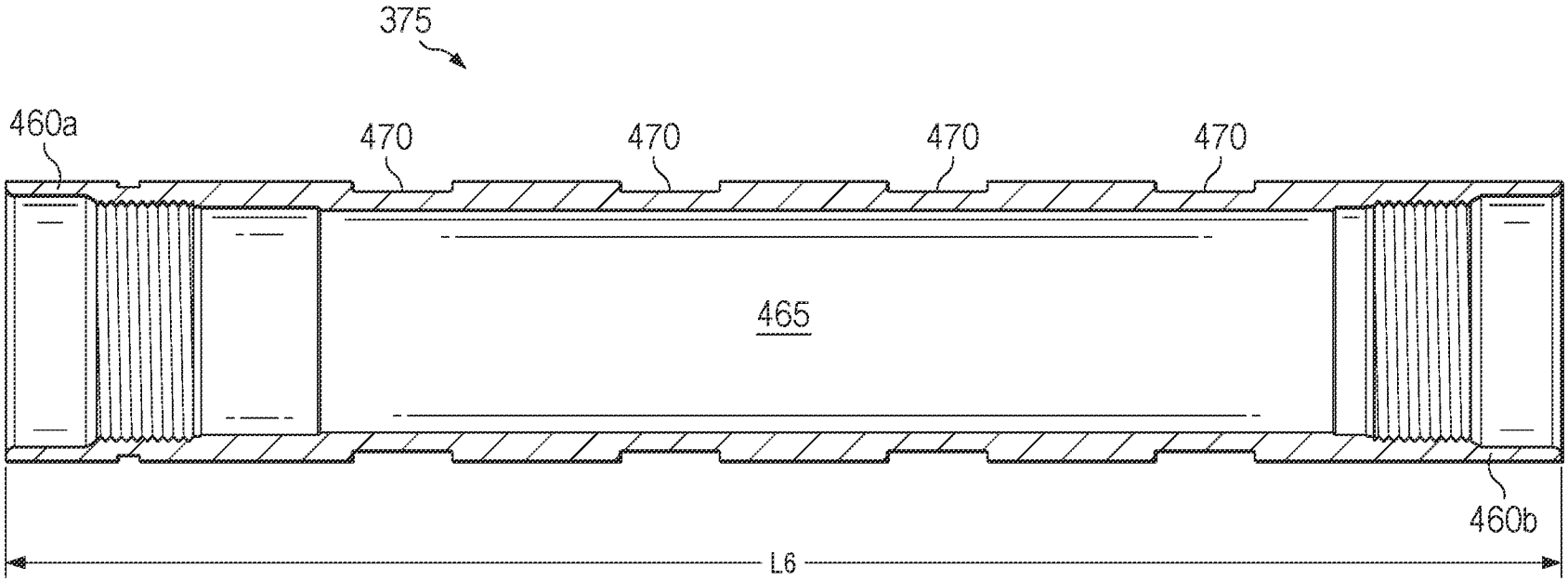
FIG. 20 is a cross-sectional view of the second carrier tube of FIG. 14 taken along the line 20-20 of FIG. 14, according to one or more embodiments.

Referring to FIG. 20, in one or more embodiments, the carrier tube 375 defines opposing end portions 460*a-b* and a central passageway 465 extending axially therethrough. A plurality of banded scallops 470 are formed externally into, and circumferentially around, the carrier tube 375. The plurality of banded scallops 470 eliminate the need to rotationally align the perforating charges (each of which is rotationally aligned in a 180-degree phased relationship with the adjacent one(s) of the perforating charges) with respective ones of the plurality of banded scallops 470 formed externally into the carrier tube 375, as will be described in further detail below.

Referring to FIGS. 21A through 21G, in one or more embodiments, the perforating gun 365 is adapted to be assembled on-site at a wellsite before being run downhole into a wellbore and detonated to perforate the wellbore proximate a subterranean formation. When the perforating gun 365 is fully assembled: the centralizing insert 395 extends transversely through the charge tube 385, as described above; the plurality of orienting keys 440 of the orienting centralizer 400 extend within the plurality of orienting keyways 455 formed into the conductor sub 380; the set screws 450 are received within the radial openings 445*a-b* formed through the annular body 430 of the orienting centralizer 400 to secure orienting centralizer 400 to the charge tube 385 (when so secured to the charge tube 385, the orienting centralizer 400 is spaced inwardly from the corresponding end of the charge tube 385); the charge tube 385 is diametrically centered within the carrier tube 375 with the centralizing insert 395 and the orienting centralizer 400 (in several embodiments, the charge tube 385 is radially centralized, or nearly radially centralized, within the carrier tube 375, with one or both end portions of the centralizing insert 395 contacting the inside surface of the carrier tube 375, and with one or more peripheral portions of the orienting centralizer 400 contacting the inside surface of the carrier tube 375); and the charge cartridge 370 is axially trapped between the conductor sub 380 and an adjacent sub (or other component) connected at the opposing end of the perforating gun 365. As a result, the charge cartridge 370 extends within the axial recess 330*a* formed into the sub body 290 of the conductor sub 380 at the end portion 305*a*; likewise, the charge cartridge 370 may extend within an axial recess formed into the adjacent sub. Such extension of the charge cartridge 370 within the axial recess 330*a* formed into the sub body 290 of the conductor sub 380 at the end portion 305*a* helps to minimize, or at least decrease, the overall length L5 of the perforating gun 365; similarly, such extension of the charge cartridge 370 within the axial recess formed into the adjacent sub helps to minimize, or at least decrease, the overall length L5 of the perforating gun 365.

Figure 21A:
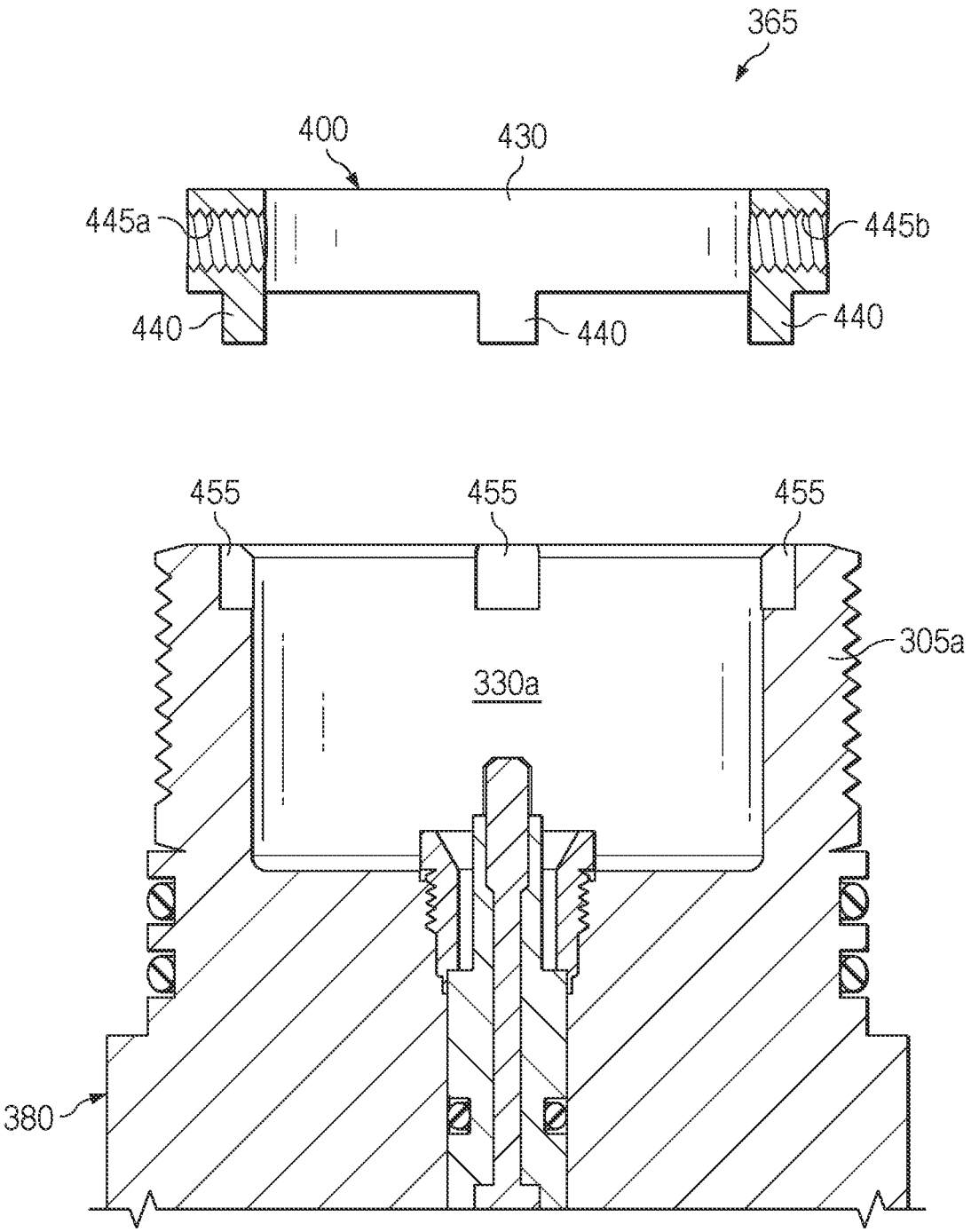
FIG. 21A is an enlarged cross-sectional view of the second perforating gun of FIG. 14 in a first operational state or configuration, according to one or more embodiments.
Figure 21B:
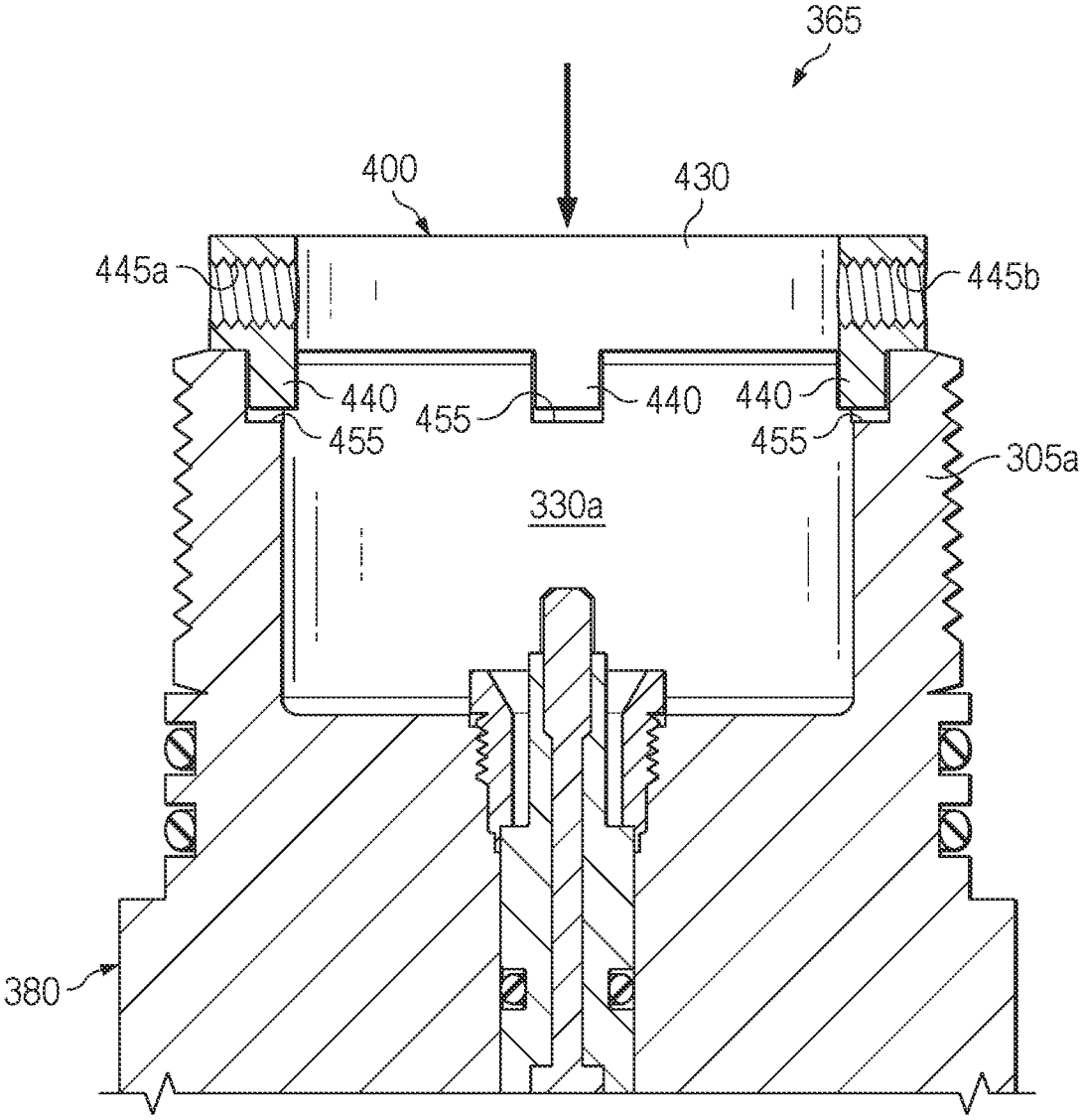
FIG. 21B is an enlarged cross-sectional view of the second perforating gun of FIG. 14 in a second operational state or configuration, according to one or more embodiments.
Figure 21C:
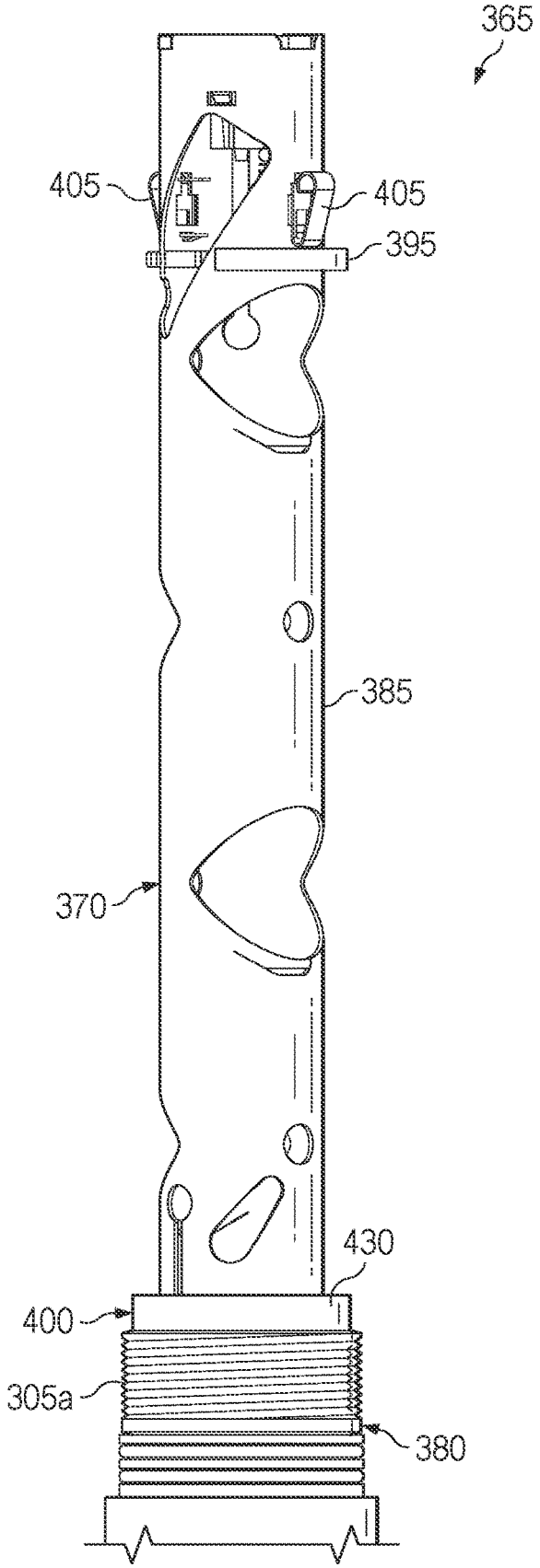
FIG. 21C is an elevational view of the second perforating gun of FIG. 14 in a third operational state or configuration, according to one or more embodiments.
Figures 1, 21D:
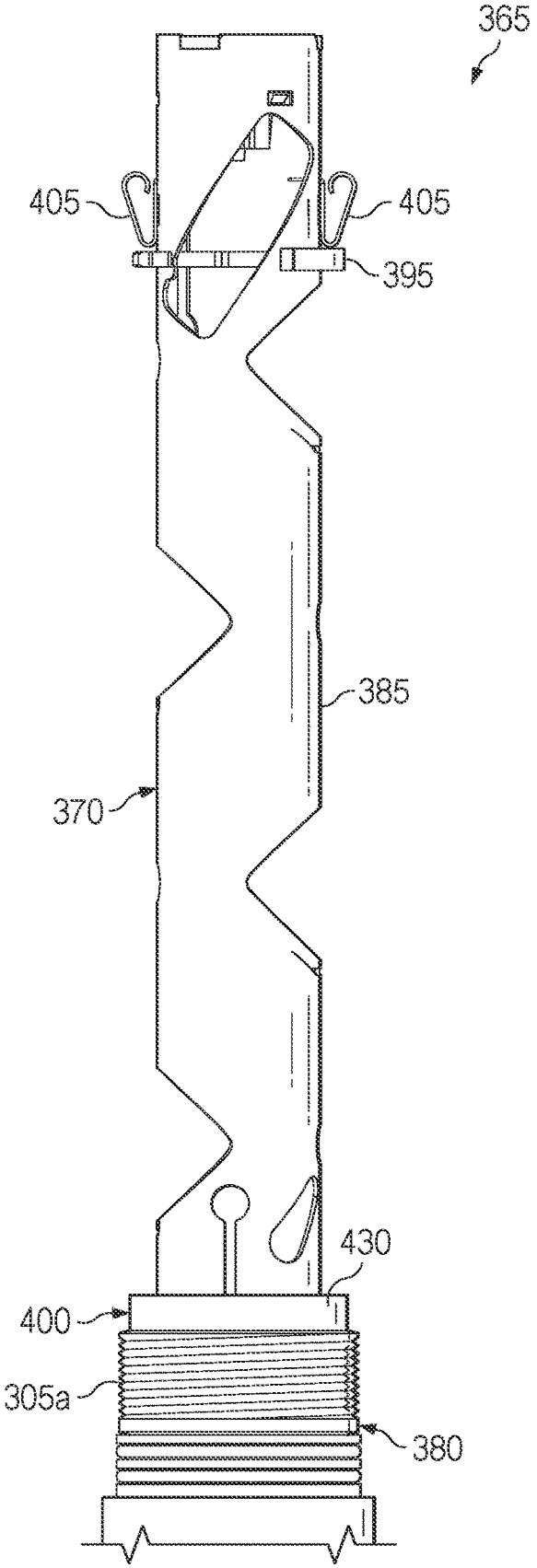
Figures 2, 21D:
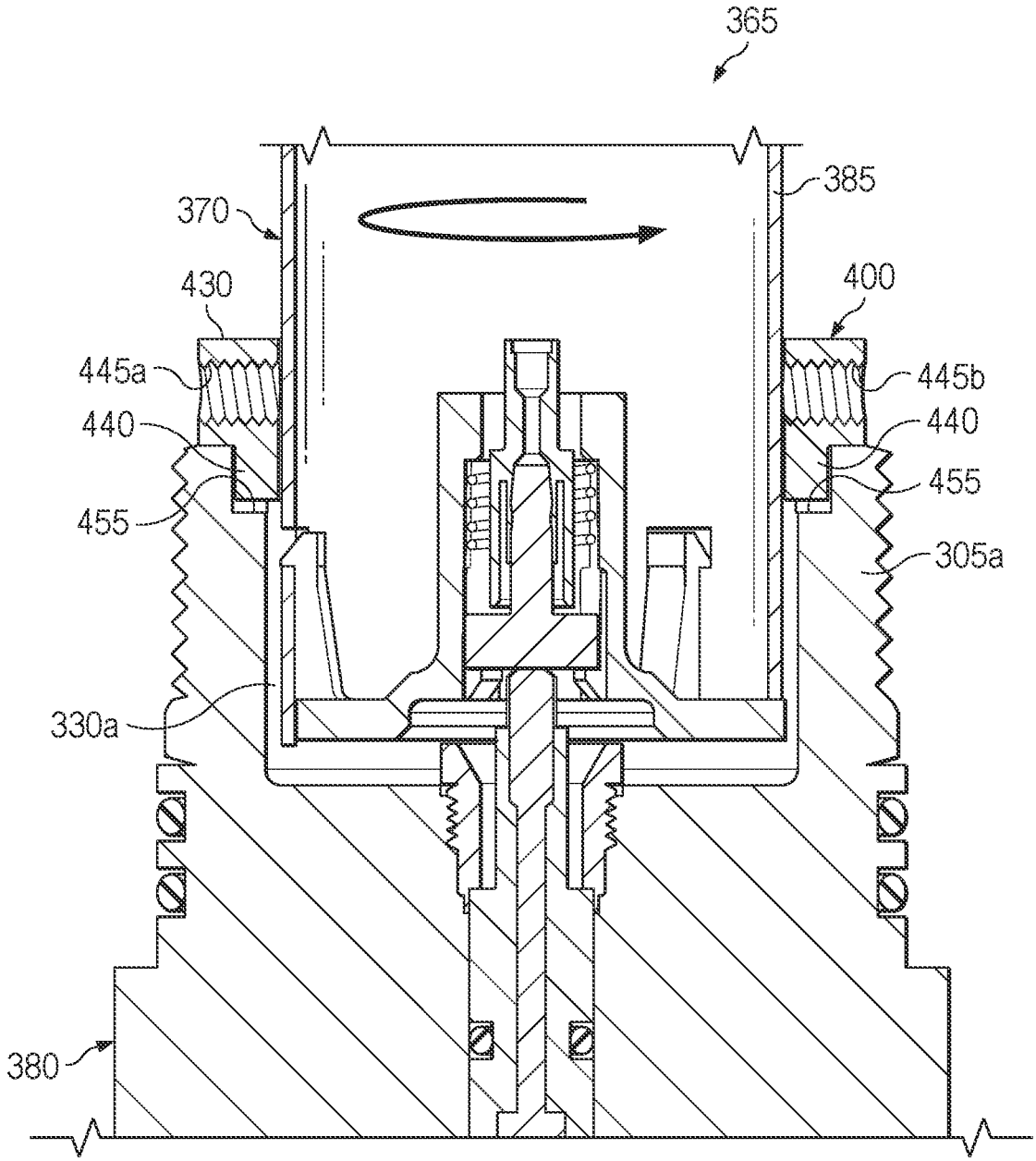
Figure 21E:
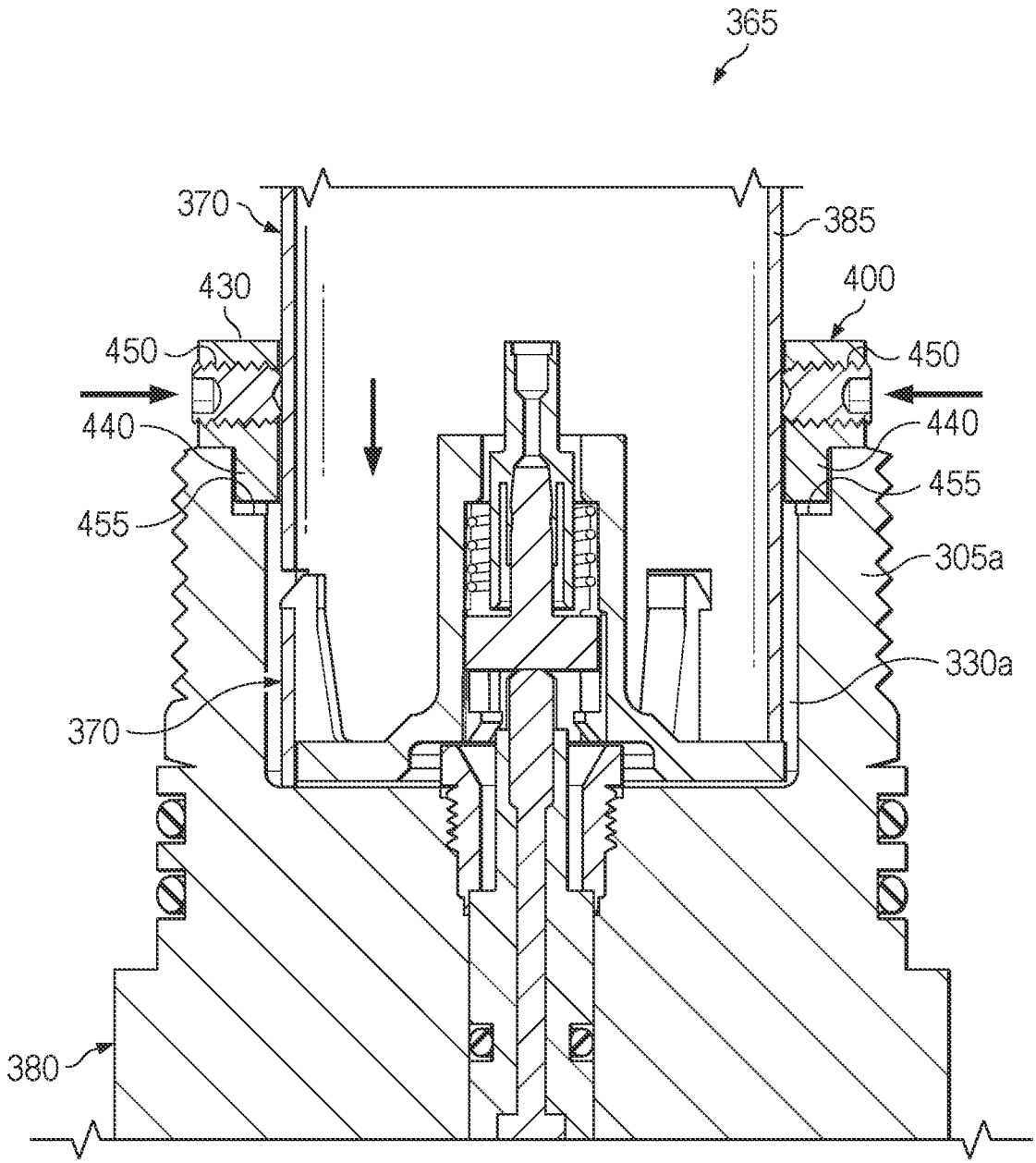
FIG. 21E is an enlarged cross-sectional view of the second perforating gun of FIG. 14 in a fifth operational state or configuration, according to one or more embodiments.
Figure 21F:
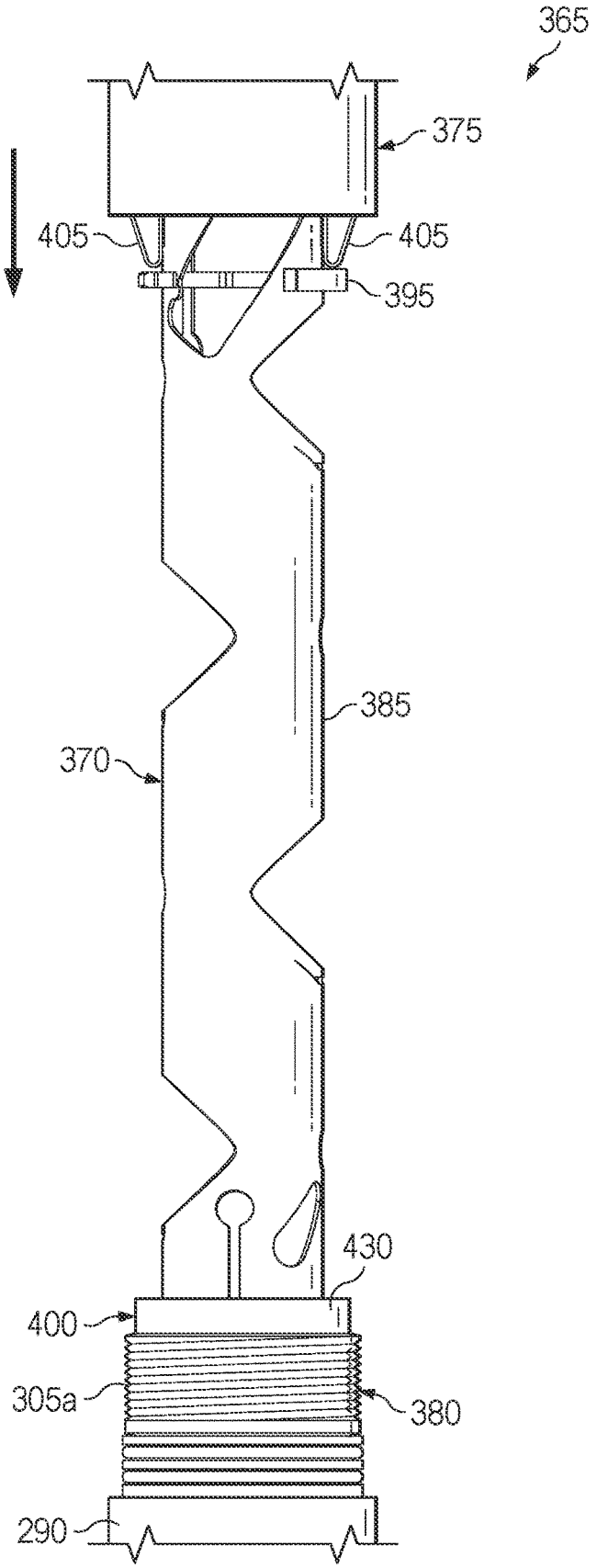
FIG. 21F is an elevational view of the second perforating gun of FIG. 14 in a sixth operation state or configuration, according to one or more embodiments.
Figure 21G:
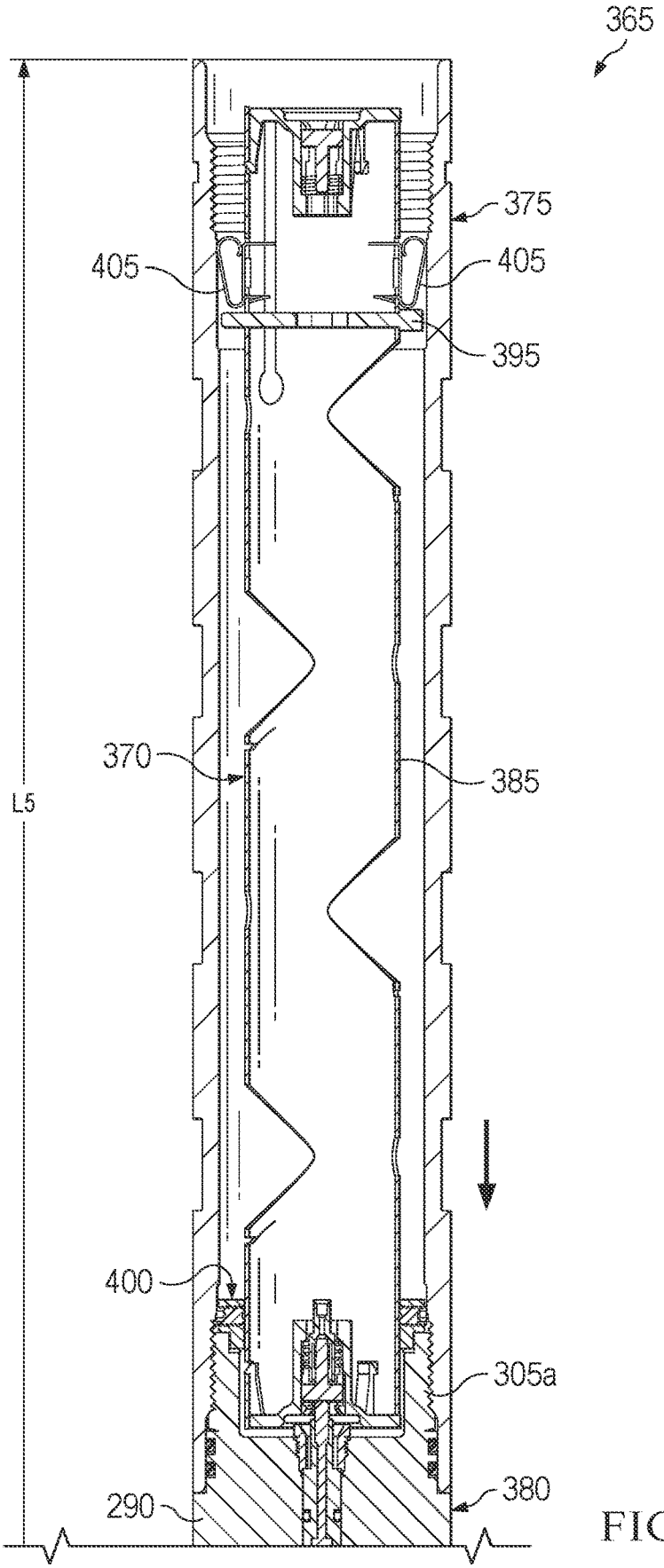
FIG. 21G is a cross-sectional view of the second perforating gun of FIG. 14 in a seventh operational state or configuration, according to one or more embodiments.

Prior to or after receiving the set screws 450 within the radial openings 445*a-b* formed through the annular body 430 of the orienting centralizer 400 to secure orienting centralizer 400 to the charge tube 385 (as shown in FIG. 21E): the plurality of orienting keys 440 of the orienting centralizer 400 are received within the plurality of orienting keyways 455 formed into the conductor sub 380 (as shown in FIG. 21B); the charge tube 385 is received through the orienting centralizer 400 and into the end portion 305*a* of the conductor sub 380 (as shown in FIG. 21C); and the charge tube 385 is rotated freely to rotationally align the perforating charges loaded in the charge tube 385 (each of which is rotationally aligned in a 180-degree phased relationship with the adjacent one(s) of the perforating charges) as desired, for example, with one or more perforating charges in an adjacent perforating gun (as shown in FIGS. 21D-1 and 21D-2). Such alignment between the shaped charges in adjacent perforating guns may be desirable, for example, in instances where the tool string also includes a weight bar to ensure proper downhole orientation of the shaped charges to perforate the wellbore at a specific angle. After receiving the set screws 450 within the radial openings 445*a-b* formed through the annular body 430 of the orienting centralizer 400 to secure orienting centralizer 400 to the charge tube 385 (as shown in FIG. 21E), the carrier tube 375 is sheathed over the charge cartridge 370 and threaded to the end portion 305*a* of the conductor sub 380; as a result, the perforating charges loaded in the charge tube 385 are axially aligned with respective ones of the plurality of banded scallops 470 formed externally into the carrier tube 375.

In one or more embodiments, the charge tube 385 defines the length L4, the carrier tube 375 defines a length L6, and a ratio of the length L4 to the length L6 is: equal to or greater than 0.2; equal to or greater than 0.3; equal to or greater than 0.4; equal to or greater than 0.5; equal to or greater than 0.6; equal to or greater than 0.7; equal to or greater than 0.75; equal to or greater than 0.775; equal to or greater than 0.8; equal to or greater than 0.825; equal to or greater than 0.85; equal to or greater than 0.875; equal to or greater than 0.9; or equal to or greater than 0.925. In one or more embodiments, the length L6 of the carrier tube 375 is a maximum length of the carrier tube 375. In several embodiments, the increased ratio of the length L4 to the length L6 helps to minimize, or at least decrease, the overall length L5 of the perforating gun 365. In several embodiments, the embodiments illustrated in the figures (including in, e.g., FIG. 14) provide a ratio of the length L4 of the charge tube 385 to the length L6 of the carrier tube 375 of equal to or greater than 0.7, 0.75, 0.9, or 0.925, thereby minimizing or at least decreasing the overall length L5 of the perforating gun 365.

Referring again to FIG. 13, in one or more embodiments the perforating gun 365 is assembled in series with one or more other perforating guns to form a gun string along which electricity is communicable to detonate the ballistic(s) of each perforating gun.

In several embodiments, one or more of the embodiments of the present application are provided in whole or in part as described and illustrated in the '338 Application and the '440 Application, each of which forms part of the present application.

In several embodiments, as noted above, the plurality of banded scallops 470 are formed externally into, and circumferentially around, the carrier tube 375 of FIG. 20; in several embodiments, instead of, or in addition to, the carrier tube 375 of FIG. 20, one or more banded scallops similar to those illustrated in FIG. 20 are formed externally into, and circumferentially around, one or more of the carrier tubes described above, illustrated in the figures, illustrated in the '338 Application, illustrated in the '440 Application, or any combination thereof. In several embodiments, one or more banded scallops similar to those illustrated in FIG. 20 are formed externally into, and circumferentially around, one or more of the carrier tubes described above, illustrated in the figures, illustrated in the '338 Application, illustrated in the '440 Application, or any combination thereof. In several embodiments, any perforating gun that does not include an orienting centralizer, which perforating gun is described above, illustrated in the figures, illustrated in the '338 Application, illustrated in the '440 Application, or any combination thereof, may include banded scallops that, in some embodiments, are similar to those illustrated in FIG. 20.

In several embodiments, any charge cartridge described above, illustrated in the figures, illustrated in the '338 Application, illustrated in the '440 Application, or any combination thereof, includes one keyed centralizing insert and one non-keyed centralizing insert, one keyed centralizing insert and another keyed centralizing insert, or one non-keyed centralizing insert and another non-keyed centralizing insert. In several embodiments, any perforating gun that does not include an orienting centralizer, which perforating gun is described above, illustrated in the figures, illustrated in the '338 Application, illustrated in the '440 Application, or any combination thereof, may include one keyed centralizing insert and one non-keyed centralizing insert, one keyed centralizing insert and another keyed centralizing insert, or one non-keyed centralizing insert and another non-keyed centralizing insert.

In several embodiments, one or more of the embodiments described and illustrated in the '440 Application are combined in whole or in part with one or more of the embodiments described above, one or more of the embodiments described and illustrated in the '338 Application, and/or one or more of the other embodiments described and illustrated in the '440 Application.

A perforating gun has been disclosed according to a first aspect, which perforating gun generally includes: a carrier tube; a charge tube extending within the carrier tube, the charge tube containing one or more perforating charges; and a conductor sub containing the charge tube within the carrier tube, the conductor sub being adapted to facilitate detonation of the one or more perforating charges; wherein the charge tube defines a first length, the first length being a maximum length of the charge tube; wherein the carrier tube defines a second length, the second length being a maximum length of the carrier tube; and wherein the perforating gun is configured so that a ratio of the first length of the charge tube to the second length of the carrier tube is greater than or equal to 0.7, thereby minimizing, or at least decreasing, an overall length of the perforating gun. In one or more embodiments, the perforating gun further includes a recess formed into the conductor sub; wherein the charge tube extends within the recess to minimize, or at least decrease, the overall length of the perforating gun. In one or more embodiments, the perforating gun further includes: an orienting centralizer including an orienting key; and an orienting keyway formed into the conductor sub; wherein the orienting key is received within the orienting keyway to prevent, or at least reduce, relative rotation between the orienting centralizer and the conductor sub. In one or more embodiments, the perforating gun further includes: one or more fasteners adapted to secure the orienting centralizer to the charge tube to prevent, or at least reduce, relative rotation between the charge tube and the orienting centralizer. In one or more embodiments, the perforating gun further includes a centralizing insert extending transversely through the charge tube; wherein the centralizing insert defines opposing first and second end portions, each of which extends radially beyond the charge tube. In one or more embodiments, the perforating gun further includes first and second circumferentially-opposing slots, each of which is formed radially through the charge tube; wherein the centralizing insert includes a latching feature at the second end portion; and wherein the latching feature is latched to the charge tube at the second slot. In one or more embodiments, the perforating gun further includes: an orienting key extending from the centralizing insert at the first end portion; and an orienting keyway formed internally into the carrier tube; wherein the orienting key is received within the orienting keyway to prevent, or at least reduce, relative rotation between the centralizing insert and the carrier tube. In one or more embodiments, the perforating gun further includes an access port or window formed radially through the charge tube proximate an end portion of the charge tube to permit insertion of a detonator into the charge tube; wherein the access port or window extends spirally along the charge tube to minimize, or at least decrease, the overall length of the perforating gun. In one or more embodiments, the perforating gun further includes a cap assembly received within an end portion of the charge tube, the cap assembly being adapted to further facilitate detonation of the one or more perforating charges. In one or more embodiments, the cap assembly includes: a conductor housing; a conductor body contained within the conductor housing; and an electrical connector toollessly coupled to the conductor body to further facilitate detonation of the one or more perforating charges. In one or more embodiments, the perforating gun further includes a ground connector toollessly coupled to the charge tube and configured to provide grounding electrical contact between the charge tube and the carrier tube.

A perforating gun has been disclosed according to a second aspect, which perforating gun generally includes: a carrier tube; a charge tube extending within the carrier tube, the charge tube containing one or more perforating charges; and a conductor sub containing the charge tube within the carrier tube, the conductor sub being adapted to facilitate detonation of the one or more perforating charges; wherein a recess is formed into the conductor sub; and wherein the charge tube extends within the recess. In one or more embodiments, the perforating gun further includes: an orienting centralizer including an orienting key; and an orienting keyway formed into the conductor sub; wherein the orienting key is received within the orienting keyway to prevent, or at least reduce, relative rotation between the orienting centralizer and the conductor sub. In one or more embodiments, the perforating gun further includes one or more fasteners adapted to secure the orienting centralizer to the charge tube to prevent, or at least reduce, relative rotation between the charge tube and the orienting centralizer. In one or more embodiments, the perforating gun further includes: a centralizing insert extending transversely through the charge tube; wherein the centralizing insert defines opposing first and second end portions, each of which extends radially beyond the charge tube. In one or more embodiments, the perforating gun further includes first and second circumferentially-opposing slots, each of which is formed radially through the charge tube; wherein the centralizing insert includes a latching feature at the second end portion; and wherein the latching feature is latched to the charge tube at the second slot. In one or more embodiments, the perforating gun further includes: an orienting key extending from the centralizing insert at the first end portion; and an orienting keyway formed internally into the carrier tube; wherein the orienting key is received within the orienting keyway to prevent, or at least reduce, relative rotation between the centralizing insert and the carrier tube. In one or more embodiments, the perforating gun further includes an access port or window formed radially through the charge tube proximate an end portion of the charge tube to permit insertion of a detonator into the charge tube; wherein the access port or window extends spirally along the charge tube. In one or more embodiments, the perforating gun further includes a cap assembly received within an end portion of the charge tube, the cap assembly being adapted to further facilitate detonation of the one or more perforating charges.

A perforating gun has been disclosed according to a third aspect, which perforating gun generally includes: a carrier tube; a charge tube extending within the carrier tube, the charge tube containing one or more perforating charges; a conductor sub containing the charge tube within the carrier tube, the conductor sub being adapted to facilitate detonation of the one or more perforating charges; and at least one centralizing insert extending transversely through the charge tube; wherein the at least one centralizing insert defines opposing first and second end portions, each of which extends radially beyond the charge tube. In one or more embodiments, the perforating gun further includes first and second circumferentially-opposing slots, each of which is formed radially through the charge tube; wherein the at least one centralizing insert includes a latching feature at the second end portion; and wherein the latching feature is latched to the charge tube at the second slot. In one or more embodiments, the perforating gun further includes: an orienting key extending from the at least one centralizing insert at the first end portion; and an orienting keyway formed internally into the carrier tube; wherein the orienting key is received within the orienting keyway to prevent, or at least reduce, relative rotation between the at least one centralizing insert and the carrier tube. In one or more embodiments, the perforating gun further includes: an orienting centralizer including an orienting key; and an orienting keyway formed into the conductor sub; wherein the orienting key is received within the orienting keyway to prevent, or at least reduce, relative rotation between the orienting centralizer and the conductor sub. In one or more embodiments, the perforating gun further includes: one or more fasteners adapted to secure the orienting centralizer to the charge tube to prevent, or at least reduce, relative rotation between the charge tube and the orienting centralizer. In one or more embodiments, the perforating gun further includes: an access port or window formed radially through the charge tube proximate an end portion of the charge tube to permit insertion of a detonator into the charge tube; wherein the access port or window extends spirally along the charge tube. In one or more embodiments, the perforating gun further includes: a cap assembly received within an end portion of the charge tube, the cap assembly being adapted to further facilitate detonation of the one or more perforating charges.

A perforating gun has been disclosed according to a fourth aspect, which perforating gun generally includes: a carrier tube; a charge tube extending within the carrier tube, the charge tube containing one or more perforating charges; a conductor sub containing the charge tube within the carrier tube, the conductor sub being adapted to facilitate detonation of the one or more perforating charges; an orienting centralizer including an orienting key; and an orienting keyway formed into the conductor sub; wherein the orienting key is received within the orienting keyway to prevent, or at least reduce, relative rotation between the orienting centralizer and the conductor sub. In one or more embodiments, the perforating gun further includes: one or more fasteners adapted to secure the orienting centralizer to the charge tube to prevent, or at least reduce, relative rotation between the charge tube and the orienting centralizer. In one or more embodiments, the perforating gun further includes an access port or window formed radially through the charge tube proximate an end portion of the charge tube to permit insertion of a detonator into the charge tube; wherein the access port or window extends spirally along the charge tube. In one or more embodiments, the perforating gun further includes a cap assembly received within an end portion of the charge tube, the cap assembly being adapted to further facilitate detonation of the one or more perforating charges.

It is understood that variations may be made in the foregoing without departing from the scope of the disclosure.

In several embodiments, the elements and teachings of the various illustrative embodiments may be combined in whole or in part in some or all of the illustrative embodiments. In addition, one or more of the elements and teachings of the various illustrative embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, or one or more of the procedures may also be performed in different orders, simultaneously or sequentially. In several embodiments, the steps, processes or procedures may be merged into one or more steps, processes or procedures. In several embodiments, one or more of the operational steps in each embodiment may be omitted. Moreover, in some instances, some features of the present disclosure may be employed without a corresponding use of the other features. Moreover, one or more of the embodiments disclosed above and in the '338 and '440 Applications, or variations thereof, may be combined in whole or in part with any one or more of the other embodiments described above and in the '338 and '440 Applications, or variations thereof.

Although several embodiments have been disclosed in detail above and in the '338 and '440 Applications, the embodiments disclosed are exemplary only and are not limiting, and those skilled in the art will readily appreciate that many other modifications, changes, and substitutions are possible in the embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. An apparatus for a perforating gun, the apparatus comprising:

a conductor housing, defining:

recess; and an internal bore extending through the conductor housing from the recess;

a charge cartridge defining opposing first and second end portions, the charge cartridge comprising a first cap assembly at the first end portion; and an annular body;

wherein the conductor housing is at least partially received into a carrier tube in which the charge cartridge extends;

wherein the recess at least partially receives the first end portion of the charge cartridge including the first cap assembly;

and wherein the annular body radially supports the charge cartridge, during rotational movement of the charge cartridge or otherwise, at a position between the first cap assembly and the second end portion.

2. The apparatus of claim 1, further comprising:

a conductor body extending through the internal bore of the conductor housing;

wherein a portion of the conductor body extends within the recess; and wherein the conductor body is adapted to facilitate detonation of one or more charges extending within.

3. The apparatus of claim 2, wherein the charge cartridge further comprises a charge tube; and wherein the first cap assembly is operably coupled to the charge tube and adapted to further facilitate detonation of the one or more perforating charges extending within the charge cartridge.

4. The apparatus of claim 3, wherein the annular body radially supports the charge tube, during rotational movement of the charge cartridge or otherwise, between the first cap assembly and the second end portion.

5. The apparatus of claim 1, further comprising the carrier tube in which the charge cartridge extends.

6. The apparatus of claim 5, wherein the annular body defines an external surface radially adjacent, or at least proximate, an interior surface of the carrier tube.

7. The apparatus of claim 1, wherein the conductor housing is or includes a sub body defining:

a third end portion received into the carrier tube, into which third end portion the first recess is formed; and a fourth end portion received into another carrier tube.

8. The apparatus of claim 1, wherein the charge cartridge further comprises a second cap assembly at the second end portion; and wherein the annular body radially supports the charge cartridge, during rotational movement of the charge cartridge or otherwise, between the first cap assembly and the second cap assembly.

9. The apparatus of claim 1, wherein the annular body extends entirely outside the recess defined in the conductor housing.

* * * * *